US010147261B2

(12) United States Patent
Kojima et al.

(10) Patent No.: US 10,147,261 B2
(45) Date of Patent: Dec. 4, 2018

(54) MEDIUM HANDOVER DEVICE

(71) Applicant: Oki Electric Industry Co., Ltd., Tokyo (JP)

(72) Inventors: Ryousuke Kojima, Tokyo (JP); Ikuo Suto, Tokyo (JP); Kenji Kadota, Tokyo (JP); Akira Gotou, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/545,297

(22) PCT Filed: Jan. 29, 2016

(86) PCT No.: PCT/JP2016/052730
§ 371 (c)(1),
(2) Date: Jul. 20, 2017

(87) PCT Pub. No.: WO2016/132866
PCT Pub. Date: Aug. 25, 2016

(65) Prior Publication Data

US 2018/0005479 A1 Jan. 4, 2018

(30) Foreign Application Priority Data

Feb. 16, 2015 (JP) ..... 2015-027835

(51) Int. Cl.

| | |
|---|---|
| ***G07D 11/00*** | (2006.01) |
| ***G07D 1/00*** | (2006.01) |
| ***G07D 9/00*** | (2006.01) |
| *B65H 5/02* | (2006.01) |
| *B65H 43/04* | (2006.01) |

(52) U.S. Cl.
CPC ..... *G07D 11/0021* (2013.01); *G07D 1/00* (2013.01); *G07D 9/00* (2013.01); *B65H 5/023* (2013.01); *B65H 43/04* (2013.01); *B65H 2701/1912* (2013.01); *G07D 9/002* (2013.01)

(58) Field of Classification Search
CPC ..... B65H 5/023; B65H 43/04; B65H 2701/1912; G07D 11/0021; G07D 11/0033
See application file for complete search history.

(56) References Cited

U.S. PATENT DOCUMENTS 7,624,977 B2 * 12/2009 Lee ..... G07D 11/006 271/3.01
2008/0284085 A1 11/2008 Curina et al.
2013/0313773 A1 * 11/2013 Komatsu ..... B65H 3/44 271/265.01

FOREIGN PATENT DOCUMENTS

JP S58-6838 Y2 2/1983
JP H02-163258 A 6/1990
JP 5156097 B2 3/2013
(Continued)

*Primary Examiner* — Michael C McCullough
(74) *Attorney, Agent, or Firm* — Rabin & Berdo, P.C.

(57) ABSTRACT

A bundle conveyance unit conveys a medium bundle created by a storage unit in a conveyance direction along a bundle conveyance path. Either the storage unit or the bundle conveyance unit includes a conveyance guide that is disposed at a connection location between the storage unit and the bundle conveyance unit, that forms a portion of the bundle conveyance path, and that transitions between a state communicating the bundle conveyance path with the inside of a reject storage box, and a state communicating the bundle conveyance path with the inside of a stacking section.

13 Claims, 33 Drawing Sheets

(56) References Cited

FOREIGN PATENT DOCUMENTS

| | | | |
|---|---|---|---|
| WO | WO-2007/057471 | A1 | 5/2007 |
| WO | WO-2010/032280 | A1 | 3/2010 |

* cited by examiner

MEDIUM HANDOVER DEVICE

TECHNICAL FIELD

The present disclosure relates to a medium handover device, and is well-suited to application in, for example, a banknote pay-out device that pays out banknotes as a medium.

BACKGROUND ART

Hitherto, banknote pay-out devices that pay out cash such as banknotes and coins in response to a request by a user (for example a customer of the financial institution) are widely employed in financial institutions and the like.

There has been a proposal for a banknote pay-out device including, for example, banknote storage boxes that store banknotes, a conveyance section that conveys banknotes, a classification section that classifies banknotes, a stacking section that stacks payable banknotes, a reject storage box that stores reject banknotes unsuitable for pay-out, a bundle conveyance section that conveys a bundle of stacked banknotes, and a pay-out port that hands over banknotes to a user. See, for example, Japanese Patent No. 5156097, and in particular FIG. 1 thereof.

SUMMARY OF INVENTION

Technical Problem

In banknote pay-out devices configured in this manner, configuration is made such that the banknote storage boxes can be attached and detached from a face on a side of a casing. In such banknote pay-out devices, the banknote storage boxes are removed from the casing when filling up with banknotes, and the banknote storage boxes are mounted in the casing again after filling up with banknotes.

Moreover, in banknote pay-out devices, the face at which the banknote storage boxes are removed from the casing varies depending on the installation location. For example, sometimes a banknote pay-out device is installed in an indoor location where a rear face, which is on the opposite side to a front face provided with the pay-out port, faces and is in close proximity to a wall of a building. In such cases, it is desirable to remove the banknote storage boxes from the front face of the banknote pay-out device. However, sometimes a hole is opened in a wall of a building, for example, and a banknote pay-out device is installed with its casing aligned with the hole such that only a front face of the pay-out port and the vicinity thereof are exposed to a space on the customer side, and the rear face is exposed to a space on a staff member side. In such cases, it is desirable to remove the banknote storage boxes from the rear face of the banknote pay-out device in the space on the staff member side.

Namely, it has been necessary to prepare two configurations of banknote pay-out device depending on the installation location: a configuration in which the banknote storage boxes are removed from a front face (referred to hereafter as a front-facing machine), and a configuration in which the banknote storage boxes are removed from a rear face (referred to hereafter as a rear-facing machine).

Preparing two configurations in this manner requires the design of two configurations differing in banknote conveyance path, placement of respective sections, and the like. It is also necessary to prepare two types of components corresponding to the respective configurations, resulting in more complicated manufacture, component management, and the like, and accompanying which there is a large increase in costs.

In consideration of the above circumstances, the present disclosure proposes a medium handover device capable of being easily adapted to constraints in the installation location.

Solution to Problem

A first aspect of the present disclosure is a medium handover device including a storage unit that stores a paper sheet-shaped medium, and stacks any of the medium to be handed over to a user to create a medium bundle, and a bundle conveyance unit that conveys the medium bundle created by the storage unit in a conveyance direction along a bundle conveyance path. The bundle conveyance unit includes a bundle conveyance section that conveys the medium bundle in the conveyance direction along the bundle conveyance path, and a handover port that is disposed at one end in the conveyance direction, and that hands over the medium bundle to the user. The storage unit includes a medium storage box in which the medium is stored, a classification section that classifies the medium that has been fed out from the medium storage box, a stacking section that stacks as normal medium any of the medium classified as normal by the classification section so as to create the medium bundle, and that passes the medium bundle across to the bundle conveyance path of the bundle conveyance unit, a reject storage box that stores as abnormal medium any of the medium classified as abnormal by the classification section and that takes in the medium bundle from the bundle conveyance path of the bundle conveyance unit, and a switching section. The switching section is disposed between the stacking section and the reject storage box, and switches a conveyance destination of the medium that has passed through the classification section to either the stacking section or the reject storage box. Moreover, either the storage unit or the bundle conveyance unit includes a conveyance guide that is disposed at a connection location between the storage unit and the bundle conveyance unit, that forms a portion of the bundle conveyance path, and that transitions between a state communicating the bundle conveyance path with the inside of the reject storage box, and a state communicating the bundle conveyance path with the inside of the stacking section.

A second aspect of the present disclosure is the medium handover device of the first aspect, further including a safe provided inside a casing. In the second aspect the medium storage box is disposed inside the safe, and is provided so as to be capable of being pulled out or stowed away with respect to the casing. In the second aspect the bundle conveyance unit, the conveyance guide, the stacking section, the reject storage box, and the switching section are disposed outside the safe, and are provided so as to be capable of being pulled out or stowed away with respect to the casing.

A third aspect of the present disclosure is the medium handover device of the first aspect or the second aspect, wherein the stacking section includes a stacking hole through which the medium bundle is passed to the bundle conveyance path at a location facing the bundle conveyance unit, the reject storage box includes an intake hole through which the medium bundle is taken in from the bundle conveyance path at a location facing the bundle conveyance unit, and the conveyance guide is moved to either an open-for-intake position opening up the intake hole, or to an open-for-stacking position opening up the stacking hole.

A fourth aspect of the present disclosure is the medium handover device of the third aspect, wherein the conveyance guide closes off the stacking hole when at the open-for-intake position, and closes off the intake hole when at the open-for-stacking position.

A fifth aspect of the present disclosure is the medium handover device of the fourth aspect, wherein the stacking section discharges the normal medium conveyed from the switching section into a stacking space inside the stacking section, and at the open-for-intake position the conveyance guide prevents the normal medium discharged into the stacking space from entering the bundle conveyance path.

A sixth aspect of the present disclosure is the medium handover device of the fourth aspect, wherein the conveyance guide is moved along the bundle conveyance path in a movement range linking the open-for-intake position and the open-for-stacking position together, and in the movement range of the conveyance guide the bundle conveyance section forms the bundle conveyance path by a portion of an upper belt disposed upward of the conveyance guide and by the conveyance guide, and outside of the movement range of the conveyance guide the bundle conveyance section forms the bundle conveyance path by a remaining portion of the upper belt and by a lower belt disposed downward of the upper belt.

A seventh aspect of the present disclosure is the medium handover device of the third aspect, wherein the stacking hole and the intake hole are provided to the casing of the storage unit at positions symmetrical to each other with respect to the conveyance direction.

An eighth aspect of the present disclosure is the medium handover device of the third aspect, wherein the bundle conveyance unit includes a large hole at an opposing face that opposes the storage unit, the large hole having a size encompassing the stacking hole and the intake hole.

A ninth aspect of the present disclosure is the medium handover device of the third aspect, wherein the stacking section further includes a stage on which the normal medium is placed, and that is moved in a direction intersecting the conveyance direction, and when the conveyance guide is at the open-for-stacking position, the stage moves into the bundle conveyance unit to form a portion of the bundle conveyance path.

A tenth aspect of the present disclosure is the medium handover device of the ninth aspect, wherein the stacking section places the stage in an inclined orientation inclined with respect to a horizontal direction when stacking the normal medium on the stage, and the stacking section places the stage in a horizontal orientation that is substantially horizontal when moving the stage into the bundle conveyance unit.

An eleventh aspect of the present disclosure is the medium handover device of the first or second aspect, wherein the classification section is disposed adjacent to the closest medium storage box to the bundle conveyance unit.

A twelfth aspect of the present disclosure is the medium handover device of the first or second aspect, wherein the storage unit includes a conveyance section that conveys the medium fed out from the medium storage box, and in the medium storage box a feed-out section that feeds out the medium and hands the medium over to the conveyance section is disposed at a location in the medium storage box distanced from the bundle conveyance unit A thirteenth aspect of the present disclosure is the medium handover device of the first or second aspect, wherein the bundle conveyance section further includes a push-out section that pushes the medium bundle along the bundle conveyance path, and that retracts from the bundle conveyance path at least in the vicinity of the handover port.

The present disclosure enables a medium bundle to be passed between a storage unit and a bundle conveyance unit to hand over the medium bundle to a user from the handover port in both a configuration in which a reject storage box is disposed on the same side as a handover port, and a configuration in which stacking section is disposed on the same side as a handover port. The present disclosure thereby enables the facing direction of an attachment/detachment face of the storage section to be switched with respect to the handover port without changing at least the configuration of the storage unit.

Advantageous Effects of Invention

The present disclosure is capable of achieving a medium handover device capable of being easily adapted to constraints in the installation location.

DESCRIPTION OF EMBODIMENTS

Explanation follows regarding embodiments for implementing the present invention (referred to below as exemplary embodiments), with reference to the drawings.

1. First Exemplary Embodiment

1-1. Automated Cash Dispenser and Banknote Pay-Out Device Configuration

Figure 1:
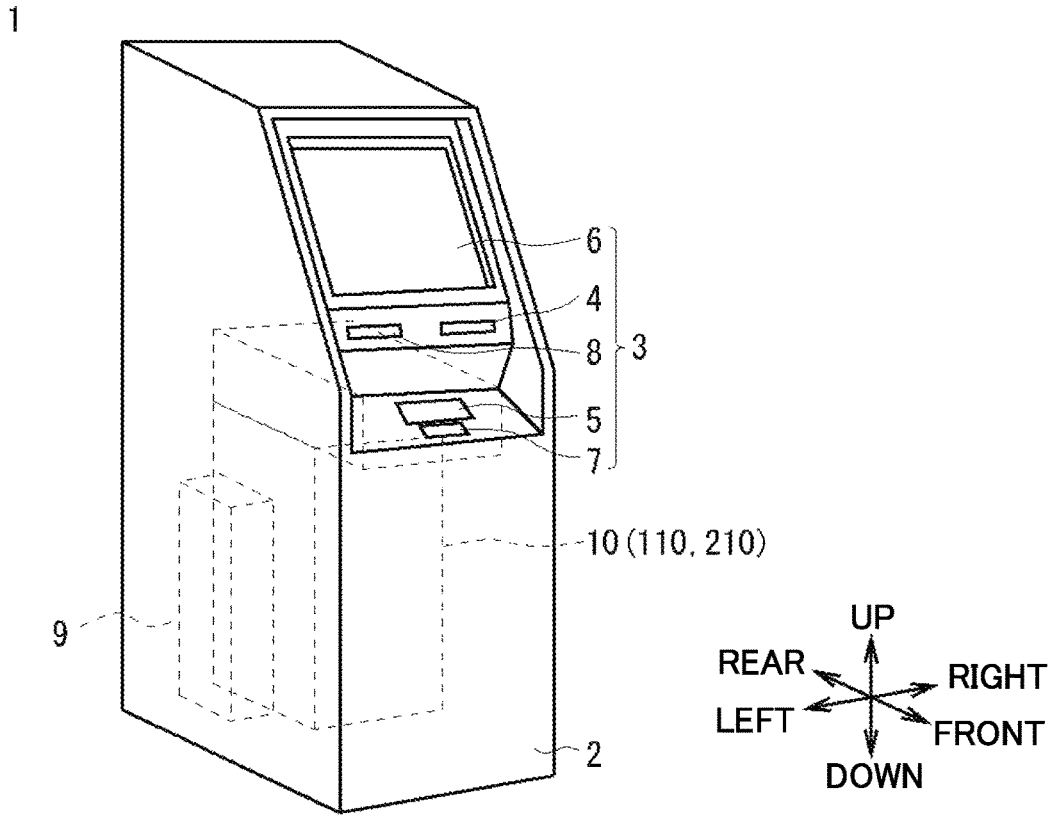
FIG. 1 is a schematic perspective view illustrating configuration of an automated cash dispenser.

As illustrated in the external view of FIG. 1, an automated cash dispenser 1 is configured around a box shaped casing 2, and is installed, for example, in a financial institution to perform cash transactions, such as pay-out processing, with a user (namely, a customer of the financial institution).

The casing 2 is provided with a customer interface 3 at a location enabling easy banknote removal, easy operation of a touch panel, and the like by a customer when facing the front side of the casing 2. The customer interface 3 directly handles cash and card interactions and the like with the customer, for example, and notifies transaction-related information and receives operation instructions. The customer interface 3 includes a card insertion/removal port 4, a casing pay-out port 5, an operation and display section 6, a ten-key 7, and a receipt issue port 8.

The card insertion/removal port 4 is a section for insertion and return of various cards, such as cash cards. A card processor (not illustrated in the drawings) that reads, for example, account numbers magnetically recorded on the various cards is provided behind the card insertion/removal port 4. The casing pay-out port 5 is opened and closed by driving a shutter, and dispenses banknotes for paying out to a customer when in an open state.

The operation and display section 6 is a touch panel integrating a liquid crystal display (LCD) that displays operation screens during transactions, and a touch sensor that is input with, for example, a transaction type selection, a PIN, or a transaction amount. The ten-key 7 is a physical keypad that is input with, for example, the numbers 0 to 9. The ten-key 7 is employed during PIN and transaction amount input operations and the like. The receipt issue port 8 is a section that issues a receipt printed with transaction details and the like at the end of transaction processing. A receipt processor (not illustrated in the drawings) that prints transaction details and the like on a receipt is provided at the back of the receipt issue port 8.

In the following explanation, the front side is defined as the side of the automated cash dispenser 1 that a customer faces, and the opposite side thereto is defined as the rear side. The left side, right side, upper side and lower side are respectively defined from the perspective of the left and right as seen by a customer facing the front side.

A main controller 9 that performs general control of the overall automated cash dispenser 1, a banknote pay-out device 10 that performs various processing relating to banknotes, and the like, are provided inside the casing 2. The main controller 9 is configured around a central processing unit (CPU), not illustrated in the drawings. The main controller 9 reads and executes specific programs from read only memory (ROM), flash memory, or the like, not illustrated in the drawings, to perform various processing such as pay-out processing. The main controller 9 is provided with an internal storage section including Random Access Memory (RAM), a hard disk drive, flash memory, or the like. The storage section is stored with various information.

Figure 2A:
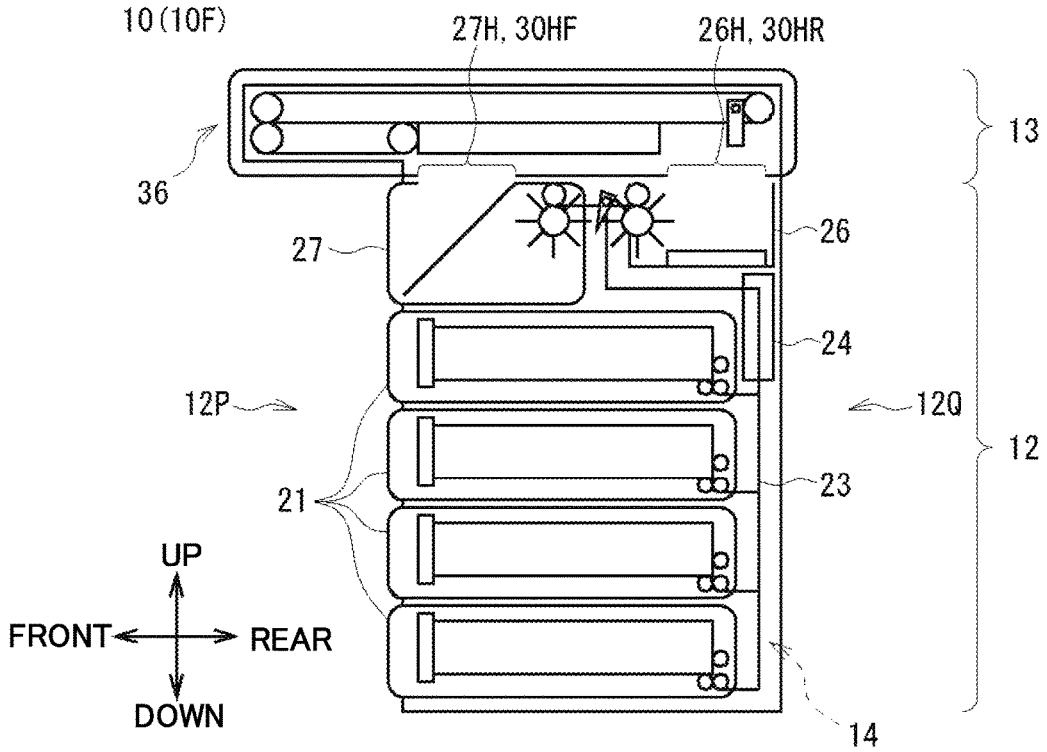
FIG. 2A is a schematic diagram illustrating a state in which a banknote pay-out device according to a first exemplary embodiment is assembled as a front-facing machine.

As seen in side view from the right in FIG. 2A, the banknote pay-out device 10 is broadly configured by a storage unit 12 on a lower side, and a bundle conveyance unit 13 on an upper side. The banknote pay-out device 10 incorporates a controller 14 that controls the overall banknote pay-out device 10.

The controller 14 is configured around a CPU, not illustrated in the drawings, similarly to the main controller 9 (FIG. 1). The controller 14 reads and executes predetermined programs from ROM, flash memory, or the like, not illustrated in the drawings, to perform processing such as pay-out processing. The controller 14 includes an internal storage section configured by RAM, a hard disk drive, flash memory, or the like. The storage section is stored with various information.

1-1-1. Storage Unit Configuration

Figure 3:
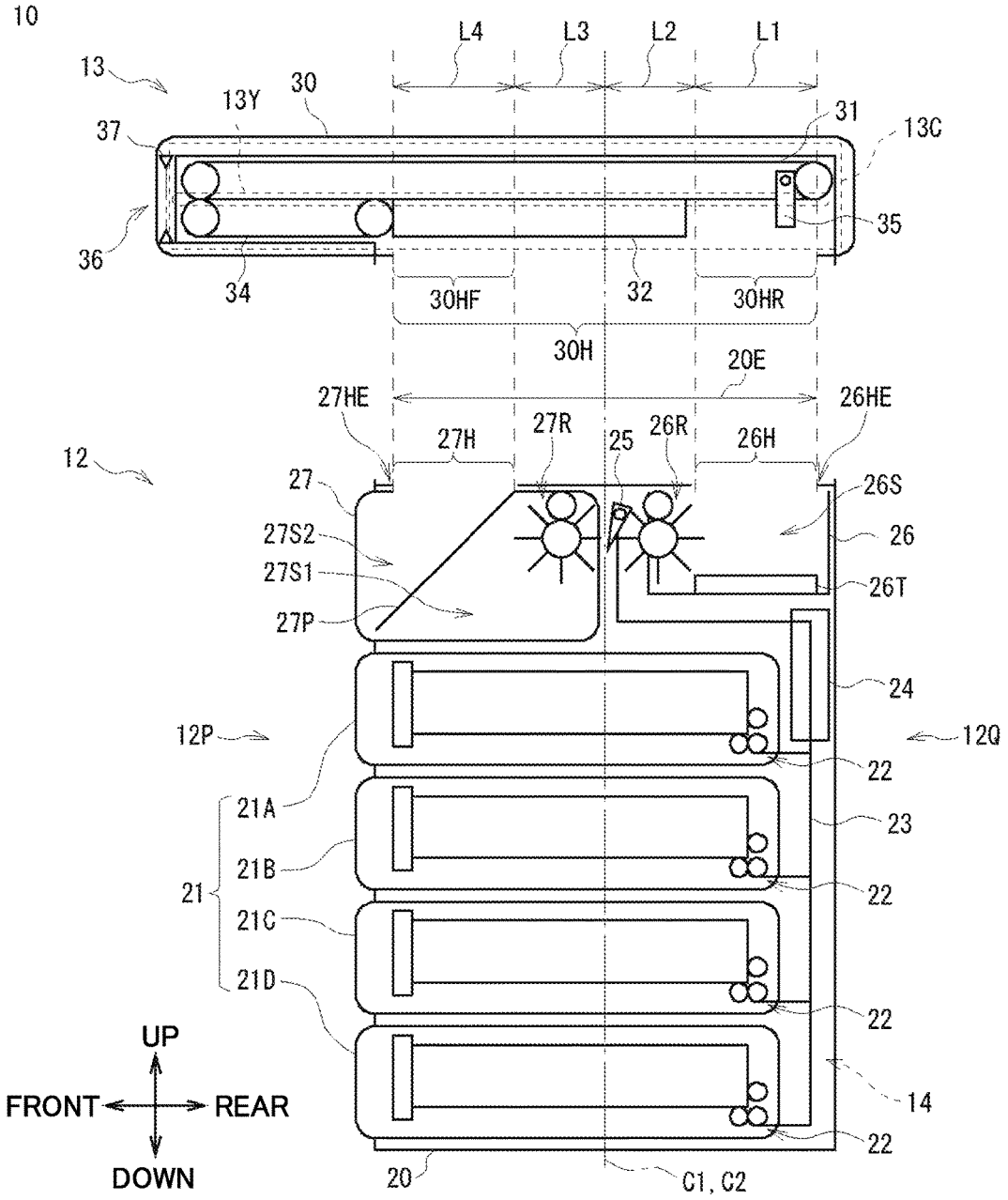
FIG. 3 is a schematic diagram illustrating configuration a banknote pay-out device according to the first exemplary embodiment.

As illustrated in FIG. 3, the storage unit 12 incorporates plural sections that perform various processing relating to banknotes inside a rectangular block shaped storage casing 20. Four banknote storage boxes 21 (21A, 21B, 21C, 21D), a conveyance section 23, a classification section 24, a switching section 25, a stacking section 26, and a reject storage box 27 are provided inside the storage casing 20.

The banknote storage boxes 21 (21A, 21B, 21C, 21D) are attached so as to be stacked one above the other from a vertical direction center toward the lower side at a front side of the storage casing 20. Each of the banknote storage boxes 21 is formed in a flattened rectangular block shape and is short in the vertical direction and long in a front-rear direction. Banknotes are stored inside the banknote storage boxes 21 in rows along the front-rear direction with their sheet faces facing along the front-rear direction, in what is referred to as a sideways stacking state. A feed-out section 22 that feeds separates and feeds out stored banknotes one note at a time is provided at a rear side lower portion of the banknote storage boxes 21, namely at a location distanced from the bundle conveyance unit 13.

Each of the banknote storage boxes 21 can be detached from the storage casing 20 by being pulled out toward the front with respect to the storage casing 20, and can be mounted in the storage casing 20 by being aligned in position with respect to the storage casing 20 and pushed in toward the rear. Namely, each of the banknote storage boxes 21 is configured so as to be attachable and detachable from a front face of the storage casing 20. Moreover, each of the banknote storage boxes 21 stores banknotes of a preset denomination.

The conveyance section 23 configures a conveyance path, this being a path along which banknotes are conveyed, from rollers, belts, and a motor or the like that drives them, not illustrated in the drawings. As shown by solid lines in the drawings, the conveyance path is connected to the feed-out section 22 of each banknote storage box 21, and progresses along the vertical direction at the rear side of the respective banknote storage boxes 21 until it reaches the vicinity of the front-rear direction center at the upper side of the banknote storage box 21A at the uppermost position. The conveyance section 23 moves banknotes fed out from the feed-out section 22 of each banknote storage box 21 substantially upward.

The classification section 24 is provided along the conveyance path of the conveyance section 23, namely in a direction approaching the bundle conveyance unit 13, at a portion of the conveyance section 23 that is at the rear side of the banknote storage box 21A. Namely, the classification section 24 is installed at a location substantially the same distance from the bundle conveyance unit 13 as from the banknote storage box 21A.

Plural sensors of various types, such as a thickness sensor and an image sensor, are built into the classification section 24. The classification section 24 classifies the denomination, travel state, and the like of the conveyed banknotes based on information obtained from the respective sensors, and supplies the classification results to the controller 14. The controller 14 determines the conveyance destination of each banknote based on the acquired classification results. Specifically, the controller 14 determines the stacking section 26 to be the conveyance destination for normal banknotes that are suitable for pay-out, and determines the reject storage box 27 to be the conveyance destination for abnormal banknotes not suitable to be paid out (referred to below as reject banknotes).

The switching section 25 is disposed substantially at the front-rear direction center at the upper side of the banknote storage box 21A. Under the control of the controller 14, the switching section 25 switches the banknote direction of travel by changing an angle of inclination of a blade (illustrated in a triangular shape in the drawings) that abuts banknotes so as to change their direction of travel. The switching section 25 is connected through the conveyance section 23 to the classification section 24 at the lower side, the stacking section 26 at the rear side, and the reject storage box 27 at the front side, respectively. The switching section 25 switches the direction of travel of respective banknotes conveyed from below according to the conveyance destination determined by the controller 14. Specifically, the switching section 25 switches the banknote conveyance path to so as to move normal banknotes to the stacking section 26 at the rear side and move abnormal banknotes (namely reject banknotes) to the reject storage box 27 at the front side.

The stacking section 26 is positioned at the rear side of an uppermost side inside the storage casing 20. A stacking space 26S, this being a space in which banknotes are stacked, is formed inside the stacking section 26. The stacking section 26 includes a stage 26T, on an upper face of which banknotes are stacked, inside the stacking space 26S. The stage 26T is formed in a thin plate shape that is thin in the vertical direction. The front-rear direction length and the left-right direction length of the stage 26T are longer than the respective lengths of the short edges and long edges of the banknotes.

A discharge section 26R for discharging banknotes conveyed from the switching section 25 into the stacking space 26S is provided toward the top of the front side of the stacking section 26. Banknotes conveyed from the switching section 25 and discharged into the stacking space 26S by the discharge section 26R are stacked upon the stage 26T of the stacking section 26. Banknotes stacked upon the stage 26T when this is performed are superimposed on each other in the form of a loose bundle. Banknotes superimposed in this manner are accordingly also referred to below as banknote bundles.

Moreover, the stage 26T can be moved in the vertical direction by a stage moving mechanism, not illustrated in the drawings. An upper face of the stacking section 26, namely a face facing the bundle conveyance unit 13, is provided with a stacking hole 26H penetrating in the vertical direction. The front-rear direction length L1 of the stacking hole 26H is slightly longer than the front-rear direction length of the stage 26T. The stacking hole 26H also penetrates an upper face of the storage casing 20, and places the stacking space 26S in communication with a space further toward the upper side than the storage casing 20. The stacking section 26 is thereby capable of lifting the stage 26T and banknotes stacked in the form of a bundle (banknote bundle) further toward the upper side than the upper face of the storage casing 20 by moving the stage 26T upward in a state in which banknotes have been stacked on the stage 26T.

The reject storage box 27 is positioned toward the front side of the uppermost side inside the storage casing 20, and an internal space of the reject storage box 27 is partitioned by a partitioning plate 27P into a first storage space 27S1 at a rear lower side and a second storage space 27S2 at a front upper side. Plate faces of the partitioning plate 27P are inclined with respect to the horizontal direction and the vertical direction. Moreover, a discharge section 27R for discharging banknotes conveyed from the switching section 25 into the first storage space 27S1 is provided toward the top of the rear side of the reject storage box 27, namely at a location in communication with the first storage space 27S1. The reject storage box 27 is thereby capable of storing banknotes (namely, reject banknotes) that have been conveyed from the switching section 25 and discharged into the first storage space 27S1 by the discharge section 27R.

Moreover, an upper face of the reject storage box 27, namely a face facing the bundle conveyance unit 13, is provided with an intake hole 27H penetrating in the vertical direction. A front-rear direction length L4 of the intake hole 27H is substantially equal to a front-rear direction length L1 of the stacking hole 26H of the stacking section 26. The intake hole 27H also penetrates an upper face of the storage casing 20, and places the second storage space 27S2 in communication with a space further toward the upper side than the storage casing 20. Accordingly, in the reject storage box 27, when banknotes that fall from above, these banknotes can be stored in the second storage space 27S2.

The reject storage box 27, similarly to the banknote storage boxes 21, can be detached from the storage casing 20 by being pulled out toward the front with respect to the storage casing 20. The reject storage box 27 can be mounted to the storage casing 20 by being aligned in position with respect to the storage casing 20 and being pushed in toward the rear.

Here, consider an imaginary casing center line C1 positioned along the front-rear direction center of the storage casing 20 of the storage unit 12. A distance L2 from the casing center line C1 to the stacking hole 26H is substantially equal to a distance L3 from the casing center line C1 to the intake hole 27H. Namely, in the storage unit 12, the front-rear direction lengths L1 and L4, respectively representing the size of the stacking hole 26H and the intake hole 27H, are substantially equal to each other, and their lengths L2 and L3, representing the distance from the casing center line C1, are also substantially equal to each other, and so the stacking hole 26H and the intake hole 27H are formed with substantial front-rear symmetry.

Moreover, a rear end portion of the stacking hole 26H configures a stacking hole end 26HE, and a front end portion of the intake hole 27H configures an intake hole end 27HE, and a range between the stacking hole end 26HE and the intake hole end 27HE is defined as a hole range 20E. In addition, an imaginary line representing the center of the hole range 20E in the front-rear direction is referred to as hole center line C2. The hole center line C2 matches the casing center line C1, and is positioned at the center of the hole range 20E, namely at the center of a range connecting together respective portions corresponding to the lengths L1 to L4.

For ease of explanation below, the face of the storage unit 12 at which the banknote storage boxes 21 and the reject storage box 27 can be attached and detached is referred to as the attachment/detachment face 12P, and the face where the conveyance section 23 is built in is referred to as the conveyance face 12Q. Note that FIG. 3 illustrates a state in which the attachment/detachment face 12P of the storage unit 12 faces toward the front side, and the conveyance face 12Q faces toward the rear side.

1-1-2. Bundle Conveyance Unit Configuration

Overall, the bundle conveyance unit 13 is short in the vertical direction and long in the front-rear direction, is formed in a flattened rectangular block shape, and has a front-rear direction length longer than that of the storage unit 12. A rectangular block shaped bundle conveyance casing 30 of the bundle conveyance unit 13 is configured with an internal bundle conveyance section 13C for conveying banknote bundles.

The bundle conveyance section 13C is configured by a combination of plural mechanisms including upper belts 31, a gripping conveyance guide 32, lower belts 34, and a push-out section 35. Banknote bundles W are conveyed along a bundle conveyance path 13Y connecting between the vicinity of a front end and the vicinity of a rear end inside the bundle conveyance casing 30.

The upper belts 31 are provided at an upper-side portion inside the bundle conveyance casing 30, namely at an upper side of the bundle conveyance path 13Y. The upper belts 31 are entrained around the peripheries of respective rollers disposed in the vicinity of a rear end and in the vicinity of a front end inside the bundle conveyance casing 30, and when the rollers are rotated, lower faces of the upper conveyor belts 31 travel along the front-rear direction. For ease of explanation, in the following explanation, the direction of travel of the lower face portions of the upper belts 31 is taken as the direction of travel of the upper belts 31.

A large hole 30H is a large hole formed in a lower face of the bundle conveyance casing 30 over a wide range spanning from the vicinity of a front-rear direction center to the rear side of the bundle conveyance casing 30. The length of the large hole 30H in the front-rear direction corresponds to the sum of the lengths L1, L2, L3, and L4 in the storage unit 12.

The gripping conveyance guide 32 is provided inside the bundle conveyance casing 30 at a portion further to the lower side than the upper belts 31, within the range of the large hole 30H. The gripping conveyance guide 32 is formed in a flattened rectangular block shape or plate shape that is thin in the vertical direction, and an upper face of the gripping conveyance guide 32 faces or abuts the lower faces of the upper belts 31. The front-rear direction length of the gripping conveyance guide 32 corresponds to the sum of the lengths L2, L3, and L4, or to the sum of the lengths L1, L2, and L3, in the storage unit 12. In other words, the front-rear direction length of the gripping conveyance guide 32 is shorter than the front-rear direction length of the large hole 30H by the length L1 or by the length L4.

The gripping conveyance guide 32 is capable of moving in the front-rear direction within the range of the large hole 30H using a non-illustrated moving mechanism. For example, when the gripping conveyance guide 32 has moved to the front side, for example, a state is adopted closed at the vicinity of the center and the front side of the large hole 30H and open at a rear side range of the large hole 30H corresponding to the length L1. The opened portion at the rear side when this occurs is referred to hereafter as the rear passage hole 30HR. Moreover, when the gripping conveyance guide 32 has moved to the rear side, a state is adopted closed at the vicinity of the center and the rear side of the large hole 30H and open at a front side range of the large hole 30H corresponding to the length L4. The opened portion at the front side when this occurs is referred to hereafter as the front passage hole 30HF. Namely, the front-rear direction length of the gripping conveyance guide 32 is shorter than the front-rear direction length of the large hole 30H by a length of the front passage hole 30HF or the length of the rear passage hole 30HR.

The lower belts 34 are provided further to the front side than the large hole 30H in a portion further to the lower side than the upper belts 31 inside the bundle conveyance casing 30. The lower belts 34 are configured shorter than the upper belts 31 in the front-rear direction, and upper faces of the lower belts 34 face or abut the lower faces of the upper belts 31, and travel in the front-rear direction. For ease of explanation, in the following explanation, the direction of travel of upper face portions of the lower belts 34 is taken as the direction of travel of the lower belts 34.

Moreover, in a state in which the gripping conveyance guide 32 has been moved toward the front (FIG. 3), the unclosed, open rear passage hole 30HR of the large hole 30H is closed by the stage 26T when the stage 26T of the stacking section 26 is moved upward. When this occurs, in the bundle conveyance unit 13, a bundle conveyance path 13Y is formed interposed in the vertical direction between the upper belts 31, and the stage 26T, the gripping conveyance guide 32 and the lower belts 34.

A portion of the push-out section 35 projects out further downward than the lower faces of the upper belts 31. The push-out section 35 is moved along the front-rear direction, namely, along the bundle conveyance path 13Y, by a moving mechanism, not illustrated in the drawings. The push-out section 35 can also be displaced in the vertical direction by a displacement mechanism, not illustrated in the drawings. Namely, as illustrated in FIG. 3, a portion of the push-out section 35 can be lowered to below the lower faces of the upper belts 31, and as described later, can be displaced to above the lower faces of the upper belts 31.

The push-out section 35 only projects out further downward than the lower faces of the upper belts 31 at a number of discrete locations in the left-right direction. Gaps, grooves, or the like corresponding to the push-out section 35 are formed along the front-rear direction in the gripping conveyance guide 32 and the lower belts 34, and in the stage 26T of the stacking section 26 of the storage unit 12, to avoid interference with the push-out section 35. Thus, when there is a banknote bundle in the bundle conveyance path 13Y, the push-out section 35 is capable of pushing and moving the banknote bundle along the front-rear direction. Moreover, the push-out section 35 incorporates a retraction mechanism (not illustrated in the drawings) in the vicinity of a front end of the bundle conveyance path 13Y. The push-out section 35 is thus swung by the retraction mechanism and retracts above the bundle conveyance path 13Y upon reaching the vicinity of the front end when moved by the moving mechanism, thereby adopting a state in which it does not interfere with the banknote bundle W.

A pay-out port 36 that hands over to a user a banknote bundle conveyed toward the front within the bundle conveyance path 13Y, is formed in a front end of the bundle conveyance casing 30. A sensor 37 that detects banknote bundles W is provided in the vicinity of the pay-out port 36. The sensor 37 is configured by combining a light emitting element that emits a predetermined detection light and a light receiving element that receives this detection light. The optical path of the detection light intersects the bundle conveyance path 13Y. The sensor 37 notifies the controller 14 of the detection light reception results. The controller 14 is capable of determining whether or not there is a banknote bundle W in the pay-out port 36 based on the light reception results. Note that when the pay-out port 36 has been installed inside a casing 2 of the automated cash dispenser 1 (FIG. 1), the pay-out port 36 is positioned at the rear side (namely the inside) of the casing pay-out port 5.

1-1-3. Banknote Pay-Out Device Assembly

The banknote pay-out device 10 is assembled by attaching the storage unit 12 at a lower side and the bundle conveyance unit 13 at an upper side during manufacture. The direction of the bundle conveyance unit 13 in the banknote pay-out device 10 is determined such that the pay-out port 36 will face toward a user. Since the stacking hole 26H and the intake hole 27H are formed with substantially front-rear symmetry within the hole range 20E, the attachment direction of the storage unit 12 with respect to the bundle conveyance unit 13 can be switched two ways.

Namely, as illustrated in FIG. 3, in the banknote pay-out device 10 the storage unit 12 is, for example, attachable to the bundle conveyance unit 13 in a state in which the attachment/detachment face 12P faces toward the front side and the conveyance face 12Q faces toward the rear side, and the intake hole 27H is aligned with the front passage hole 30HF and the stacking hole 26H is aligned with the rear passage hole 30HR. Accordingly, as illustrated in FIG. 2A, the banknote pay-out device 10 is assembled in a state in which the banknote storage boxes 21 and the reject storage box 27 can be attached and detached from the front side. In the following explanation, the banknote pay-out device 10 in which the attachment/detachment face 12P is disposed on the front side in this manner is also referred to as a front-facing machine 10F.

Figure 4A:
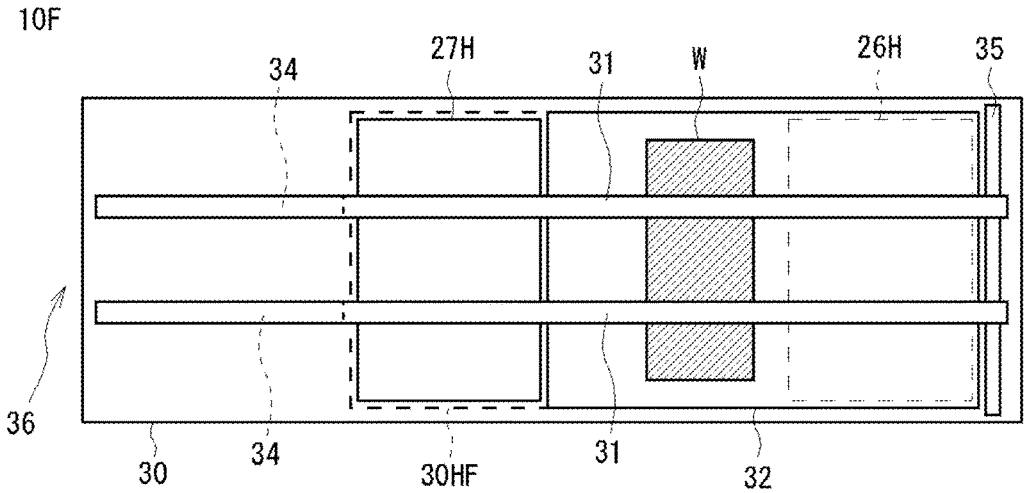
FIG. 4A is a schematic plan view illustrating configuration of a front-facing machine according to the first exemplary embodiment.
Figure 4B:
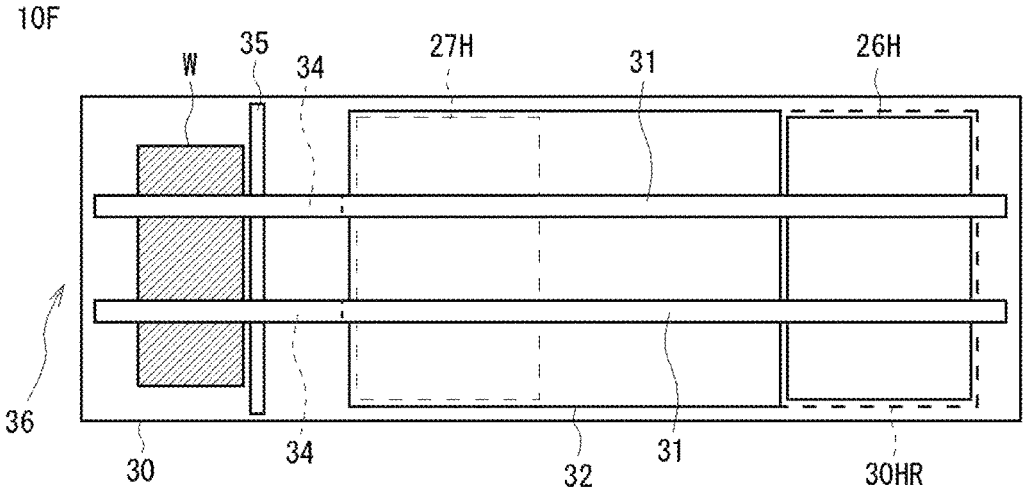
FIG. 4B is a schematic plan view illustrating configuration of a front-facing machine according to the first exemplary embodiment.

In the front-facing machine 10F, as illustrated in schematic plan view in FIG. 4B, when the gripping conveyance guide 32 has moved to the front within the range of the large hole 30H, the gripping conveyance guide 32 closes off the intake hole 27H, and the rear passage hole 30HR is formed at the rear side of the gripping conveyance guide 32 to open up the stacking hole 26H. This position of the gripping conveyance guide 32 is referred to hereafter as the open-for-stacking position.

Moreover, in the front-facing machine 10F, as illustrated in FIG. 4A corresponding to FIG. 4B, when the gripping conveyance guide 32 has moved to the rear within the range of the large hole 30H, the stacking hole 26H is closed off, and the front passage hole 30HF is formed at the front side of the gripping conveyance guide 32 to open up the intake hole 27H. This position of the gripping conveyance guide 32 is referred to hereafter as the open-for-intake position.

Figure 2B:
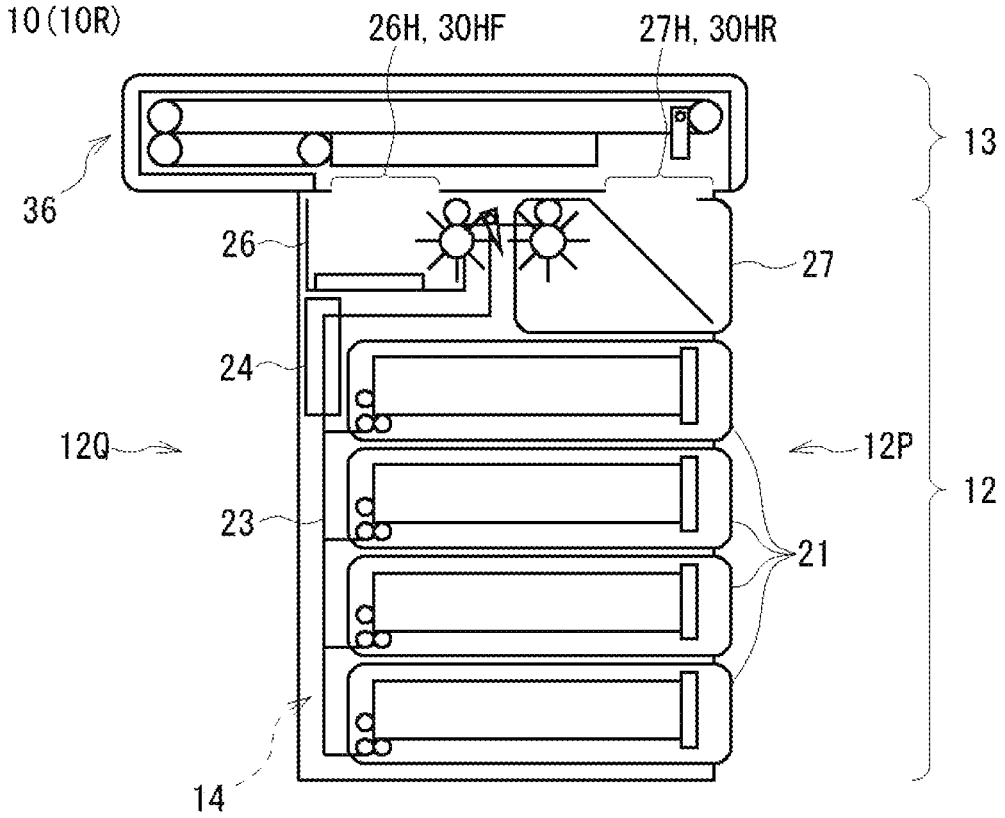
FIG. 2B is a schematic diagram illustrating a state in which a banknote pay-out device according to the first exemplary embodiment is assembled as a rear-facing machine.

Moreover, in the banknote pay-out device 10 the storage unit 12 is attachable to the bundle conveyance unit 13 front-rear reversed from that of in FIG. 3, in a state in which the conveyance face 12Q faces toward the front side and the attachment/detachment face 12P faces toward the rear side, and the intake hole 27H is aligned with the rear passage hole 30HR and the stacking hole 26H is aligned with the front passage hole 30HF. Accordingly, as illustrated in FIG. 2B, the banknote pay-out device 10 can be assembled in a state in which the banknote storage boxes 21 and the reject storage box 27 can be attached and detached from the rear side. In the following explanation, the banknote pay-out device 10 in which the attachment/detachment face 12P is disposed on the rear side in this manner is also referred to as a rear-facing machine 10R.

Note that in the rear-facing machine 10R, the position illustrated in FIG. 2B in which the gripping conveyance guide 32 has been moved toward the front, closing off the stacking hole 26H to form the front passage hole 30HF at the front side of the gripping conveyance guide 32 and opening up the intake hole 27H, is referred to as the open-for-intake position. Conversely, in the rear-facing machine 10R, a position in which the gripping conveyance guide 32 has been moved toward the rear, closing off the intake hole 27H to form the rear passage hole 30HR at the rear side of the gripping conveyance guide 32 and opening up the stacking hole 26H, is referred to as the open-for-stacking position.

In this manner, the banknote pay-out device 10 can be assembled in two ways: as the front-facing machine 10F or as the rear-facing machine 10R, by reversing the attachment direction of the storage unit 12 with respect to the bundle conveyance unit 13 and switching the combination between the stacking hole 26H and intake hole 27H and the front passage hole 30HF and rear passage hole 30HR. Accordingly, the gripping conveyance guide 32 is disposed at a location connecting between the storage unit 12 and the bundle conveyance unit 13 whether the assembly is that of the front-facing machine 10F or the rear-facing machine 10R.

Note that when the automated cash dispenser 1 (FIG. 1) incorporates the front-facing machine 10F, a front face portion of the casing 2 is configured by an openable and closable door. In an open state of this door, the banknote storage boxes 21 and the reject storage box 27 are attached and detached from the front side. Moreover, when the automated cash dispenser 1 incorporates the rear-facing machine 10R, a rear face portion of the casing 2 is configured by the openable and closable door. In an open state of this door, the banknote storage boxes 21 and the reject storage box 27 are attached and detached from the rear side.

Moreover, in the storage unit 12, in both the front-facing machine 10F and the rear-facing machine 10R, the stacking section 26, the switching section 25, and the reject storage box 27 are disposed at the upper side of the banknote storage boxes 21 in a row so as to substantially follow the front-rear direction, this being the direction of the bundle conveyance path 13Y when the bundle conveyance unit 13 is attached.

1-2. Banknote Pay-Out Device Operation

Next, explanation follows regarding operation relating to pay-out in the banknote pay-out device 10, for both the front-facing machine 10F and the rear-facing machine 10R. During assembly and the like of the banknote pay-out device 10, control programs appropriate to the configuration are stored in a storage section the controller 14 or the like corresponding to whether the banknote pay-out device 10 configures the front-facing machine 10F or the rear-facing machine 10R.

In the banknote pay-out device 10, on receipt of a pay-out instruction and a pay-out amount from a user using the operation and display section 6 (FIG. 1), the controller 14 reads and executes the control program or the like whilst coordinating with the main controller 9, and commences processing corresponding to the configuration of the banknote pay-out device 10.

1-2-1. Front-Facing Machine Operation

Figure 5A:
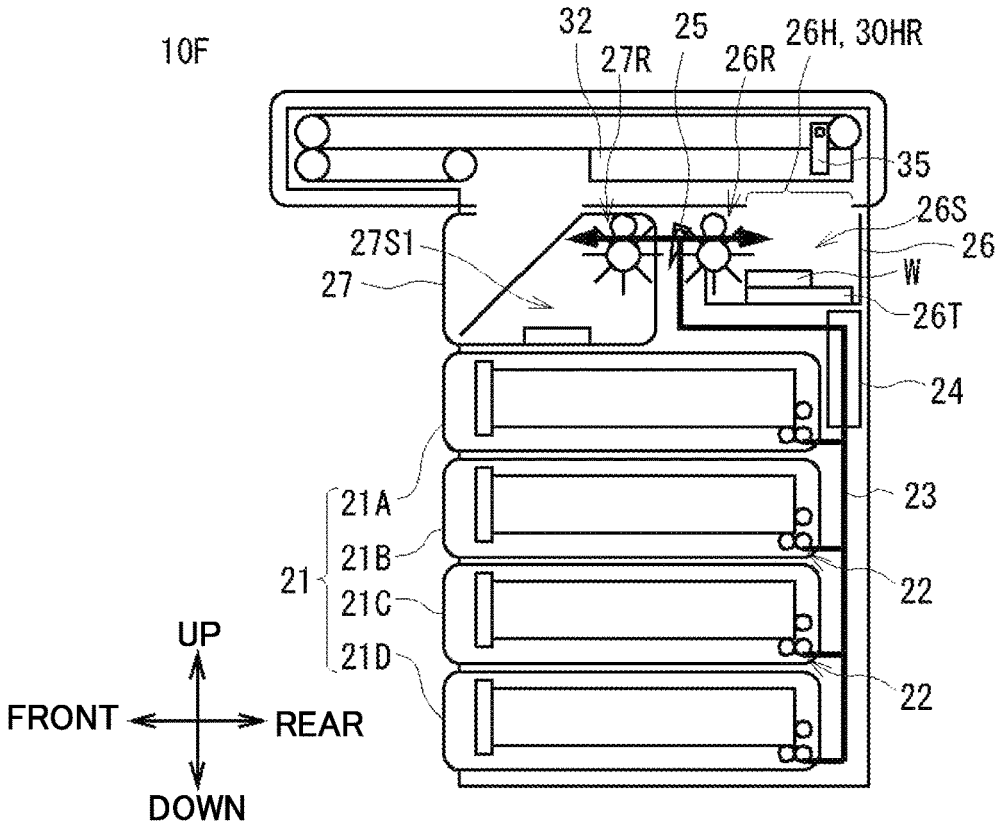
FIG. 5A is a schematic diagram illustrating a pay-out operation of a front-facing machine according to the first exemplary embodiment.

First, explanation follows regarding the front-facing machine 10F. As illustrated in FIG. 5A, the controller 14 of the front-facing machine 10F first moves the stage 26T downward, and moves the gripping conveyance guide 32 toward the open-for-intake position at the rear so as to close off the stacking hole 26H of the stacking section 26 and the rear passage hole 30HR. The controller 14 moves the push-out section 35 to a rearmost side.

In this state, the controller 14 uses the feed-out section 22 to sequentially feed out banknotes from the banknote storage boxes 21 in denominations and numbers corresponding to the pay-out amount. The banknotes are conveyed upward by the conveyance section 23 and classified by the classification section 24. When this is performed, the controller 14 determines the conveyance destination to be either the stacking section 26 or the reject storage box 27 according to whether or not a classified banknote is payable, based on classification results obtained from the classification section 24.

Next, the controller 14 conveys the banknotes classified by the classification section 24 forward and upward using the conveyance section 23 such that the banknotes reach the switching section 25. The switching section 25 switches the progress direction according to the conveyance destination determined for each banknote under the control of the controller 14, and moves the banknotes to the stacking section 26 or the reject storage box 27.

The stacking section 26 uses the discharge section 26R to discharge the conveyed banknotes into the stacking space 26S so as to be stacked on the stage 26T. When this is performed, the stacking hole 26H of the stacking section 26 is closed off from above by the gripping conveyance guide 32, thereby preventing banknotes discharged from the discharge section 26R from floating up, enabling stable stacking on the stage 26T. Moreover, the reject storage box 27 uses the discharge section 27R to discharge conveyed banknotes into the first storage space 27S1 and stores the conveyed banknotes therein.

The controller 14 keeps a running total of the denominations and number of banknotes with a conveyance destination of the stacking section 26, namely the banknotes stacked in the stacking section 26, and stops feeding banknotes out from the banknote storage boxes 21 at a stage when the tallied amount has reached the pay-out amount. As a result, a banknote bundle W, in which banknotes corresponding to the pay-out amount are stacked in the form of a loose bundle, is thereby placed onto the stage 26T of the stacking section 26.

Figure 5B:
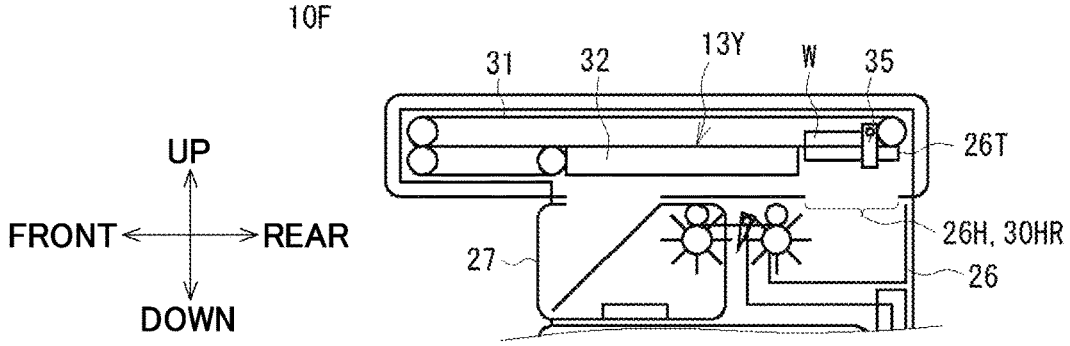
FIG. 5B is a schematic diagram illustrating a pay-out operation of a front-facing machine according to the first exemplary embodiment.

Next, as illustrated in FIG. 5B, the controller 14 opens the stacking hole 26H of the stacking section 26 and the rear passage hole 30HR by moving the gripping conveyance guide 32 toward the front to the open-for-stacking position, and, after closing off the intake hole 27H and the front passage hole 30HF, lifts the banknote bundle W by moving the stage 26T of the stacking section 26 upward. The stacking section 26 is thereby capable of transferring the banknote bundle W from inside the storage unit 12 to inside the bundle conveyance unit 13 through the stacking hole 26H and the rear passage hole 30HR. When this is performed, the controller 14 aligns the upper face of the stage 26T to the same height as the upper face of the gripping conveyance guide 32, such that the stage 26T configures part of the bundle conveyance path 13Y, and the banknote bundle W on the stage 26T is positioned in the bundle conveyance path 13Y.

The controller 14 then uses the bundle conveyance section 13C to convey the banknote bundle W toward the front. Specifically, the controller 14 drives the upper belts 31 toward the front and moves the push-out section 35 toward the front, thereby moving the banknote bundle W toward the front along the bundle conveyance path 13Y. When this is performed, when the banknote bundle W reaches a position abutting the upper faces of the lower belts 34, the controller 14 grips the banknote bundle W from above and below between the upper belts 31 and the lower belts 34, and drives the two types of belt to convey the banknote bundle W toward the front.

Figure 5C:
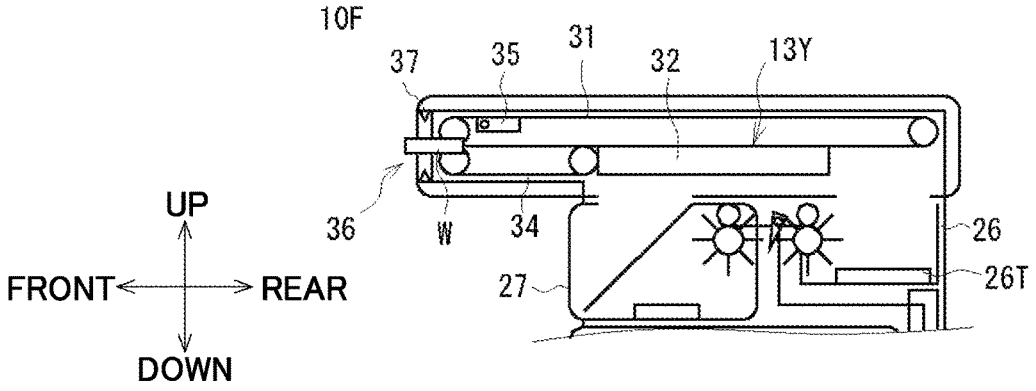
FIG. 5C is a schematic diagram illustrating a pay-out operation of a front-facing machine according to the first exemplary embodiment.

Eventually, when the banknote bundle W is detected as having reached the pay-out port 36 based on notification from the sensor 37, the controller 14 stops driving the upper belts 31 and the lower belts 34, as illustrated in FIG. 5C. Note that, the controller 14 moves the stage 26T downward when this is performed, ending the pay-out operation. The controller 14 moreover causes the push-out section 35 to reach the vicinity of the front end of the bundle conveyance path 13Y, such that the push-out section 35 is retracted to above the bundle conveyance path 13Y by the retraction mechanism (not illustrated in the drawings).

The front-facing machine 10F can thereby allow the user to take out the banknote bundle W, in a state in which part of the banknote bundle W is exposed from the pay-out port 36 and the vicinity of a rear edge of the banknote bundle W is gripped between the upper belts 31 and the lower belts 34.

The controller 14 monitors whether or not the banknote bundle W has been taken out from the pay-out port 36 based on notification from the sensor 37. In cases in which the banknote bundle W has not been taken out even after a predetermined standby time has elapsed (for example, 30 seconds), namely when the banknote bundle W has been left behind, the controller 14 begins a take-in operation to take in the banknote bundle W. Banknotes left behind by a user in this manner are referred to hereafter as left behind banknotes.

Figure 6A:
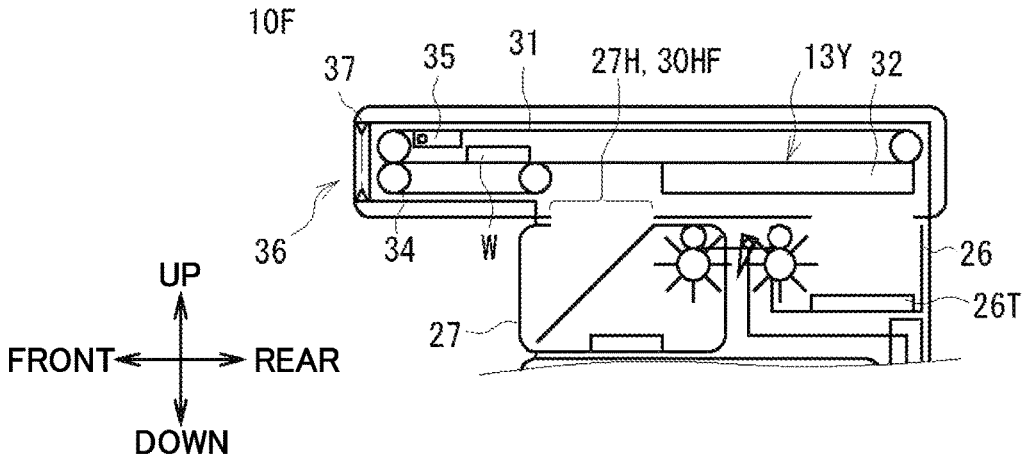
FIG. 6A is a schematic diagram illustrating a take-in operation of a front-facing machine according to the first exemplary embodiment.

Specifically, as illustrated in FIG. 6A, first, the controller 14 moves the gripping conveyance guide 32 toward the rear to the open-for-intake position so as to open up the front passage hole 30HF and the intake hole 27H, and close off the stacking hole 26H and the rear passage hole 30HR. Next, the controller 14 conveys the banknote bundle W toward the rear using the bundle conveyance section 13C. Namely, the controller 14 drives the upper belts 31 and the lower belts 34 toward the rear with the push-out section 35 still in the upward retracted state, thereby taking the banknote bundle W into the bundle conveyance path 13Y and moving the banknote bundle W along the bundle conveyance path 13Y toward the rear. When this is performed, when the controller 14 detects that the banknote bundle W has reached a location further to the rear than the push-out section 35 using a non-illustrated sensor, the controller 14 returns the push-out section 35, which was retracted above the bundle conveyance path 13Y, into the bundle conveyance path 13Y at the front of the banknote bundle W, and then moves the push-out section 35 toward the rear so as to assist conveyance of the banknote bundle W toward the rear.

Figure 6B:
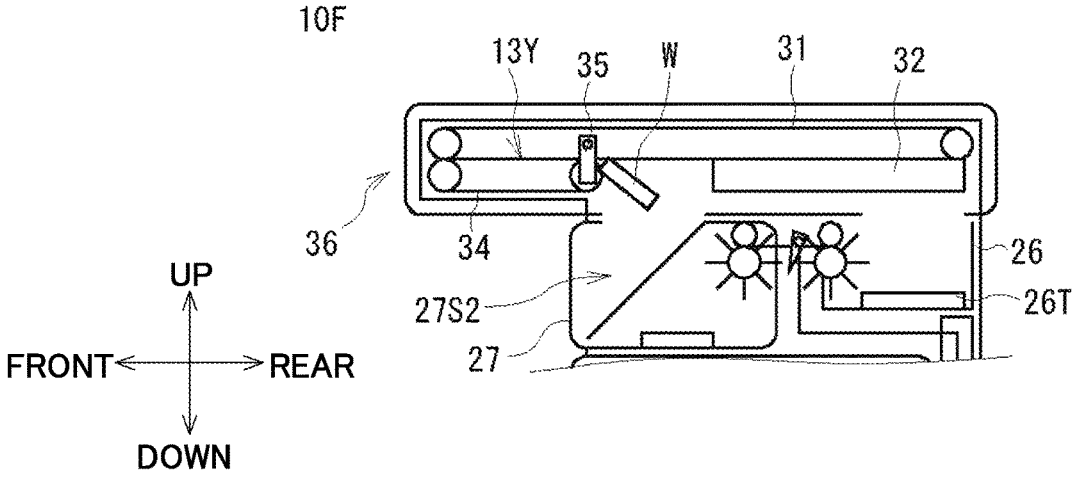
FIG. 6B is a schematic diagram illustrating a take-in operation of a front-facing machine according to the first exemplary embodiment.

Eventually, as illustrated in FIG. 6B, when the banknote bundle W reaches the front passage hole 30HF and the intake hole 27H, the controller 14 causes the banknote bundle W to fall from the bundle conveyance path 13Y through the front passage hole 30HF and the intake hole 27H to be stored inside the second storage space 27S2 of the reject storage box 27, and then ends the take-in operation. The front-facing machine 10F is thus capable of taking in a banknote bundle W that a user has forgotten to take from the pay-out port 36 and storing the banknote bundle W in the reject storage box 27.

1-2-2. Rear-Facing Machine Operation

Figure 7A:
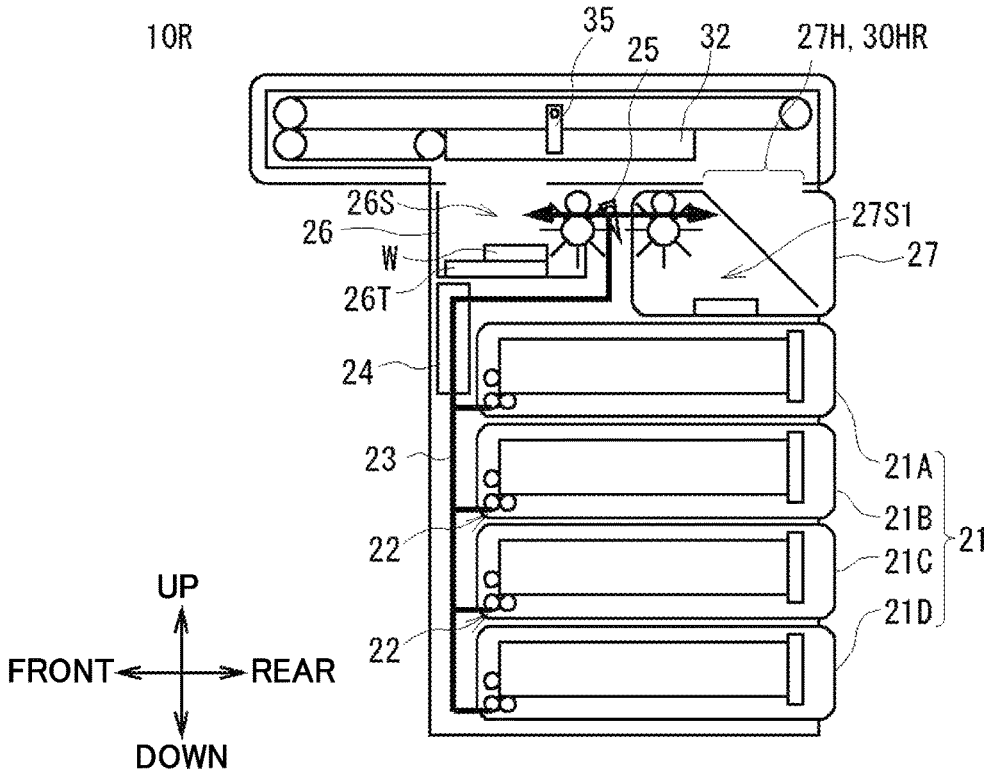
FIG. 7A is a schematic diagram illustrating a pay-out operation of a rear-facing machine according to the first exemplary embodiment.

Next, explanation follows regarding the rear-facing machine 10R. As illustrated in FIG. 7A corresponding to FIG. 5A, the controller 14 of the rear-facing machine 10R first moves the stage 26T downward, and moves the gripping conveyance guide 32 toward the open-for-intake position at the front, thereby closing off the stacking hole 26H of the stacking section 26 and the front passage hole 30HF and opening up the intake hole 27H and the rear passage hole 30HR. The controller 14 then moves the push-out section 35 to a position slightly further toward the rear side than the stage 26T. In this state, similarly to in the front-facing machine 10F, the controller 14 conveys banknotes corresponding to the pay-out amount to the stacking section 26 to be stacked as a banknote bundle W on the stage 26T.

Figure 7B:
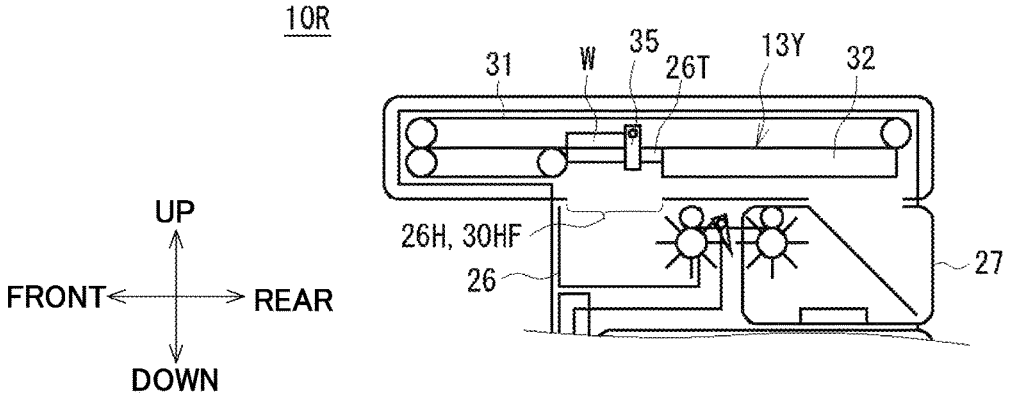
FIG. 7B is a schematic diagram illustrating a pay-out operation of a rear-facing machine according to the first exemplary embodiment.

Next, as illustrated in FIG. 7B, the controller 14 opens the stacking hole 26H of the stacking section 26 and the front passage hole 30HF by moving the gripping conveyance guide 32 toward the rear to the open-for-stacking position, and after closing off the intake hole 27H and the rear passage hole 30HR, lifts the banknote bundle W by moving the stage 26T of the stacking section 26 upward. The stacking section 26 is thereby capable of transferring the banknote bundle W from inside the storage unit 12 to inside the bundle conveyance unit 13 through the stacking hole 26H and the front passage hole 30HF. When this is performed, the controller 14 aligns the upper face of the stage 26T to the same height as the upper face of the lower belts 34, such that the stage 26T configures part of the bundle conveyance path 13Y, and the banknote bundle W on the stage 26T is positioned in the bundle conveyance path 13Y.

Figure 7C:
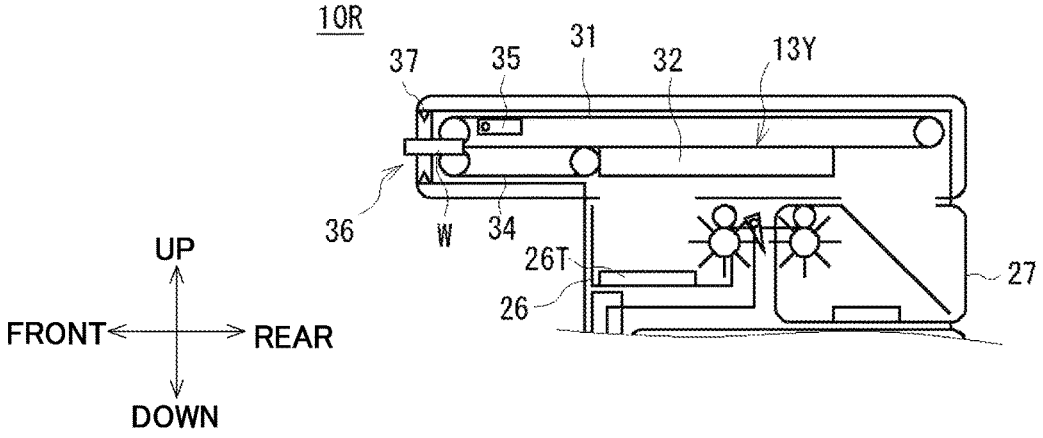
FIG. 7C is a schematic diagram illustrating a pay-out operation of a rear-facing machine according to the first exemplary embodiment.

Similarly to in the front-facing machine 10F, the controller 14 then uses the bundle conveyance section 13C to convey the banknote bundle W toward the front. Specifically, the controller 14 drives the upper belts 31 and the lower belts 34 toward the front and moves the push-out section 35 toward the front, thereby moving the banknote bundle W toward the front along the bundle conveyance path 13Y such that the banknote bundle W reaches the pay-out port 36 as illustrated in FIG. 7C. At this point, the controller 14 moves the stage 26T downward and ends the pay-out operation.

Accordingly, similarly to in the front-facing machine 10F, the rear-facing machine 10R can thereby allow the user to take out the banknote bundle W, in a state in which part of the banknote bundle W is exposed from the pay-out port 36 and the vicinity of a rear edge of the banknote bundle W is gripped between the upper belts 31 and the lower belts 34.

Figure 8A:
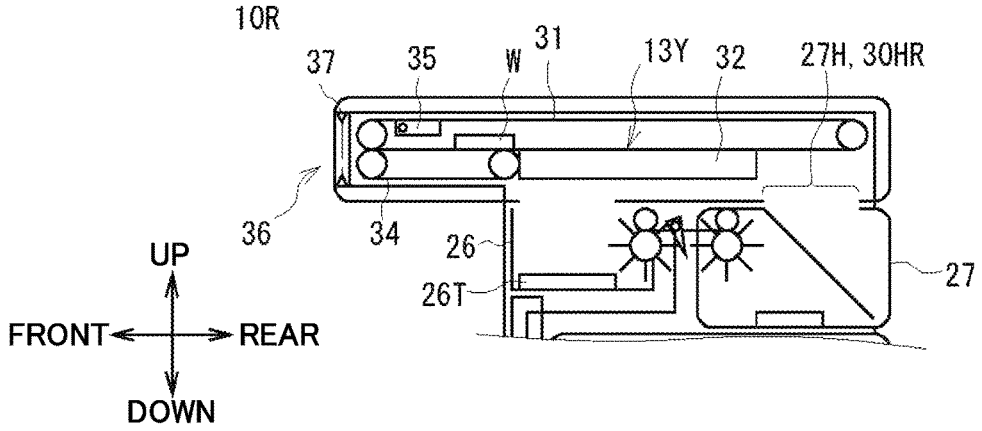
FIG. 8A is a schematic diagram illustrating a take-in operation of a rear-facing machine according to the first exemplary embodiment.

Similarly to in the front-facing machine 10F, in cases in which the banknote bundle W is not taken out from the pay-out port 36, the controller 14 begins a take-in operation to take in the banknote bundle W. Specifically, as illustrated in FIG. 8A corresponding to FIG. 6A, first, the controller 14 moves the gripping conveyance guide 32 toward the front to the open-for-intake position, thereby closing off the front passage hole 30HF and the stacking hole 26H and opening up the rear passage hole 30HR and the intake hole 27H. The controller 14 then uses the bundle conveyance section 13C to convey the banknote bundle W toward the rear, similarly to in the case of the front-facing machine 10F. Namely, the controller 14 temporarily displaces the push-out section 35 upward, and then drives the upper belts 31 and the lower belts 34 toward the rear and displaces the push-out section 35 downward and moves the push-out section 35 toward the rear. The controller 14 thereby takes the banknote bundle W into the bundle conveyance path 13Y, and moves the banknote bundle W along the bundle conveyance path 13Y toward the rear.

Figure 8B:
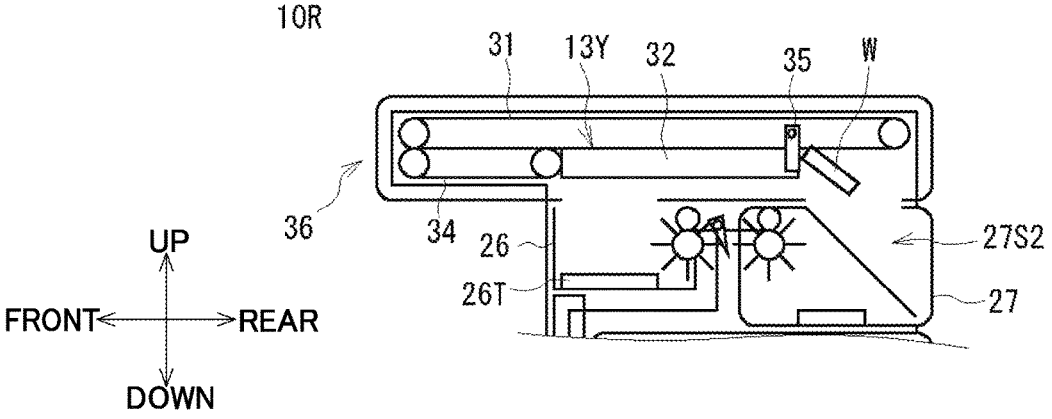
FIG. 8B is a schematic diagram illustrating a take-in operation of a rear-facing machine according to the first exemplary embodiment.

Eventually, as illustrated in FIG. 8B, when the banknote bundle W reaches the rear passage hole 30HR and the intake hole 27H, the controller 14 causes the banknote bundle W to fall from the bundle conveyance path 13Y to be stored inside the second storage space 27S2 of the reject storage box 27, and then ends the take-in operation. The rear-facing machine 10R is thus capable of taking in a banknote bundle W that a user has forgotten to take from the pay-out port 36 and storing the banknote bundle W in the reject storage box 27.

In this manner, the pay-out operation and the take-in operation of the rear-facing machine 10R are substantially the same as those of the front-facing machine 10F up until operation to generate the banknote bundle Win the storage unit 12, and differs in part of the operation to convey the banknote bundle W in the bundle conveyance unit 13. In other words, there is a change in control by the controller 14 relating to movement of the gripping conveyance guide 32 and movement of the push-out section 35 between the case of the front-facing machine 10F and the case of the rear-facing machine 10R.

1-3. Operation

In the above configuration, the banknote pay-out device 10 according to the first exemplary embodiment is configured by attaching the storage unit 12 on the lower side to the bundle conveyance unit 13 on the upper side.

In the banknote pay-out device 10, the size, namely the front-rear direction length, of the hole range 20E provided at the upper portion of the storage unit 12, and the size of the large hole 30H formed in the lower face of the bundle conveyance unit 13 are substantially the same as each other. Moreover, in the storage unit 12 of the banknote pay-out device 10, the stacking hole 26H and the intake hole 27H are formed with substantially front-rear symmetry in the hole range 20E. Moreover, the in the bundle conveyance unit 13, the positions and sizes of the front passage hole 30HF and the rear passage hole 30HR formed according to the movement of the gripping conveyance guide 32 are made to correspond with the stacking hole 26H and the intake hole 27H (FIG. 3).

From another perspective, in the conventional banknote pay-out device described in Japanese Patent No. 5156097, a banknote bundle conveyance path is formed only at the front side of a left behind banknote storage section 16 (FIG. 1). By contrast, in the banknote pay-out device 10, the bundle conveyance path 13Y is configured so as to pass above the reject storage box 27.

Accordingly, in the banknote pay-out device 10, the attachment/detachment face 12P of the storage unit 12 faces toward the front side or the rear side, and the stacking hole 26H and the intake hole 27H are aligned with either the front passage hole 30HF or the rear passage hole 30HR respectively and attached to the bundle conveyance unit 13, enabling the banknote pay-out device 10 to be assembled in two ways: as the front-facing machine 10F, or as the rear-facing machine 10R (FIG. 2).

In the front-facing machine 10F (FIG. 2A), the pay-out port 36 is positioned on the front side, and the banknote storage boxes 21 and the reject storage box 27 can respectively be attached and detached from the attachment/detachment face 12P, this being the front face of the storage unit 12. Moreover, a banknote bundle W can be passed between the storage unit 12 and the bundle conveyance unit 13 while performing the pay-out operation and the take-in operation (FIG. 5 and FIG. 6). Moreover, in the rear-facing machine 10R (FIG. 2B), the pay-out port 36 is positioned on the front side, and the banknote storage boxes 21 and the reject storage box 27 can respectively be attached and detached from the attachment/detachment face 12P, this being the rear face of the storage unit 12. Moreover, a banknote bundle W can be passed between the storage unit 12 and the bundle conveyance unit 13 while performing the pay-out operation and the take-in operation (FIG. 7 and FIG. 8). Namely, in the banknote pay-out device 10, operation that was not possible in the conventional banknote pay-out device described in Japanese Patent No. 5156097 from a structural perspective, is made possible even in cases in which sections at the lower side of the conveyance path of the banknote bundle, such as the banknote cassette and the conveyance path, have been reversed in the front-rear direction.

Accordingly, unlike the conventional banknote pay-out device described in Japanese Patent No. 5156097, the banknote pay-out device 10 can be assembled, and can perform pay-out operations and take-in operations, as either the front-facing machine 10F or the rear-facing machine 10R according to the installation location and the like. Namely, since the banknote pay-out device 10 is capable of operating as either the front-facing machine 10F or the rear-facing machine 10R, constraints due to the installation location can be eliminated. Moreover, the banknote pay-out device 10 uses common components and modules, enabling a great reduction in manufacturing and management costs in comparison to cases in which a front-facing machine and a rear-facing machine are designed separately to each other.

Moreover, the large hole 30H formed in the bundle conveyance unit 13 has a size that encompasses both the stacking hole 26H and the intake hole 27H. A portion of the large hole 30H is closed off by the gripping conveyance guide 32, and the remaining portion configures the front passage hole 30HF or the rear passage hole 30HR. Accordingly, in the bundle conveyance unit 13, the gripping conveyance guide 32 can be moved to the open-for-stacking position or to the open-for-intake position, so as to open up one out of the front passage hole 30HF or the rear passage hole 30HR while at the same time closing the other thereof, by the simple operation of moving the gripping conveyance guide 32 along the front-rear direction.

Moreover, in the bundle conveyance section 13C of the bundle conveyance unit 13 of the banknote pay-out device 10, the banknote bundle W is pushed in the front-rear direction by the push-out section 35 so as to move the banknote bundle W in the front-rear direction along the bundle conveyance path 13Y. Accordingly, in the banknote pay-out device 10, banknotes can be conveyed without incorporating belt mechanisms such as the lower belts 34 into the gripping conveyance guide 32 and the stage 26T, thereby enabling the configuration to be greatly simplified.

In particular, in the banknote pay-out device 10, it is necessary to move the gripping conveyance guide 32 in the front-rear direction, and move the stage 26T in the vertical direction. Accordingly, in cases in which the gripping conveyance guide 32 and the stage 26T are incorporated with belt mechanisms, their weight would increase, requiring a large force to move them, requiring reinforcement of the respective sections, or the like, which could lead to a more complex configuration and an increase in costs. However, in the banknote pay-out device 10, it is sufficient simply to move the push-out section 35 in the front-rear direction, thereby enabling such complication of the configuration and increases in costs to be avoided.

Moreover, in the banknote pay-out device 10, the lower belts 34, configured by a belt mechanism in front of the gripping conveyance guide 32, are provided to the bundle conveyance section 13C of the bundle conveyance unit 13. Accordingly, the banknote pay-out device 10 is capable of taking in a banknote bundle W more stably during banknote bundle W take-in than in cases in which a plate shaped member such as the gripping conveyance guide 32 is provided instead of the lower belts 34. In other words, the banknote pay-out device 10 is only provided with the lower belts 34 that are configured by a belt mechanism in the vicinity of the pay-out port 36, and the gripping conveyance guide 32 and the stage 26T positioned at other locations are configured by simple plate shaped members. This thereby enables precision and stability to be raised in a banknote bundle W take-in operation, while at the same time enabling the configuration to be made as simple as possible and enabling a reduction in costs.

Note that the configuration of the banknote pay-out device 10 inevitably entails a certain amount of time for banknote classification by the classification section 24, conveyance destination determination by the controller 14 according to the classification results, and completion of an operation by the switching section 25 to switch the direction of travel. Accordingly, in the banknote pay-out device 10, supposing the conveyance distance from the classification section 24 to the switching section 25 were short, it would be necessary to reduce the banknote conveyance speed in order to wait for completion of the switching operation by the switching section 25, resulting in a potential increase in the time needed in order to complete a pay-out operation.

Regarding this point, in the banknote pay-out device 10 the switching section 25 is disposed substantially at the front-rear direction center of the storage unit 12, thereby enabling the conveyance path from the classification section 24 to the switching section 25 to be formed with a certain degree of length. Accordingly, in the banknote pay-out device 10, the operation by the switching section 25 to switch the direction of travel can be completed while a banknote is being conveyed from the classification section 24 to the switching section 25, removing the need for an unnecessary reduction in the banknote conveyance speed, and enabling the pay-out operation to be completed within a shorter amount of time.

Moreover, in the banknote pay-out device 10, the switching section 25 is disposed between the stacking section 26 and the reject storage box 27, enabling the length of a conveyance path from the classification section 24 as far as the stacking section 26 via the switching section 25, and the length of a conveyance path from the classification section 24 as far as the reject storage box 27 via the switching section 25, to be brought substantially in line with each other. This thereby enables the conveyance path after the switching section 25 to be kept as short as possible in the banknote pay-out device 10, enabling the configuration to be simplified.

Moreover, in the banknote pay-out device 10, the feed-out section 22 is provided to a rear side lower portion of each of the banknote storage boxes 21 in the storage unit 12, thereby enabling a position where upward conveyance of the banknotes by the conveyance section 23 begins to be set as a comparatively low position. Accordingly, in the banknote pay-out device 10, the classification section 24 can be disposed at substantially the same height as the uppermost banknote storage box 21A, enabling the overall height of the banknote pay-out device 10 to be suppressed, and also enabling the conveyance path from the classification section 24 to the switching section 25 to be made sufficiently long.

According to the above configuration, in the banknote pay-out device 10 according to the first exemplary embodiment, the stacking hole 26H and the intake hole 27H are formed with substantially front-rear symmetry in the storage unit 12, and the front passage hole 30HF and the rear passage hole 30HR are formed in the bundle conveyance unit 13 at positions corresponding to the stacking hole 26H and the intake hole 27H. Accordingly, in the banknote pay-out device 10, the attachment/detachment face 12P of the storage unit 12 faces toward the front side or the rear side, and the stacking hole 26H and the intake hole 27H are aligned with either the front passage hole 30HF or the rear passage hole 30HR respectively and attached to the bundle conveyance unit 13. This enables the banknote pay-out device 10 to be assembled in two ways: as the front-facing machine 10F, or as the rear-facing machine 10R. The banknote pay-out device 10 is thereby capable of eliminating constraints in the installation location, and uses common components and modules, enabling a great reduction in manufacturing and management costs.

2. Second Exemplary Embodiment

Figure 9A:
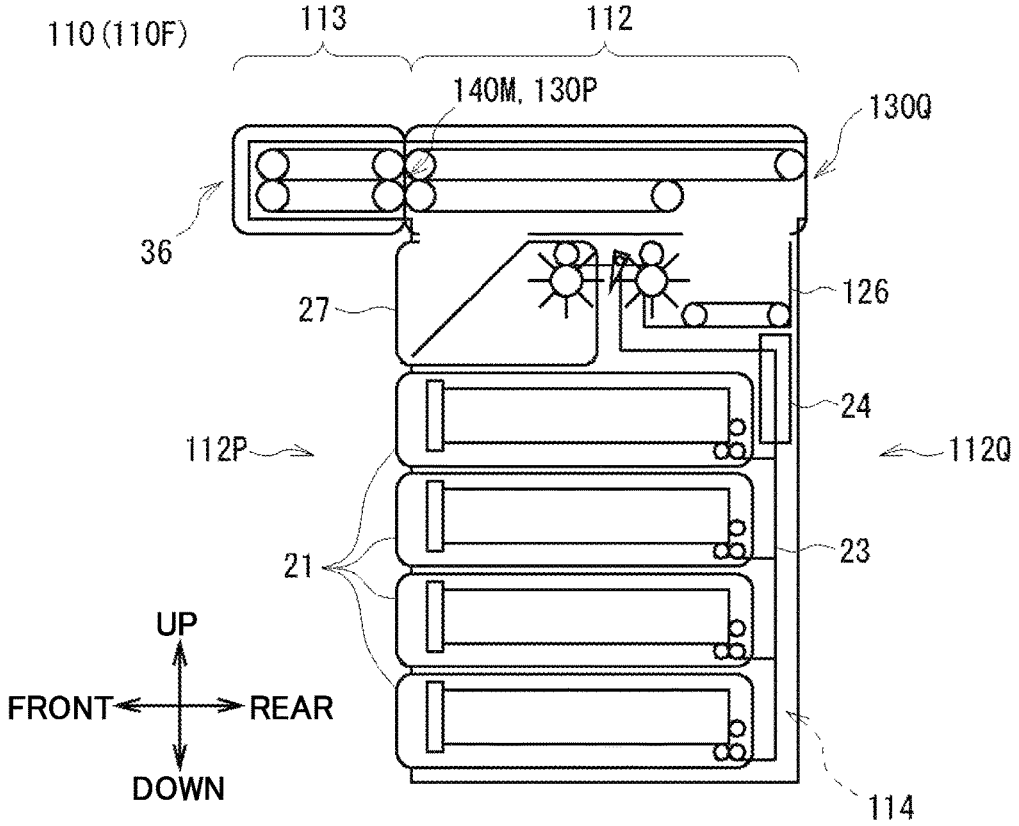
FIG. 9A is a schematic diagram illustrating a state in which a banknote pay-out device according to a second exemplary embodiment is assembled as a front-facing machine.

As illustrated in FIG. 9A corresponding to FIG. 2A, a banknote pay-out device 110 according to a second exemplary embodiment is broadly configured by a main unit 112 at a rear side and a front bundle conveyance unit 113 at a front side. The banknote pay-out device 110 incorporates a controller 114 that controls the overall banknote pay-out device 110. Similarly to the controller 14, the controller 114 is configured around a CPU, not illustrated in the drawings, and performs processing such as pay-out processing. The controller 114 stores various information in an internal storage section.

The main unit 112 has a configuration combining the storage unit 12 of the first exemplary embodiment with a portion corresponding to a range of approximately the rear two-thirds of the bundle conveyance unit 13.

Figure 10:
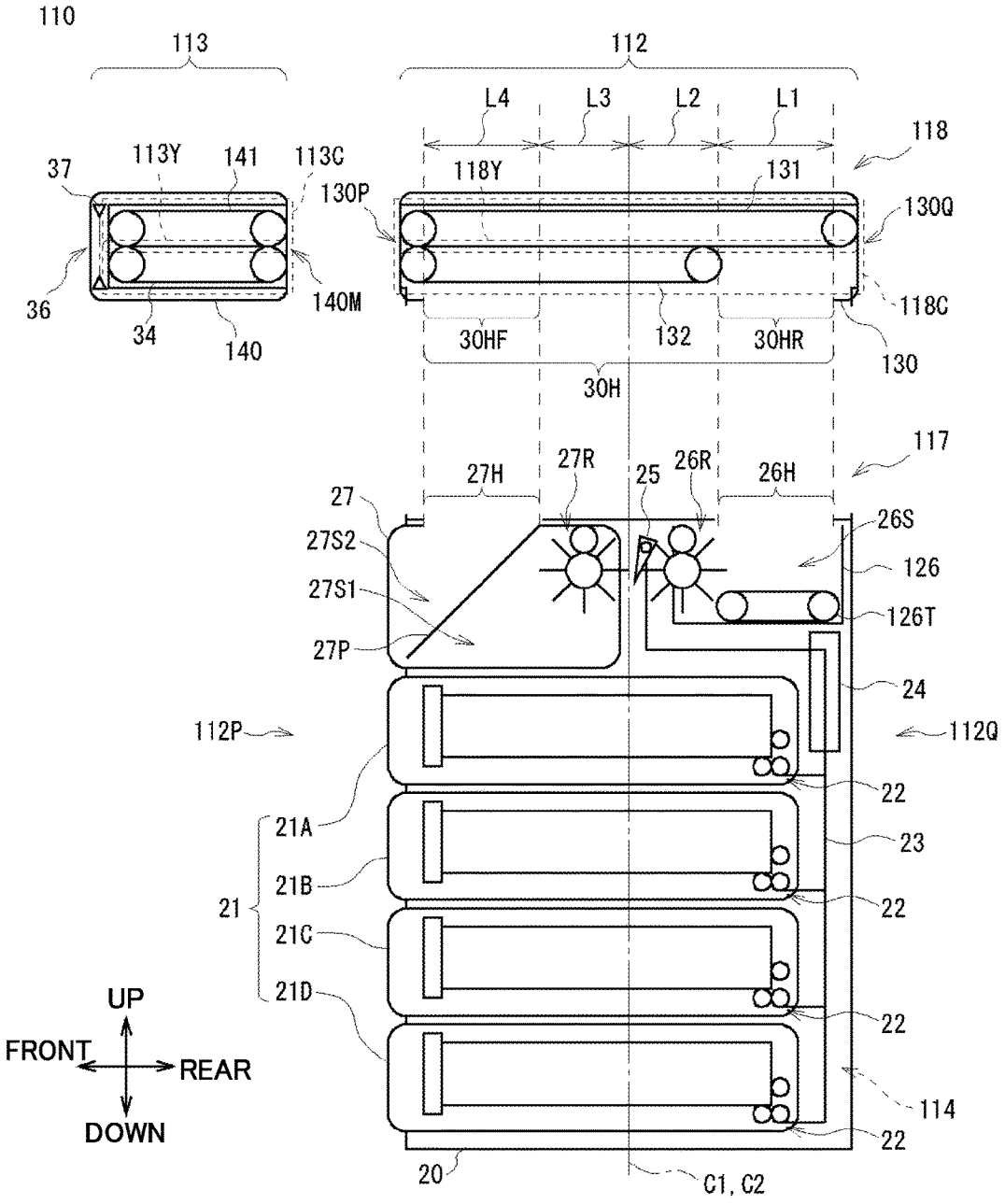
FIG. 10 is a schematic diagram illustrating configuration of a banknote pay-out device according to the second exemplary embodiment.

As illustrated in FIG. 10 corresponding to FIG. 3, a lower side portion of the main unit 112, namely a portion corresponding to the storage unit 12, configures a storage unit 117. The storage unit 117 includes a storage casing 20, banknote storage boxes 21 (21A, 21B, 21C, and 21D), a conveyance section 23, a classification section 24, a switching section 25, and a reject storage box 27 similar to those of the storage unit 12, as well as a stacking section 126 instead of the stacking section 26. A stage 126T of the stacking section 126 incorporates a belt mechanism similar to the lower belts 34 and the like.

Moreover, an upper side portion of the main unit 112, namely the portion corresponding to the range of approximately the rear two-thirds of the bundle conveyance unit 13, configures a rear bundle conveyance unit 118. The rear bundle conveyance unit 118 incorporates a bundle conveyance section 118C inside a bundle conveyance rear casing 130 corresponding to a rear side portion of the bundle conveyance casing 30. In contrast to the rear side portion of the bundle conveyance section 13C, in the bundle conveyance section 118C, upper rear belts 131 and movable conveyor belts 132 are provided corresponding to the upper belts 31 and the gripping conveyance guide 32 respectively, and the push-out section 35 is omitted.

The bundle conveyance rear casing 130 is formed with a large hole 30H similar to that of the first exemplary embodiment over substantially the entire range of a lower face, corresponding to the range of approximately the rear two-thirds of the bundle conveyance casing 30 of the first exemplary embodiment. The upper rear belts 131 are configured as if front side rollers of the upper belts 31 of the first exemplary embodiment were retracted to the vicinity of the front end of the bundle conveyance rear casing 130, and the peripheral length of the belts was shortened.

Similarly to the gripping conveyance guide 32, the movable conveyor belts 132 have a front-rear direction length corresponding to the sum of the lengths of L1, L2, and L3, and can be moved in the front-rear direction within the range of the large hole 30H by a moving mechanism, not illustrated in the drawings. The movable conveyor belts 132 also incorporate a belt mechanism, and upper faces of the movable conveyor belts 132 are driven in the front-rear direction.

In this configuration, a bundle conveyance path 118Y that conveys a banknote bundle W in the front-rear direction is formed inside the rear bundle conveyance unit 118 by the bundle conveyance section 118C, so as to run along the lower faces of the upper rear belts 131. A front end and a rear end of the bundle conveyance rear casing 130, namely a front end and a rear end of the bundle conveyance path 118Y, are respectively formed with passing ports 130P and 130Q for passing banknote bundles W across.

The main unit 112 differs from the first exemplary embodiment in that the attachment direction of the rear bundle conveyance unit 118 to the storage unit 117 is fixed. Moreover, for ease of explanation, the face of the main unit 112 where the banknote storage boxes 21 can be attached and detached is referred to as the attachment/detachment face 112P, and the face where the conveyance section 23 is built in is referred to as the conveyance face 112Q. Namely, the rear bundle conveyance unit 118 is attached to the storage unit 117 in a state in which the passing port 130P faces the attachment/detachment face 112P, and the passing port 130Q faces the conveyance face 112Q.

The front bundle conveyance unit 113 corresponds to a range of approximately the front one-third of the bundle conveyance unit 13 of the first exemplary embodiment. The front bundle conveyance unit 113 incorporates a bundle conveyance section 113C inside a front bundle conveyance casing 140 corresponding to a front side portion of the bundle conveyance casing 30. In contrast to a front side portion of the bundle conveyance section 13C, the bundle conveyance section 113C includes the lower belts 34, as well as upper front belts 141 instead of the upper belts 31. The front bundle conveyance casing 140 corresponds to a range of approximately the front one-third of the bundle conveyance casing 30 of the first exemplary embodiment, includes a pay-out port 36 at a front end, and is provided with a sensor 37 in the vicinity of the pay-out port 36.

The upper front belts 141 correspond to a range of approximately the front one-third of the upper belts 31 of the first exemplary embodiment, and, similarly to the upper belts 31, lower faces of the upper front belts 141 run in the front-rear direction due to circulation of the belts entrained around the periphery of rollers disposed at the front and rear.

In this configuration, a bundle conveyance path 113Y that conveys a banknote bundle W in the front-rear direction is formed by the bundle conveyance section 113C inside the front bundle conveyance unit 113 so as to run along a lower face of the upper front belts 141. A passing port 140M for passing banknote bundles W across is formed at a rear end of the front bundle conveyance casing 140, namely a rear end of the bundle conveyance path 113Y.

Moreover, in the banknote pay-out device 110, the front bundle conveyance unit 113 is attachable to either the attachment/detachment face 112P or the conveyance face 112Q of the main unit 112. For example, the banknote pay-out device 110 is attachable to the front bundle conveyance unit 113 in a state in which the attachment/detachment face 112P of the main unit 112 faces toward the front side and the conveyance face 112Q faces toward the rear side, and the passing port 140M faces the passing port 130P. Accordingly, as illustrated in FIG. 9A, the banknote pay-out device 10 can be assembled in a state in which the banknote storage boxes 21 can be attached and detached from the front side. The banknote pay-out device 110 disposed with the attachment/detachment face 112P at the front side in this manner is referred to hereafter as a front-facing machine 110F.

Figure 9B:
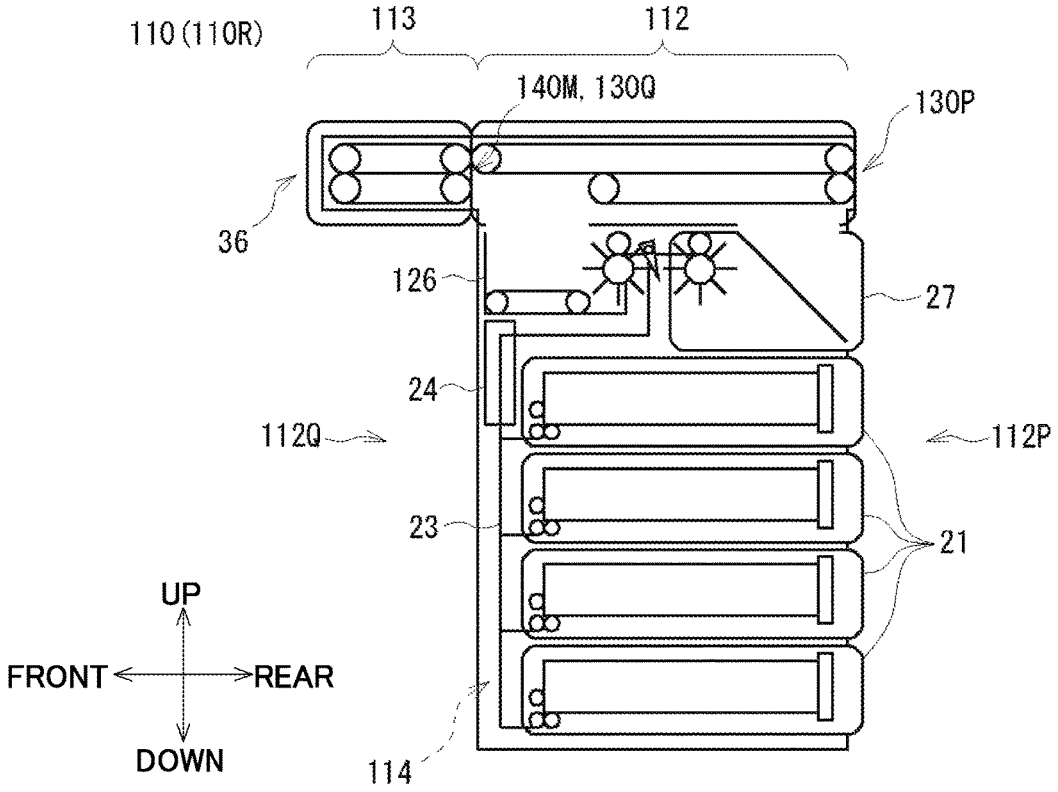
FIG. 9B is a schematic diagram illustrating a state in which a banknote pay-out device according to the second exemplary embodiment is assembled as a rear-facing machine.

Moreover, in the banknote pay-out device 110, the front bundle conveyance unit 113 is attachable in a state in which the attachment/detachment face 112P of the main unit 112 faces toward the rear side and the conveyance face 112Q faces toward the front side, and the passing port 140M faces the passing port 130Q. Accordingly, as illustrated in FIG. 9B, the banknote pay-out device 10 can be assembled in a state in which the banknote storage boxes 21 can be attached and detached from the rear side. The banknote pay-out device 110 disposed with the attachment/detachment face 112P at the rear side in this manner is referred to hereafter as a rear-facing machine 110R.

In this manner, the banknote pay-out device 110 can be assembled in two ways as the front-facing machine 110F or the rear-facing machine 110R by reversing the attachment direction of the main unit 112 to the front bundle conveyance unit 113 such that the passing port 140M faces either the passing port 130P or the passing port 130Q.

The rear bundle conveyance unit 118 and the front bundle conveyance unit 113 convey a banknote bundle W along the bundle conveyance paths 118Y and 113Y by respectively driving the upper rear belts 131, the upper front belts 141, the belts incorporated into the stage 126T, the movable conveyor belts 132, and the lower belts 34 toward the front or toward the rear. Accordingly, the banknote pay-out device 110 is capable of performing a pay-out operation and a take-in operation as either the front-facing machine 110F or the rear-facing machine 110R, similarly to the banknote pay-out device 10 according to the first exemplary embodiment.

In other words, in the rear bundle conveyance unit 118, the passing port 130P and the passing port 130Q that are capable of passing a banknote bundle W between themselves and the passing port 140M are disposed with front-rear symmetry, and the banknote bundle W can be conveyed along the front-rear direction by the upper rear belts 131, the movable conveyor belts 132, and the stage 126T. Moreover, the rear bundle conveyance unit 118 moves a banknote bundle W to be paid out into the bundle conveyance path 118Y using the stage 126T, and a banknote bundle W that has been taken in is made to fall into the reject storage box 27 to be stored. Accordingly, the banknote pay-out device 110 is capable of performing pay-out operations and take-in operations correctly while passing a banknote bundle W between the front bundle conveyance unit 113 and the rear bundle conveyance unit 118, whether the front bundle conveyance unit 113 is attached to the attachment/detachment face 112P side or to the conveyance face 112Q side of the main unit 112.

According to the above configuration, the banknote pay-out device 110 according to the second exemplary embodiment conveys banknote bundle W toward the front or rear along the bundle conveyance path 118Y in the rear bundle conveyance unit 118, and is capable of passing a banknote bundle W between the passing port 140M of the front bundle conveyance unit 113 and either one of the passing port 130P or the passing port 130Q respectively provided at the front and rear ends of the rear bundle conveyance unit 118. Accordingly, the banknote pay-out device 110 can be assembled in two ways, as the front-facing machine 110F or the rear-facing machine 110R, with the attachment/detachment face 112P of the main unit 112 facing toward the front side or the rear side, by attaching the front bundle conveyance unit 113 with the passing port 140M facing either the passing port 130P or the passing port 130Q. The banknote pay-out device 110 is thereby capable of eliminating constraints in the installation location, and uses common components and modules, enabling a great reduction in manufacturing and management costs.

3. Third Exemplary Embodiment

3-1. Main Unit and Bundle Conveyance Unit Configuration

Figure 11A:
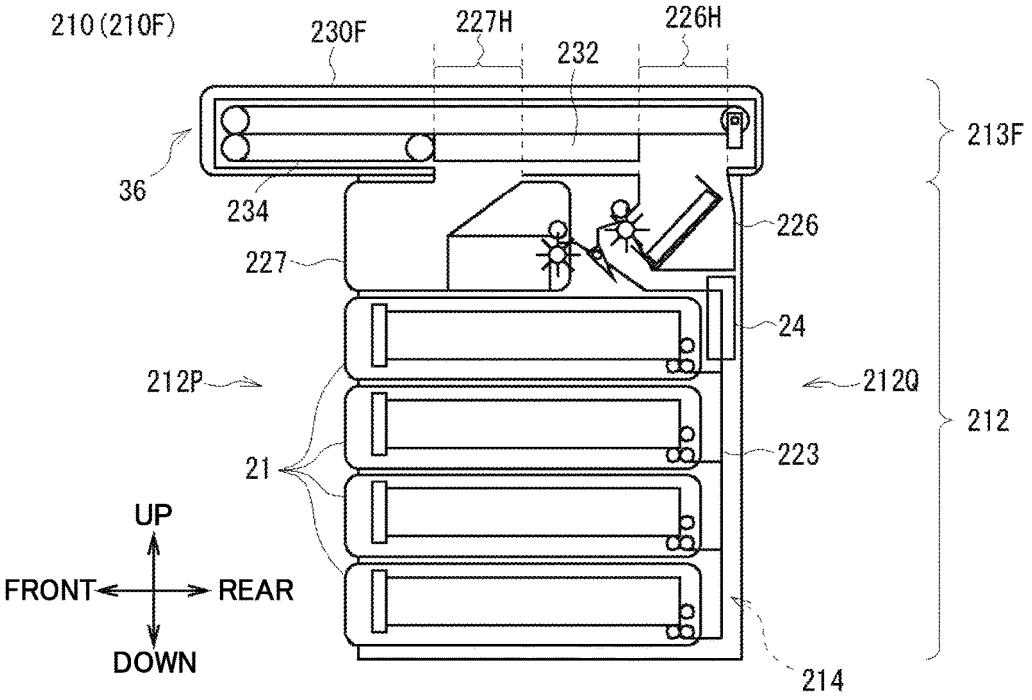
FIG. 11A is a schematic diagram illustrating a state in which a banknote pay-out device according to a third exemplary embodiment is assembled as a front-facing machine.
Figure 11B:
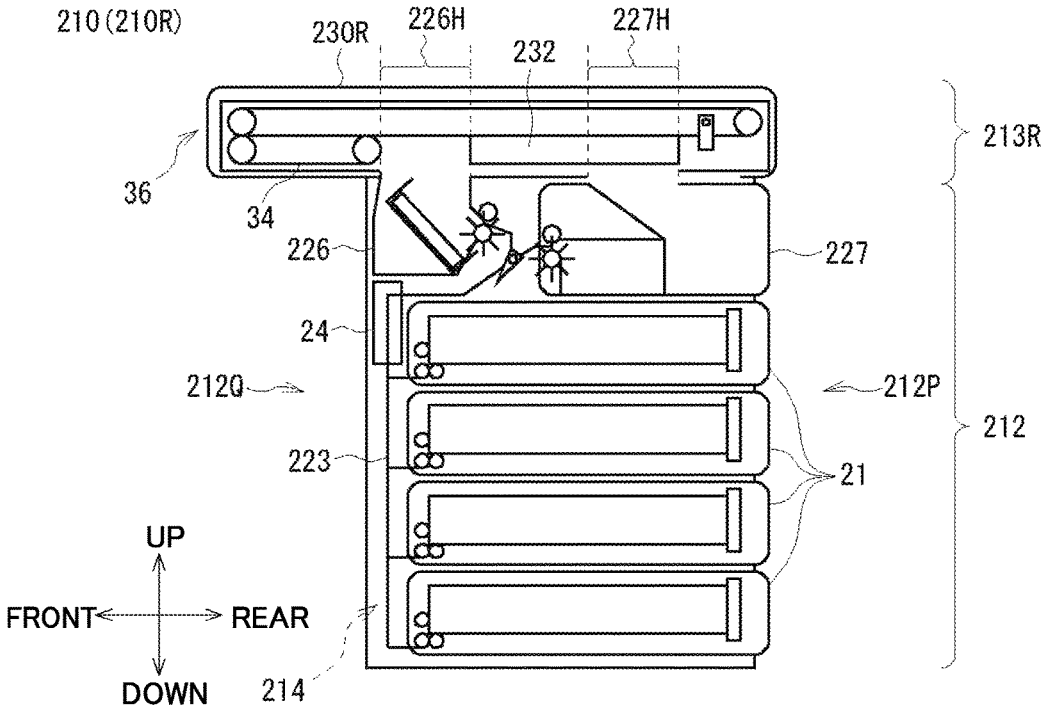
FIG. 11B is a schematic diagram illustrating a state in which a banknote pay-out device according to the third exemplary embodiment is assembled as a rear-facing machine.

As illustrated in FIG. 11 corresponding to FIG. 2 and FIG. 9, a banknote pay-out device 210 according to a third exemplary embodiment is broadly configured by a storage unit 212 at a lower side and a bundle conveyance units 213 (213F, 213R) at an upper side. The banknote pay-out device 210 incorporates a controller 214 that controls the overall banknote pay-out device 210. Similarly to the controller 14, the controller 214 is configured around a CPU, not illustrated in the drawings, and performs processing such as pay-out processing. The controller 214 stores various information in an internal storage section.

Figure 12:
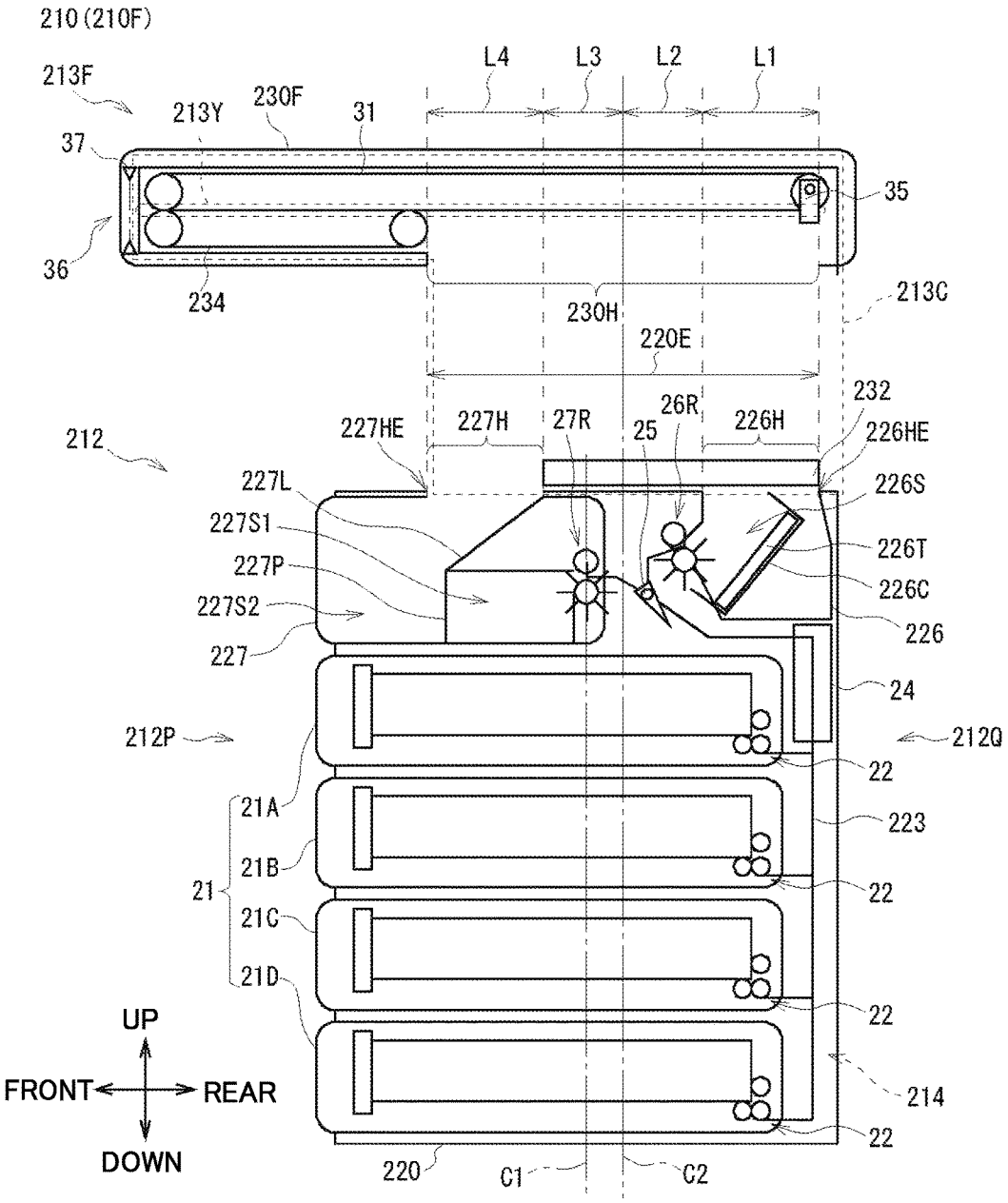
FIG. 12 is a schematic diagram illustrating configuration of a banknote pay-out device according to the third exemplary embodiment.

As illustrated in FIG. 12 corresponding to FIG. 3, the storage unit 212 is configured substantially the same as the storage unit 12 according to the first exemplary embodiment; however, the configuration differs in parts. Specifically, the storage unit 212 is provided with a storage casing 220, a conveyance section 223, a stacking section 226, and a reject storage box 227 instead of the storage casing 20, the conveyance section 23, the stacking section 26, and the reject storage box 27 of the storage unit 12. The storage unit 212 also includes a gripping conveyance guide 232.

The front-rear length of the stacking section 226 is somewhat shorter than that of the stacking section 26 according to the first exemplary embodiment. On the other hand, the front-rear length of the reject storage box 227 is somewhat longer than that of the reject storage box 27 according to the first exemplary embodiment. Accordingly, in the storage unit 212, the switching section 25 is disposed further to the rear side than the casing center line C1 representing the front-rear direction center of the storage casing 220, namely at a position offset toward a conveyance face 212Q side.

Accompanying this, the shape of a portion of the conveyance section 223 positioned further to the upper side than the banknote storage boxes 21, namely a banknote conveyance path, differs in part to that of the conveyance section 23 of the first exemplary embodiment. Namely, the conveyance section 223 is formed with an inclined portion, at a portion on the way toward the switching section 25 after passing through the classification section 24. A portion from the switching section 25 heading toward the reject storage box 227 is also partially inclined so as to substantially maintain this inclination angle. Moreover, a portion of the conveyance section 223 heading toward the stacking section 226 initially travels upward, then bends toward the rear partway along.

Similarly to in the first exemplary embodiment, an upper face of the stacking section 226 is provided with a stacking hole 226H penetrating in the vertical direction. The front-rear direction length of the stacking hole 226H is configured as the length L1, similarly to in the first exemplary embodiment. Moreover, the stacking section 226 is provided with a discharge section 26R similar to that of the first exemplary embodiment, a stage 226T corresponding to the stage 26T of the first exemplary embodiment, and a stacking basket 226C.

The stacking basket 226C is formed in the shape of a box that is open at an upper face, and the stage 226T is housed inside a stacking space 226S inside the stacking basket 226C. Banknotes are stacked on an upper face of the stage 226T. The stacking basket 226C is swung by a swinging mechanism, not illustrated in the drawings, and is capable of transitioning between an inclined orientation in which the stage 226T is inclined as illustrated in FIG. 12, and a horizontal orientation in which the stage 226T is substantially horizontal, described later. In the inclined orientation, the inclination angle of the stage 226T with respect to the horizontal direction is greater than a discharge angle of banknotes discharged into the stacking space 226S by the discharge section 26R (namely, close to vertical). The stage 226T is capable of being moved in the vertical direction with respect to the stacking basket 226C by a moving mechanism, not illustrated in the drawings.

An upper face of the reject storage box 227 is provided with an intake hole 227H penetrating in the vertical direction at a location toward the rear, namely a location close to the switching section 25 and the stacking section 226. The front-rear direction length of the intake hole 227H is configured as the length L4, similarly to the intake hole 27H of the first exemplary embodiment, and is also equivalent to the length L1 of the stacking hole 226H.

A space inside the reject storage box 227 is partitioned by plural partitioning plates 227P so as to form a first storage space 227S1 and a second storage space 227S2. The first storage space 227S1 is provided at a rear side inside the reject storage box 227, namely at the side closer to the switching section 25, and is almost directly below the intake hole 227H so as to be adjacent to a discharge section 27R.

Accordingly, the reject storage box 227 is able to store banknotes conveyed from the switching section 25 and discharged into the first storage space 227S1 by the discharge section 27R (namely reject banknotes) in the first storage space 227S1, similarly to in the first storage space 27S1 of the first exemplary embodiment.

The second storage space 227S2 is provided at a front side inside the reject storage box 227, namely at the side closer to the attachment/detachment face 212P, and is in communication with the intake hole 227H at an upper and diagonally rear side thereof. Moreover, an inclined face 227L is formed downward of the intake hole 227H and an upper side of the first storage space 227S1. The inclined face 227L is higher at a rear side, namely the side closer to the switching section 25 and the stacking section 226, and lower at a front side, namely the side closer to the attachment/detachment face 212P.

Accordingly, when a banknote bundle W enters from above the intake hole 227H, the reject storage box 227 guides the banknote bundle W toward the front along the inclined face 227L, and is able to store the banknote bundle W inside the second storage space 227S2, similarly to with the second storage space 27S2 of the first exemplary embodiment.

Note that similarly to in the first exemplary embodiment, a rear end portion of the stacking hole 226H configures a stacking hole end 226HE, and a front end portion of the intake hole 227H configures an intake hole end 227HE. A range between the stacking hole end 226HE and the intake hole end 227HE is defined as a hole range 220E. Accordingly, in the storage unit 212, a hole center line C2 representing the center of the hole range 220E is positioned offset more toward the conveyance face 212Q side than the casing center line C1 representing the front-rear direction center of the storage casing 220. In other words, the hole range 220E is provided at a position that is front-rear asymmetric with respect to the storage casing 220.

The gripping conveyance guide 232 corresponds to the gripping conveyance guide 32 provided to the bundle conveyance unit 13 of the first exemplary embodiment, and is formed in a plate shape that is thin in the vertical direction and long in the front-rear direction. Similarly to in the first exemplary embodiment, the front-rear direction length of the gripping conveyance guide 232 corresponds to the sum of the lengths L2, L3, and L4, or to the sum of the lengths L1, L2, and L3, and is a length corresponding to the length of the hole range 220E minus either the stacking hole 226H or the intake hole 227H.

Similarly to in the first exemplary embodiment, the gripping conveyance guide 232 is capable of being moved in the front-rear direction within the range of the hole range 220E by a moving mechanism, not illustrated in the drawings. Namely, when the gripping conveyance guide 232 has been moved to the open-for-intake position at the rear side, as illustrated in FIG. 12, the intake hole 227H is opened up and the stacking hole 226H is closed off. Conversely, when the gripping conveyance guide 232 has been moved to the open-for-stacking position at the front side, the stacking hole 226H is opened up and the intake hole 227H is closed off. Moreover, as described later, the gripping conveyance guide 232 configures part of a bundle conveyance section 213C.

Note that in the third exemplary embodiment, two types of the bundle conveyance unit 213, namely a front face bundle conveyance unit 213F and a rear face bundle conveyance unit 213R, are produced, and either one of these is combined with the storage unit 212 so as to configure a front-facing machine 210F or a rear-facing machine 210R. Explanation follows regarding the front face bundle conveyance unit 213F as an example.

The front face bundle conveyance unit 213F differs from the bundle conveyance units 213 according to the first exemplary embodiment in the points that a bundle conveyance section 213C is configured instead of the bundle conveyance section 13C, a bundle conveyance casing 230F and lower belts 234 are provided instead of the bundle conveyance casing 30 and the lower belts 34, and the gripping conveyance guide 32 is omitted, and has the same configuration otherwise.

In the bundle conveyance section 213C, a bundle conveyance path 213Y is formed inside the bundle conveyance casing 230F by upper belts 31, the lower belts 234, and a push-out section 35, as well as the gripping conveyance guide 232 of the storage unit 212.

The bundle conveyance casing 230F differs from the bundle conveyance casing 30 according to the first exemplary embodiment in the point that a large hole 230H is provided instead of the large hole 30H, and has the same configuration otherwise. The large hole 230H has a position and size adjusted so as to correspond to the hole range 220E in the storage unit 212 (FIG. 12) with the attachment/detachment face 212P facing toward the front. The lower belts 234 are configured as if the lower belts 34 of the first exemplary embodiment were extended toward the rear, with rear ends thereof reaching the vicinity of the front end of the large hole 230H.

Note that the rear face bundle conveyance unit 213R (FIG. 11B) differs from the front face bundle conveyance unit 213F in the points that the large hole 230H is formed further toward the front, and lower belts 34 similar to those of the first exemplary embodiment are employed instead of the lower belts 234.

3-2. Banknote Pay-Out Device Operation

Next, explanation follows regarding operation relating to pay-out in the banknote pay-out device 210, using the front-facing machine 210F as an example. Note that operation of the rear-facing machine 210R is similar to that in the first exemplary embodiment.

Figure 13A:
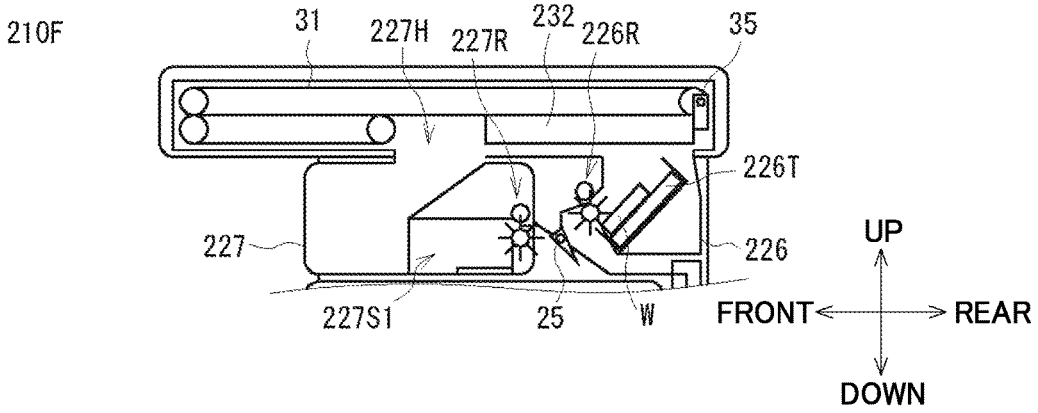
FIG. 13A is a schematic diagram illustrating a pay-out operation of a front-facing machine according to the third exemplary embodiment.

The controller 214 of the banknote pay-out device 210 places the stacking basket 226C and the stage 226T in an inclined orientation in the stacking section 226, as illustrated in FIG. 13A. Similarly to in the first exemplary embodiment, the controller 214 also moves the gripping conveyance guide 232 toward the open-for-intake position at the rear so as to open up the intake hole 227H and close off the stacking hole 226H, and moves the push-out section 35 to the rearmost side. The controller 214 also uses the conveyance section 223 to convey banknotes fed out from the banknote storage boxes 21 by the feed-out sections 22 to either the stacking section 226 or the reject storage box 227 via the classification section 24 and the switching section 25, similarly to as illustrated in FIG. 5A.

The stacking section 226 uses the discharge section 26R to discharge conveyed banknotes into the stacking space 226S and to stack the banknotes on the stage 226T inside the stacking basket 226C. When this is performed, the banknotes are aligned by the action of gravity, in a state abutting a front side face of the stacking basket 226C, for example, on the stage 226T. The reject storage box 227 uses the discharge section 27R to discharge and store conveyed banknotes inside the first storage space 227S1.

Figure 13B:
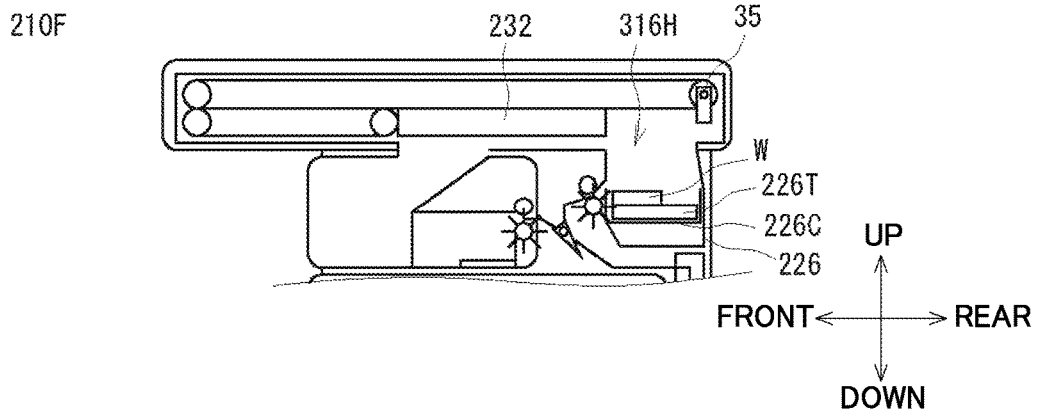
FIG. 13B is a schematic diagram illustrating a pay-out operation of a front-facing machine according to the third exemplary embodiment.
Figure 13C:
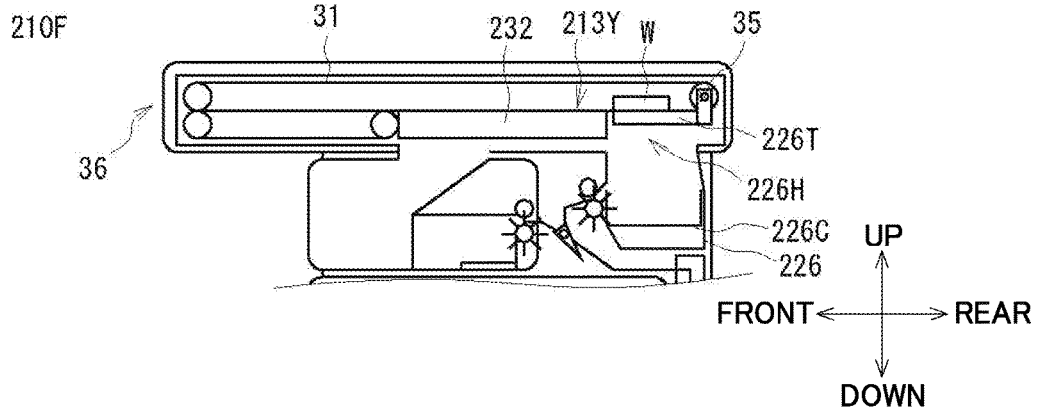
FIG. 13C is a schematic diagram illustrating a pay-out operation of a front-facing machine according to the third exemplary embodiment.

When banknotes corresponding to the pay-out amount have been stacked on the stage 226T, as illustrated in FIG. 13B, the controller 214 moves the gripping conveyance guide 232 to the open-for-stacking position at the front, and then transitions the stacking basket 226C to the horizontal orientation so as to make the upper face of the stage 226T substantially horizontal. Doing so achieves a state in which a banknote bundle W is stacked on the stage 226T in the stacking section 226. The controller 214 then raises the stage 226T as illustrated in FIG. 13C, and thereby delivers the banknote bundle W into the front face bundle conveyance unit 213F through the stacking hole 226H, and positions the banknote bundle W on the bundle conveyance path 213Y. When this is performed, the stage 226T forms part of the bundle conveyance path 213Y.

Then, similarly to in the first exemplary embodiment, the controller 214 uses the bundle conveyance section 213C to convey the banknote bundle W toward the front. Specifically, the controller 214 drives the upper belts 31 toward the front and moves the push-out section 35 toward the front, thereby moving the banknote bundle W toward the front along the bundle conveyance path 213Y. When this is performed, the controller 214 uses the upper belts 31 and the lower belts 234 to grip the banknote bundle W from above and below when the banknote bundle W reaches a position abutting the upper faces of the lower belts 234, and then runs the respective belts to convey the banknote bundle W toward the front.

Figure 13D:
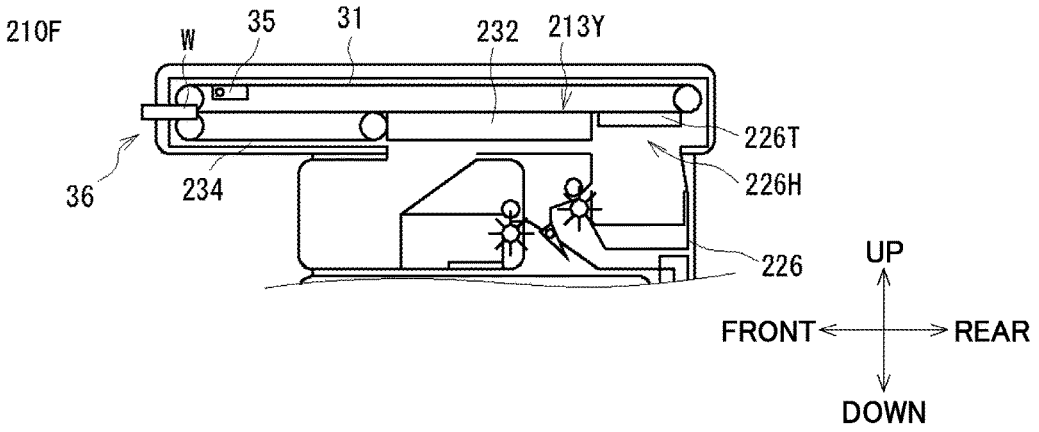
FIG. 13D is a schematic diagram illustrating a pay-out operation of a front-facing machine according to the third exemplary embodiment.

When the banknote bundle W reaches the pay-out port 36 as illustrated in FIG. 13D, the controller 214 stops running the upper belts 31 and the lower belts 234, and ends the pay-out operation to allow a user to remove the banknote bundle W. The controller 214 brings the push-out section 35 to the vicinity of a front end of the bundle conveyance path 213Y, such that the push-out section 35 is retracted above the bundle conveyance path 213Y by a retraction mechanism (not illustrated in the drawings).

Figure 13E:
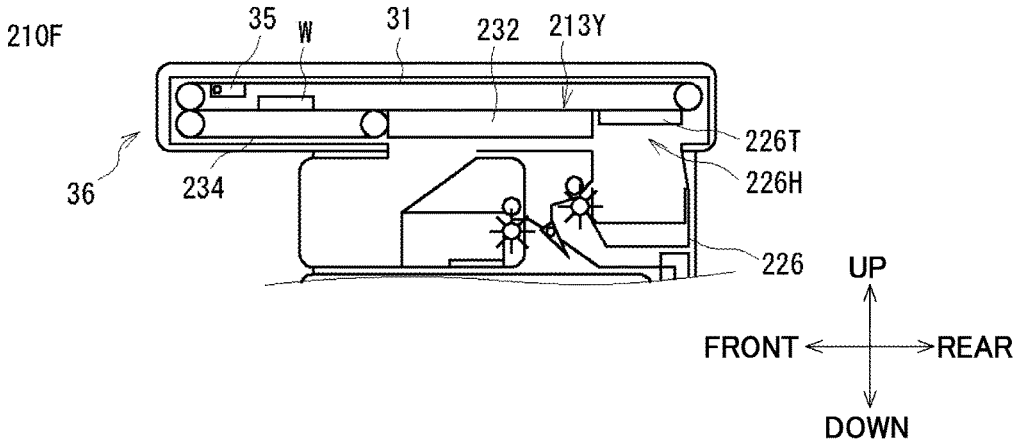
FIG. 13E is a schematic diagram illustrating a pay-out operation of a front-facing machine according to the third exemplary embodiment.

Note that in cases in which the banknote bundle W is not removed from the pay-out port 36, the controller 214 performs a take-in operation to take in a banknote bundle W by following a different procedure to that in the first exemplary embodiment. Specifically, the controller 214 first conveys the banknote bundle W toward the rear using the bundle conveyance section 213C. Namely, as illustrated in FIG. 13E, the controller 214 drives the upper belts 31 and the lower belts 234 toward the rear while the push-out section 35 remains in a retracted state above the push-out section 35. The banknote bundle W is thereby taken into the bundle conveyance path 213Y and moved toward the rear along the bundle conveyance path 213Y.

Figure 14A:
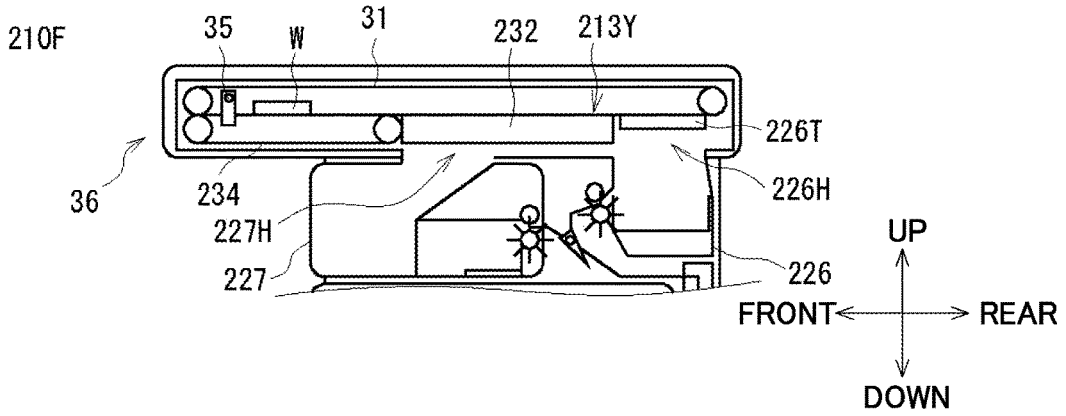
FIG. 14A is a schematic diagram illustrating a take-in operation of a front-facing machine according to the third exemplary embodiment.

When this is performed, detected by a sensor, not illustrated in the drawings, that the banknote bundle W has reached a position further to the rear than the push-out section 35, the controller 214, as illustrated in FIG. 14A, returns the push-out section 35 retracted above the bundle conveyance path 213Y into the bundle conveyance path 213Y at the front side of the banknote bundle W. The controller 214 then assists conveyance of the banknote bundle W toward the rear by moving the push-out section 35 toward the rear.

Figure 14B:
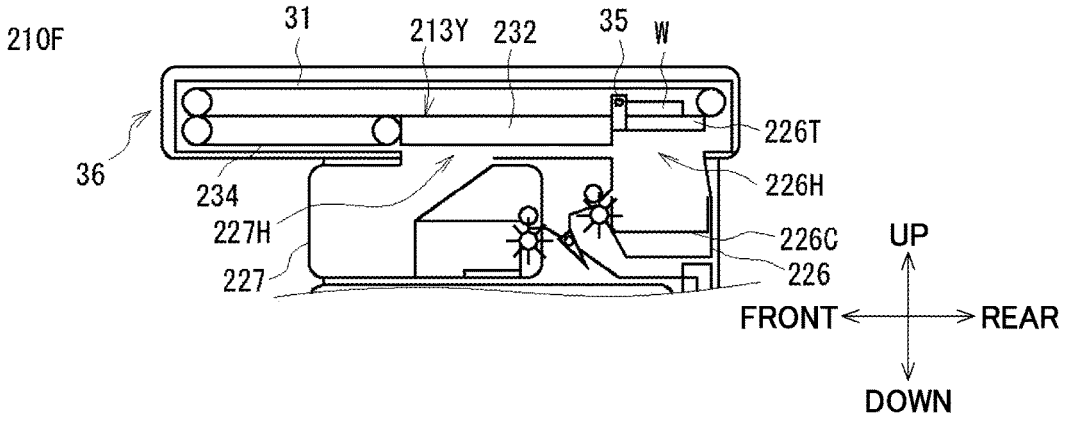
FIG. 14B is a schematic diagram illustrating a take-in operation of a front-facing machine according to the third exemplary embodiment.

Next, after the banknote bundle W has reached the rear end of the lower belts 234, the controller 214 continues to push the banknote bundle W toward the rear using the push-out section 35, and as illustrated in FIG. 14B, the controller 214 stops the push-out section 35 at a point at which the banknote bundle W has been placed on the stage 226T. Namely, the controller 214 moves the banknote bundle W further toward the rear side than the intake hole 227H of the reject storage box 227.

Figure 14C:
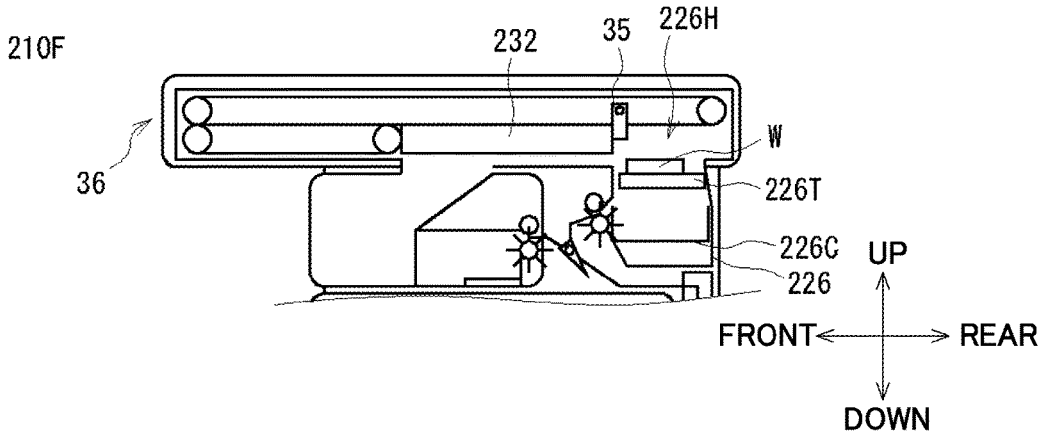
FIG. 14C is a schematic diagram illustrating a take-in operation of a front-facing machine according to the third exemplary embodiment.
Figure 14D:
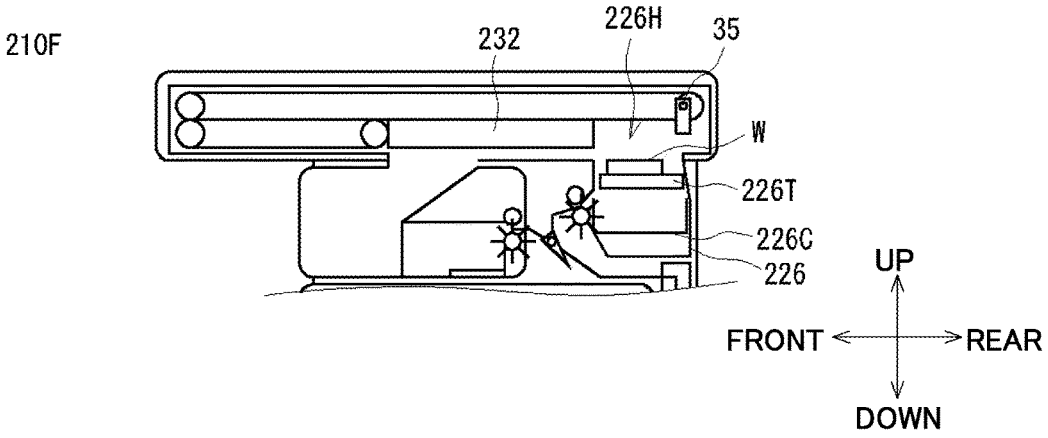
FIG. 14D is a schematic diagram illustrating a take-in operation of a front-facing machine according to the third exemplary embodiment.
Figure 14E:
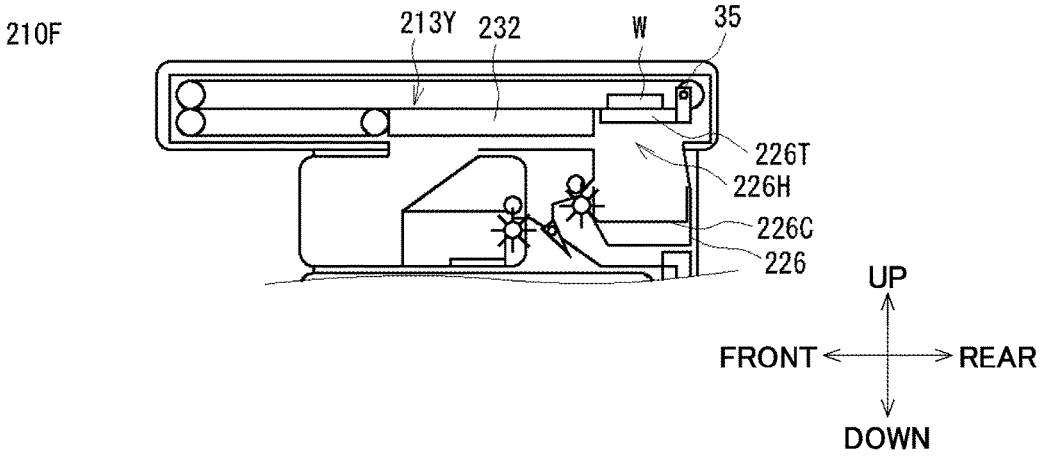
FIG. 14E is a schematic diagram illustrating a take-in operation of a front-facing machine according to the third exemplary embodiment.

Next, as illustrated in FIG. 14C, the controller 214 lowers the stage 226T in the state in which the banknote bundle W is placed thereon, so as to temporarily remove the banknote bundle W from the bundle conveyance path 213Y. As illustrated in FIG. 14D and FIG. 14E, the controller 214 then moves the push-out section 35 as far as the vicinity of the rear end of the bundle conveyance path 213Y without causing the push-out section 35 to contact the banknote bundle W, before raising the stage 226T and returning the banknote bundle W to the bundle conveyance path 213Y. As a result, the push-out section 35 is positioned at the rear side of the banknote bundle W in the bundle conveyance path 213Y. Namely, the controller 214 utilizes movement of the banknote bundle W on the stage 226T in the vertical direction when moving the push-out section 35 from the front side to the rear side of the banknote bundle W.

Figure 15A:
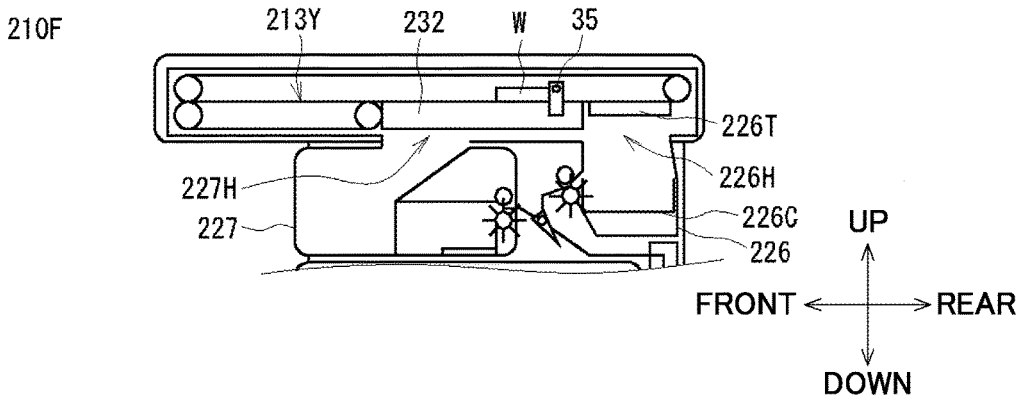
FIG. 15A is a schematic diagram illustrating a take-in operation of a front-facing machine according to the third exemplary embodiment.
Figure 15B:
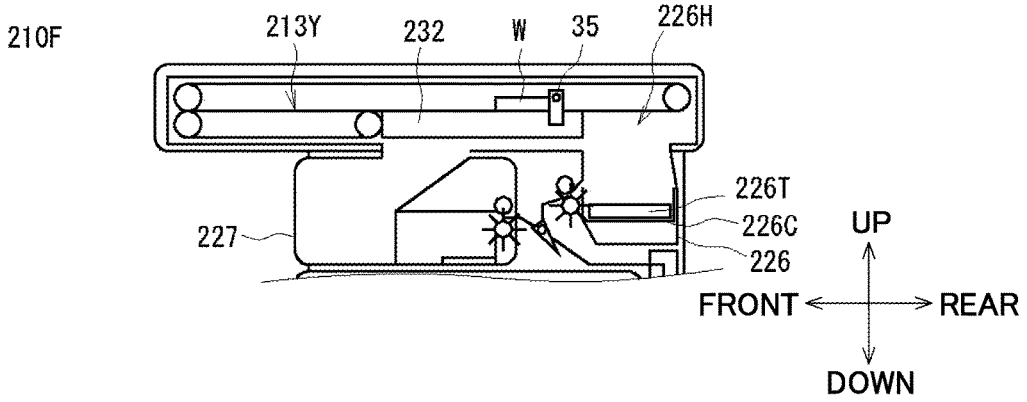
FIG. 15B is a schematic diagram illustrating a take-in operation of a front-facing machine according to the third exemplary embodiment.
Figure 15C:
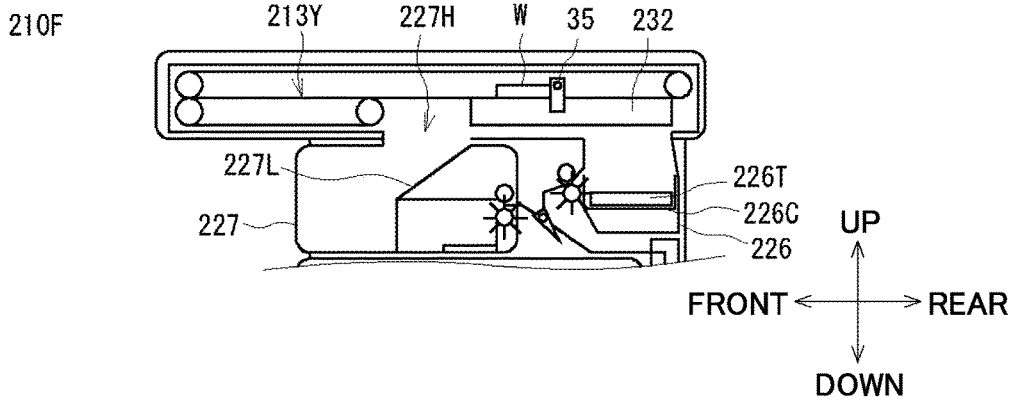
FIG. 15C is a schematic diagram illustrating a take-in operation of a front-facing machine according to the third exemplary embodiment.

Next, the controller 214 uses the bundle conveyance section 213C to convey the banknote bundle W toward the front. Specifically, as illustrated in FIG. 15A, FIG. 15B, and FIG. 15C, by moving the push-out section 35 toward the front, the controller 214 conveys the banknote bundle W to the upper face of the gripping conveyance guide 232 further to the rear side than the intake hole 227H, lowers the stage 226T, and moves the gripping conveyance guide 232 to the open-for-intake position at the rear with the push-out section 35 still stationary. In this manner, the controller 214 is capable of opening the intake hole 227H, positioning the banknote bundle W at the rear side of the intake hole 227H, and causing the rear side of the banknote bundle W to contact the push-out section 35.

Figure 15D:
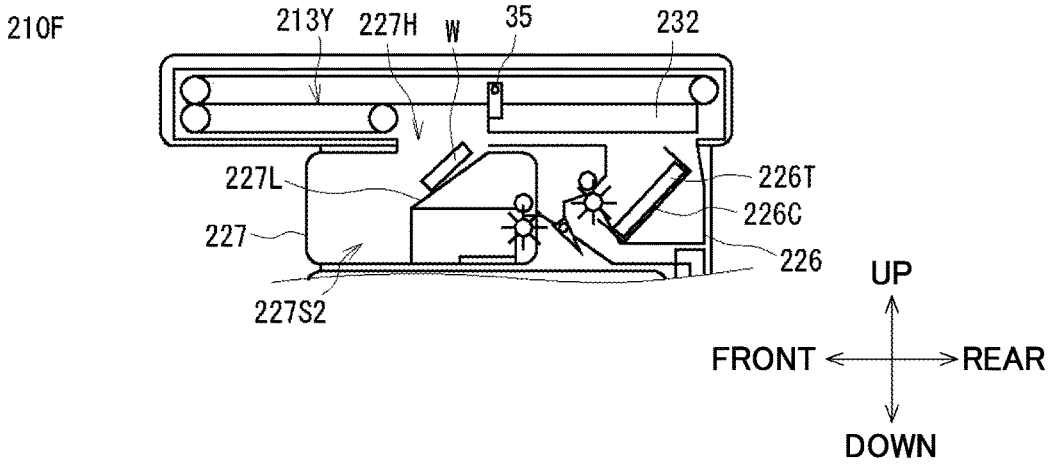
FIG. 15D is a schematic diagram illustrating a take-in operation of a front-facing machine according to the third exemplary embodiment.

Finally, as illustrated in FIG. 15D, the controller 214 moves the push-out section 35 toward the front so as to drop the banknote bundle W through the intake hole 227H, causes the banknote bundle W to slide forward along the inclined face 227L, and to reach the inside of the second storage space 227S2. Accordingly, the controller 214 is capable of sliding a banknote bundle W left behind by a user along the inclined face 227L while guiding the banknote bundle W into the second storage space 227S2 to be stored.

3-3. Operation

In the above configuration, the banknote pay-out device 210 according to the third exemplary embodiment opens either the stacking hole 226H or the intake hole 227H by moving the gripping conveyance guide 232 in the front-rear direction at the inside of the hole range 220E in the storage unit 212. Moreover, in the banknote pay-out device 210 the front face bundle conveyance unit 213F employed in the front-facing machine 210F, and the rear face bundle conveyance unit 213R employed in the rear-facing machine 210R are configured differently from each other primarily by the position of the large hole 230H.

Accordingly, the storage unit 212 of the banknote pay-out device 210 can be incorporated into either the front-facing machine 210F or the rear-facing machine 210R simply by switching the attachment direction with respect to the bundle conveyance unit 213. Accordingly, the banknote pay-out device 210 enables a much higher degree of commonality between components between the front-facing machine 210F and the rear-facing machine 210R than in the case of the conventional banknote pay-out device described in Japanese Patent No. 5156097.

Moreover, in the banknote pay-out device 210, and in particular in the front-facing machine 210F, during take-in of a banknote bundle W left behind by a user, the banknote bundle W is made to fall after first being moved to the rear side of the intake hole 227H, namely to the high side of the inclined face 227L. Accordingly, in the banknote pay-out device 210 a banknote bundle W of banknotes stacked in the form of a loose bundle can reach the second storage space 227S2 where it is to be stored without the banknote bundle W collapsing as it falls, such that as far as possible, the banknote bundle W is retained in a bundle form.

Moreover, in the storage unit 212, the switching section 25 is positioned further to the conveyance face 212Q side than the casing center line C1 representing the front-rear center of the storage casing 220. Accordingly, the storage unit 212 is capable of reducing the length of the conveyance path when banknotes are conveyed through the classification section 24 to the stacking section 226 by the conveyance section 223 in comparison to the case of the storage unit 12 (FIG. 3) according to the first exemplary embodiment. In general, in the banknote pay-out device 210, the frequency with which banknotes rejection occurs in the classification section 24 is extremely low, with almost all banknotes being conveyed to the stacking section 226 as normal banknotes. Accordingly, in the storage unit 212, the probability of causing banknote jams and the like during conveyance can be lowered accompanying this reduction in the length of the conveyance path to the stacking section 226 along which most banknotes are conveyed.

Accompanying this, in the conveyance section 223 of the storage unit 212, the direction of progress barely changes in the banknote conveyance path from the classification section 24 to the reject storage box 227 when passing through the switching section 25, and locations where the conveyance path bends are given obtuse angles. Thus, in the storage unit 212, in cases in which the conveyance section 223 conveys a reject banknote from the classification section 24 to the reject storage box 227, it is sufficient to change the direction of travel of the banknote by a comparatively small angle range, enabling the load applied to the banknote during conveyance to be kept comparatively small, enabling stable conveyance.

Moreover, in the stacking section 226, when in the inclined orientation, the inclination angle of the stage 226T with respect to the horizontal direction is comparatively large, and in particular, is larger than the discharge angle of banknotes discharged from the discharge section 26R into the stacking space 226S (FIG. 12). Accordingly, in the stacking section 226, gravity is caused to act on banknotes discharged from the discharge section 26R, enabling the front edges of the respective banknotes to be caused to abut a side face of the stacking basket 226C or the like, thereby arranging the banknotes neatly on the stage 226T.

The banknote pay-out device 210 is similar to the banknote pay-out device 10 according to the first exemplary embodiment in other respects, except in the point that the front face bundle conveyance unit 213F and the rear face bundle conveyance unit 213R are configured differently to each other.

According to the above configuration, in the banknote pay-out device 210 according to the third exemplary embodiment, the stacking hole 226H and the intake hole 227H are formed within the hole range 220E so as to substantially front-rear symmetrical about the hole center line C2 of the storage unit 212. Accordingly, the banknote pay-out device 210 can be assembled in two ways: as the front-facing machine 210F or as the rear-facing machine 210R, by pointing the attachment/detachment face 212P of the storage unit 212 toward the front side or toward the rear side, and attaching the front face bundle conveyance unit 213F or the rear face bundle conveyance unit 213R with the large hole 230H aligned with the hole range 220E. The banknote pay-out device 210 is thereby capable of eliminating constraints due to the installation location, and is also capable of a great reduction in manufacturing and management costs due to using common components and modules.

4. Other Exemplary Embodiments

Note that in the first exemplary embodiment described above, explanation has been given regarding a case in which the gripping conveyance guide 32 is configured by a plate shaped member. However, the present disclosure is not limited thereto, and, for example, various mechanisms may be incorporated for conveying banknote bundles W, for example belt mechanisms capable of driving belts such as the movable conveyor belts 132 according to the second exemplary embodiment. The same applies to the stage 26T of the stacking section 26. In particular, in cases in which both the gripping conveyance guide 32 and the stage 26T incorporate belt mechanisms, the push-out section 35 may be omitted. Conversely, in the second exemplary embodiment, the movable conveyor belts 132 and the stage 126T may be configured by plate shaped members similarly to in the first exemplary embodiment. In such cases, providing a push-out section 35 similar to that of the first exemplary embodiment enables a banknote bundle W to be conveyed along the bundle conveyance path 118Y.

Moreover, in the first exemplary embodiment described above, explanation has been given regarding a case in which the gripping conveyance guide 32 is provided on the bundle conveyance unit 13 side. However, the present disclosure is not limited thereto, and, for example, similarly to in the third exemplary embodiment, provision may be on the storage unit 12 side. The same applies in the second exemplary embodiment. Moreover, conversely, the gripping conveyance guide 232 may be provided on the bundle conveyance unit 213 side in the third exemplary embodiment.

Moreover, in the first exemplary embodiment described above, explanation has been given regarding a case in which the front-rear direction length of the gripping conveyance guide 32 is the sum of the lengths L1, L2, and L3, and the gripping conveyance guide 32 is moved in the front-rear direction within the range of the large hole 30H so as to exclusively form the front passage hole 30HF or the rear passage hole 30HR. However, the present disclosure is not limited thereto, and, for example, the length of the gripping conveyance guide 32 may be fixed at the summed length of the lengths L2 and L3, and provided with shutters capable of respectively opening and closing the front passage hole 30HF and the rear passage hole 30HR.

Moreover, in the first exemplary embodiment described above, explanation has been given regarding a case in which the front-rear direction lengths L1 and L4 of the stacking hole 26H and the intake hole 27H are equal to one another. However, the present disclosure is not limited thereto, and, for example, the front-rear direction length L4 of the intake hole 27H may be set longer than the front-rear direction length L1 of the stacking hole 26H. Namely, the front-rear direction lengths L1 and L4 of the stacking hole 26H and intake hole 27H may be made different from each other. In essence, whether configured as the front-facing machine 10F or the rear-facing machine 10R, the configuration is sufficient as long as the stacking hole 26H can be closed off with the intake hole 27H opened up when the gripping conveyance guide 32 has been moved to the open-for-intake position on the stacking section 26 side, and that the intake hole 27H can be closed off with the stacking hole 26H opened up when the gripping conveyance guide 32 has been moved to the open-for-stacking position on the reject storage box 27 side. The same applies in the second and the third exemplary embodiments.

Moreover, in the first exemplary embodiment described above, explanation has been given regarding a case in which the gripping conveyance guide 32 is configured by a single plate shaped member or rectangular block shaped member, and either one of the stacking hole 26H or the intake hole 27H is closed off with the other being opened up by moving the gripping conveyance guide 32 in the front-rear direction. However, the present disclosure is not limited thereto, and configuration may be made in which two or more of the gripping conveyance guide 32 are configured by plate shaped members or rectangular block shaped members. For example, instead of the gripping conveyance guide 32, a stacking gripping conveyance guide and a take-in gripping conveyance guide corresponding to dividing the gripping conveyance guide 32 into a front and a rear section may be provided. In such cases, the opening and closing of the stacking hole 26H by the stacking gripping conveyance guide can be performed independently to the opening and closing of the intake hole 27H by the take-in gripping conveyance guide, enabling, for example, both the stacking hole 26H and the intake hole 27H to be closed off at the same time. The same applies in the second and the third exemplary embodiments.

Moreover, in the first exemplary embodiment described above, explanation has been given regarding a case in which, at the lower side of the bundle conveyance unit 13, the large hole 30H is formed corresponding to the summed front-rear direction lengths L1 to L4. However, the present disclosure is not limited thereto, and, for example, a hole corresponding to the rear passage hole 30HR of length L1 may be formed independently to a hole corresponding to the front passage hole 30HF of length L4. The same applies in the second and the third exemplary embodiments.

Moreover, in the first exemplary embodiment described above, explanation has been given regarding a case in which when banknotes are stacked on the stage 26T, the stacking hole 26H is closed off by the gripping conveyance guide 32 to prevent banknotes from floating upward into the bundle conveyance path 13Y. However, the present disclosure is not limited thereto, and, for example, banknotes may be stacked on the stage 26T with the stacking hole 26H remaining opened up by the gripping conveyance guide 32. The same applies in the second and the third exemplary embodiments.

Moreover, in the first exemplary embodiment described above, explanation has been given regarding a case in which reject banknotes and left behind banknotes are kept separate by partitioning the space inside the reject storage box 27 into the first storage space 27S1 and the second storage space 27S2 with the partitioning plate 27P. However, the present disclosure is not limited thereto, and, for example, the partitioning plate 27P may be omitted such that reject banknotes and left behind banknotes are stored together in a single space. Moreover, for example in cases in which the reject storage box 27 is formed thin in the vertical direction, and the height difference between the bundle conveyance path 13Y and a bottom face of the reject storage box 27 is comparatively small, configuration may be made in which the partitioning plate 27P is not inclined, and banknote bundles W are made to fall directly, without being guided. The same applies in the second and the third exemplary embodiments.

Moreover, in the third exemplary embodiment described above, explanation has been given regarding a case in which the push-out section 35 is retracted from the bundle conveyance path 213Y only in the vicinity of the pay-out port 36, using the retraction mechanism (not illustrated in the drawings) of the bundle conveyance section 213C. However, the present disclosure is not limited thereto, and, for example, configuration may be made in which the push-out section 35 is retracted from the bundle conveyance path 213Y and returned to the bundle conveyance path 213Y at any given location using a retraction mechanism. In the bundle conveyance section 213C, in particular in cases in which a user has left behind a banknote bundle W, the procedure utilizing movement of the stage 226T, as illustrated in FIG. 14B to FIG. 14E, may be omitted by moving the push-out section 35 to the rear side of the banknote bundle W with the push-out section 35 in a state retracted from the bundle conveyance path 213Y at the stage when the banknote bundle W has been retracted to the rear side of the intake hole 227H. The same applies in the first and the second exemplary embodiments.

Figure 16A:
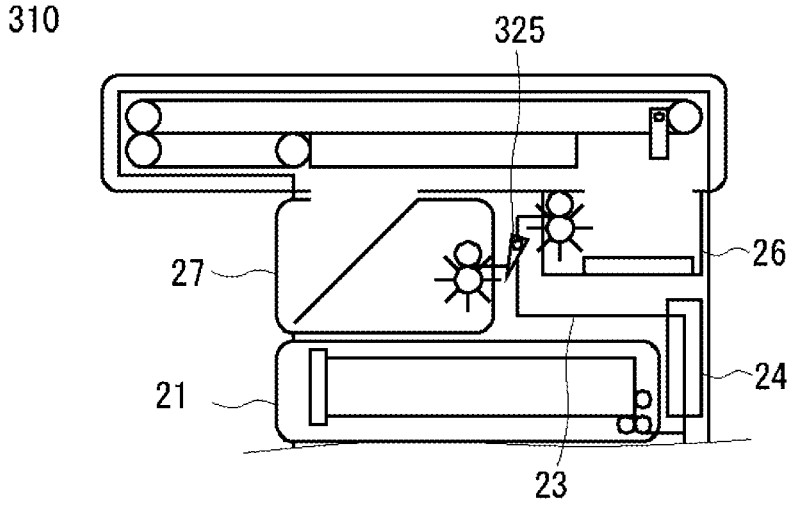
FIG. 16A is a schematic diagram illustrating configuration of a banknote pay-out device according to another exemplary embodiment.

Moreover, in the first exemplary embodiment described above, explanation has been given regarding a case in which banknotes are moved to either the stacking section 26 or the reject storage box 27 by switching the banknote direction of travel toward the rear side or the front side using the switching section 25. However, the present disclosure is not limited thereto, and as in a banknote pay-out device 310 illustrated in FIG. 16A, for example, a banknote direction of travel may be switched to an upper side or a front side by a switching section 325. In essence, it is sufficient that banknotes be sorted toward the stacking section 26 or the reject storage box 27 by switching the banknote direction of travel between two different directions.

Figure 16B:
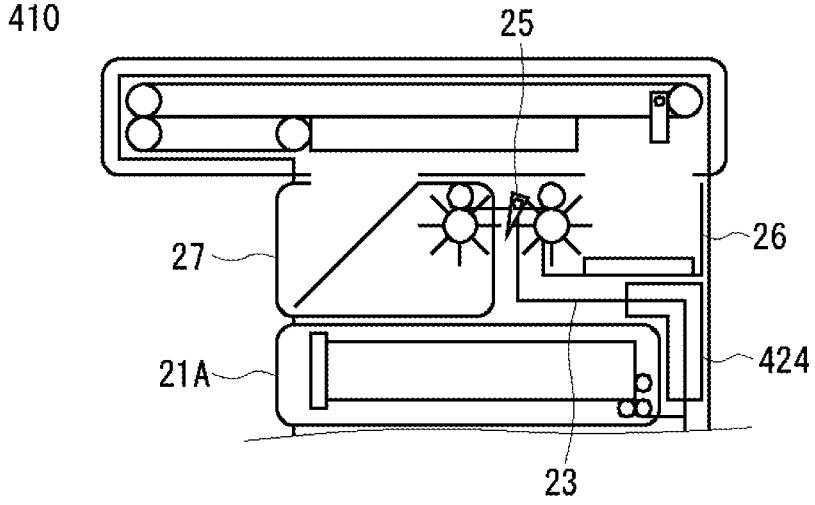
FIG. 16B is a schematic diagram illustrating configuration of a banknote pay-out device according to another exemplary embodiment.
Figure 16C:
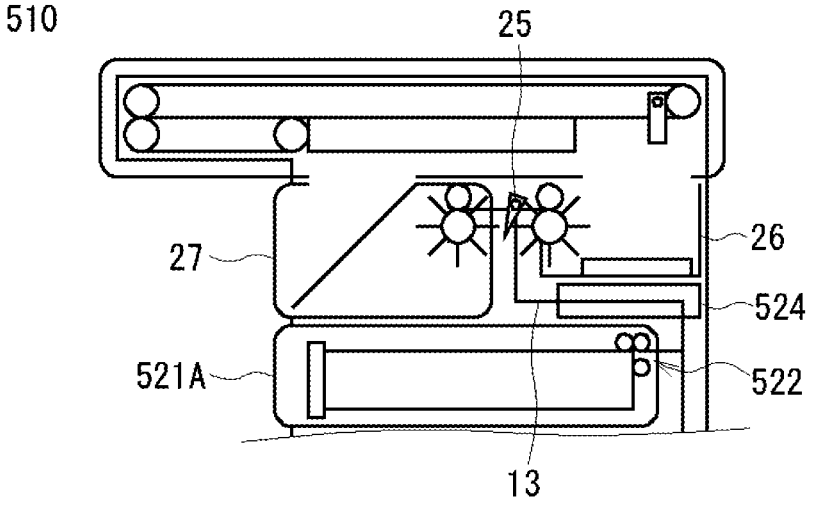
FIG. 16C is a schematic diagram illustrating configuration of a banknote pay-out device according to another exemplary embodiment.

Moreover, in the first exemplary embodiment described above, explanation has been given regarding a case in which the classification section 24 is at the same height as the uppermost banknote storage box 21A, and is provided to part of the conveyance section 23 where the banknote conveyance path runs in the vertical direction. However, the present disclosure is not limited thereto, and, as in a banknote pay-out device 410 illustrated in FIG. 16B, for example, at least a portion of a classification section 424 may be disposed at an upper side of the banknote storage box 21A. Moreover, as in a banknote pay-out device 510 illustrated in FIG. 16C, substantially all of a classification section 524 may be disposed at an upper side of an uppermost banknote storage box 521A. In such cases, a feed-out section 522 may be disposed at a rear side upper portion of the banknote storage box 521A. The same applies in the second exemplary embodiment.

Figure 17:
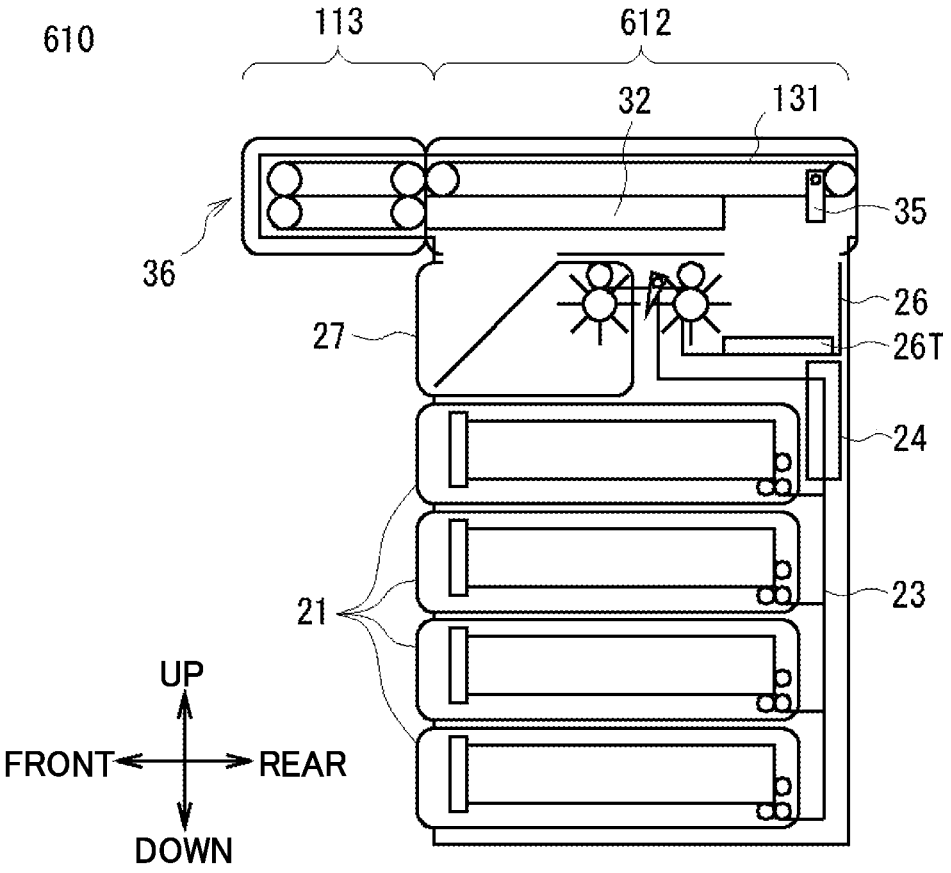
FIG. 17 is a schematic diagram illustrating configuration of a banknote pay-out device according to another exemplary embodiment.

Moreover, in the second exemplary embodiment described above, explanation has been given regarding a case in which in the main unit 112, the movable conveyor belts 132 are provided and belts are built into the stage 126T, and the push-out section 35 is omitted. A banknote bundle W is gripped from above and below by the respective belts, and the banknote bundle W is conveyed in the front-rear direction by running the belts (FIG. 10). However, the present disclosure is not limited thereto, and as in a banknote pay-out device 610 illustrated in FIG. 17, for example, in a storage unit 612, a gripping conveyance guide 32 similar to that of the first exemplary embodiment and a stage 26T may be provided, and a push-out section 35 may also be provided so as to convey banknote bundles W in the front-rear direction with the push-out section 35 similarly to in the first exemplary embodiment.

Figure 18:
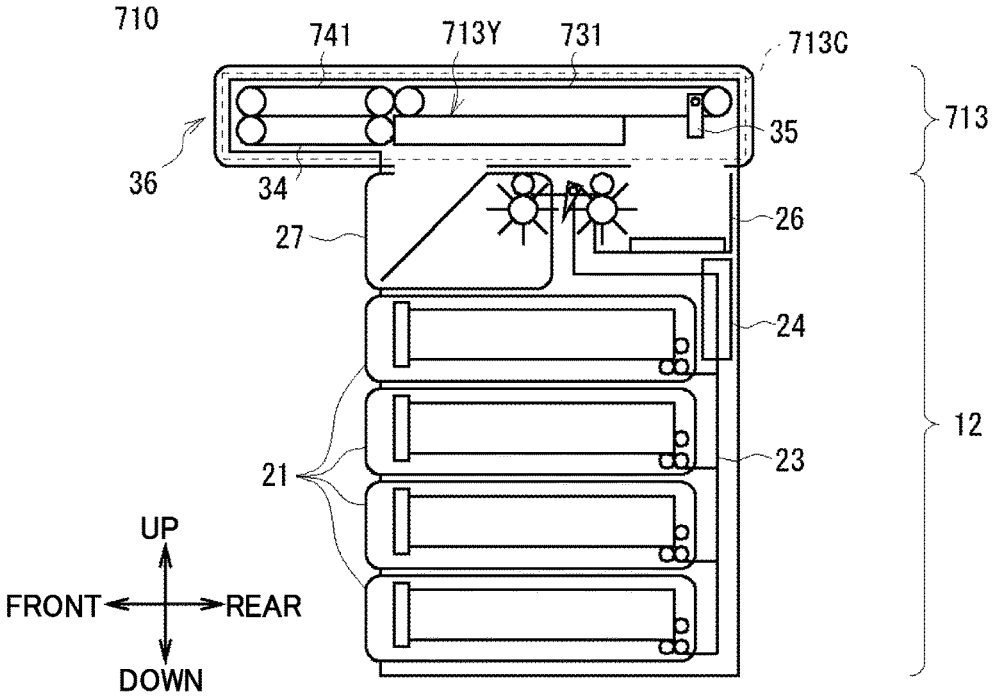
FIG. 18 is a schematic diagram illustrating configuration of a banknote pay-out device according to another exemplary embodiment.

Moreover, in the first exemplary embodiment described above, explanation has been given regarding a case in which the bundle conveyance section 13C is provided with upper belts 31 that connect the vicinity of the front end to the vicinity of the rear end of the bundle conveyance casing 30 at the upper side of the bundle conveyance path 13Y. However, the present disclosure is not limited thereto, and, as in a banknote pay-out device 710 illustrated in FIG. 18, for example, in bundle conveyance section 713C of a bundle conveyance unit 713 there may be upper rear belts 731 and upper front belts 741 configured similarly to the upper rear belts 131 and the upper front belts 141 (FIG. 10) of the second exemplary embodiment provided at the upper side of a bundle conveyance path 713Y.

Moreover, in the second exemplary embodiment described above, explanation has been given regarding a case in which in the storage unit 117, similarly to in the storage unit 12 of the first exemplary embodiment, the stacking hole 26H and the intake hole 27H are formed so as to be substantially front-rear symmetrical, and the front passage hole 30HF and the rear passage hole 30HR are respectively formed at substantially front-rear symmetrical positions in the rear bundle conveyance unit 118. However, since the attachment direction of the rear bundle conveyance unit 118 to the storage unit 117 is fixed in the second exemplary embodiment, these elements may be formed so as to be front-rear asymmetric.

Moreover, in the first exemplary embodiment described above, explanation has been given regarding a case in which the present disclosure is applied to the banknote pay-out device 10 that pays out banknotes. However, the present disclosure is not limited thereto, and may be applied, for example, to various devices that are capable of storing paper sheet-shaped media such as cash vouchers, securities, or tickets of various types, and to various devices for handing such media to a user. The same applies in the second exemplary embodiment.

Moreover, the present disclosure is not limited to the respective exemplary embodiments described above, nor to the other exemplary embodiments described above. Namely, the present disclosure encompasses application to exemplary embodiments arrived at by appropriately combining each exemplary embodiment described above with part or all of other exemplary embodiments described above, and to exemplary embodiments arrived at by extracting a part thereof.

Moreover, in the third exemplary embodiment described above, in the reject storage box, an inclined face is provided inclined such that the switching section side is adjacent to the bundle conveyance path, and in a cases in which the bundle conveyance section is the storage unit and the bundle conveyance unit combined such that the reject storage box is positioned on the handover port side, the medium bundle from the handover port is taken in and, in a state in which the conveyance guide has been moved to the open-for-stacking position, the medium bundle is conveyed further than the intake hole to an opposite direction side opposite to the conveyance direction, and after the conveyance guide has been moved to the open-for-intake position, the medium bundle is dropped from the intake hole, caused to slide on the inclined face, and be stored in the reject storage box.

Accordingly, in the banknote pay-out device 210, due to conveying a banknote bundle W from the pay-out port 36 to the opposite side of the intake hole 227H initially, the banknote bundle W can be guided into the second storage space 227S2 by causing the banknote bundle W dropped from the bundle conveyance path 213Y to first abut the vicinity of the upper end of the inclined face 227L in the reject storage box 227, and then to be guided into the second storage space 227S2 while being slide with barely any change in the orientation of the banknote bundle W.

Moreover, in the third exemplary embodiment described above, in the bundle conveyance section, a push-out section is provided that pushes out the medium bundle along the bundle conveyance path and that retracts from the bundle conveyance path at least in the vicinity of the handover port, the bundle conveyance section conveys the medium bundle taken in through the handover port further toward the opposite direction side than the intake hole using the push-out section, and then after the push-out section has been moved from the conveyance direction side of the medium bundle to the opposite direction side thereof, drops the medium bundle from the intake hole using the push-out section.

The banknote pay-out device 210 is thus configured comparatively simply, and enables a banknote bundle W to be conveyed from the pay-out port 36 to the opposite side of the intake hole 227H, and to be pushed in the direction of the pay-out port 36 and the intake hole 227H, even in cases employing at a given location a push-out section 35 that is not capable of switching the direction for pushing out the banknote bundle W.

Moreover, in the third exemplary embodiment described above, in the stacking section, a stage is provided for placing the medium on, and by moving the stage in a direction orthogonal to the conveyance direction, part of the bundle conveyance path is formed by the stage within the bundle conveyance unit, and in cases in which the bundle conveyance section has moved the push-out section from the conveyance direction side of the medium bundle to the opposite direction side thereof, in a state in which part of the bundle conveyance path is formed by the stage, the medium bundle is conveyed by the push-out section toward the opposite direction side, and in a state in which the stage has been moved away from the bundle conveyance path, the push-out section is moved further toward the opposite direction side than the medium bundle on the stage, then the stage is moved back to a position where the stage forms part of the bundle conveyance section.

Accordingly, the banknote pay-out device 210 is capable of switching the push-out direction of the banknote bundle W by the push-out section 35 while effectively utilizing the stage 226T that is capable of moving the banknote bundle W both inside and outside of the bundle conveyance path 213Y.

Moreover, in the first exemplary embodiment described above, explanation has been given regarding a case in which the banknote pay-out device 10, serving as a medium handover device, is configured by the storage unit 12 serving as a storage unit and the bundle conveyance unit 13 serving as a bundle conveyance unit. The bundle conveyance unit is configured by the bundle conveyance section 13C serving as a bundle conveyance section and the pay-out port 36 serving as a handover port, and the storage unit is configured by the banknote storage boxes 21 serving as medium storage boxes, the classification section 24 serving as a classification section, the stacking section 26 serving as a stacking section, the reject storage box 27 serving as a reject storage box, and the switching section 25 serving as a switching section. However, the present disclosure is not limited thereto, and various other configurations may be achieved of a medium handover device configured by a storage unit and a bundle conveyance unit, a bundle conveyance unit configured by a bundle conveyance section and a handover port, and a storage unit configured by medium storage boxes, a classification section, a stacking section, a reject storage box, and a switching section.

5. Modified Example

5-1. Automated Cash Dispenser and Banknote Pay-Out Device Configuration in Modified Example The banknote pay-out devices of the respective exemplary embodiments discussed so far are each configured by a single overall device. However, the banknote pay-out devices according to the respective exemplary embodiments described above may be split into upper and lower units, and the lower unit may be enclosed by a safe.

Explanation follows regarding a modified example of the first exemplary embodiment described above.

Figure 19:
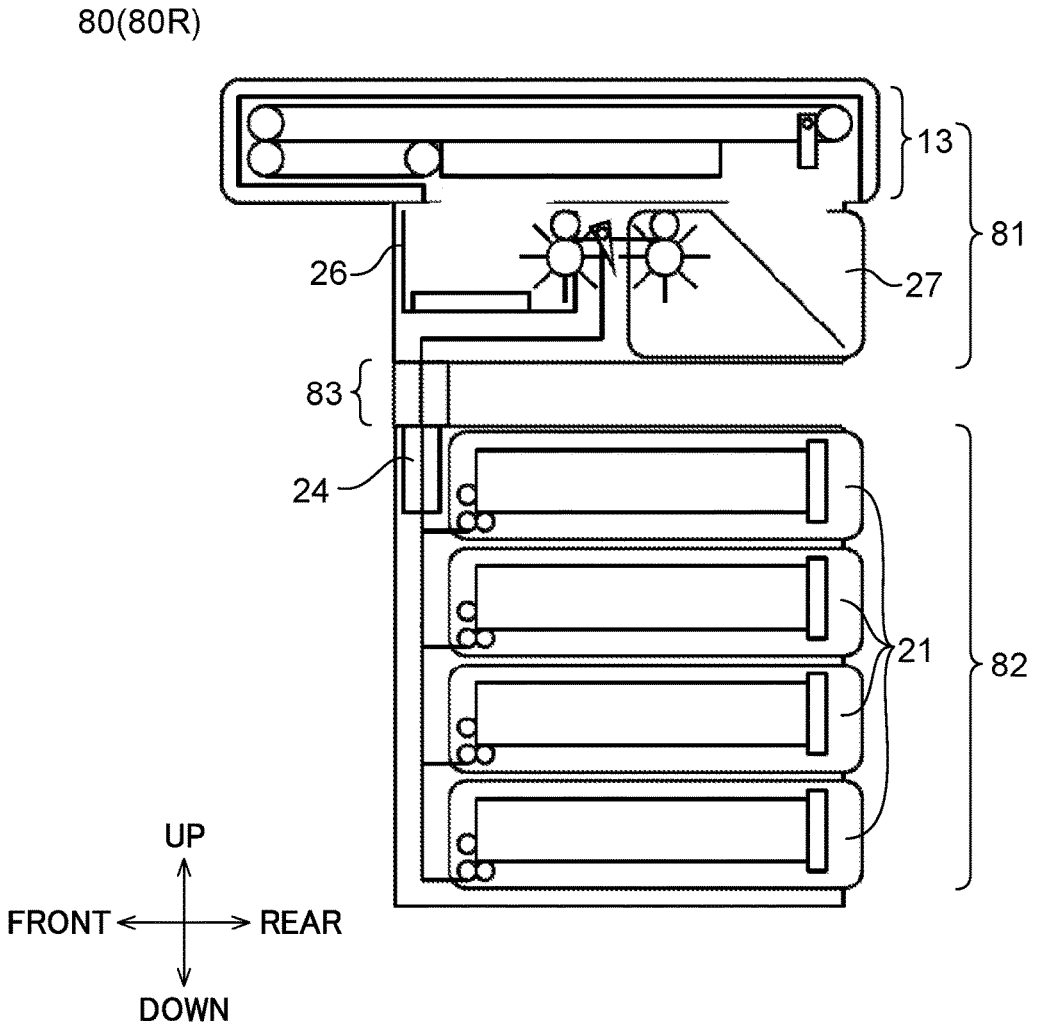
FIG. 19 is a schematic diagram illustrating a state in which a banknote pay-out device according to a modified example of the first exemplary embodiment is assembled as a rear-facing machine.

FIG. 19 corresponds to FIG. 2B, and is a schematic diagram illustrating a state in which a banknote pay-out device 80 according to a modified example of the first exemplary embodiment has been assembled as a rear-facing machine 80R.

As illustrated in side view from the right in FIG. 19, the banknote pay-out device 80 according to the modified example of the first exemplary embodiment is configured broadly split between an upper unit 81 on the upper side, and a lower unit 82 on the lower side. A passing section 83, described later, is disposed between the upper unit 81 and the lower unit 82, and banknotes are passed between the upper unit 81 and the lower unit 82 through the passing section 83.

The lower unit 82 includes the banknote storage boxes 21 (21A, 21B, 21C, and 21D) and the conveyance section 23 (a part thereof adjacent to the banknote storage boxes 21) in the storage unit 12 of the first exemplary embodiment. On the other hand, the upper unit 81 includes the switching section 25, the stacking section 26, and the reject storage box 27 of the storage unit 12 of the first exemplary embodiment, as well as the bundle conveyance unit 13 and the gripping conveyance guide 32 of the first exemplary embodiment. Note that FIG. 19, FIGS. 20A, and 20B, and the following explanation describe a device in which the classification section 24 of the first exemplary embodiment is provided to the lower unit 82. However, the classification section 24 may be provided to the upper unit 81.

Figure 20A:
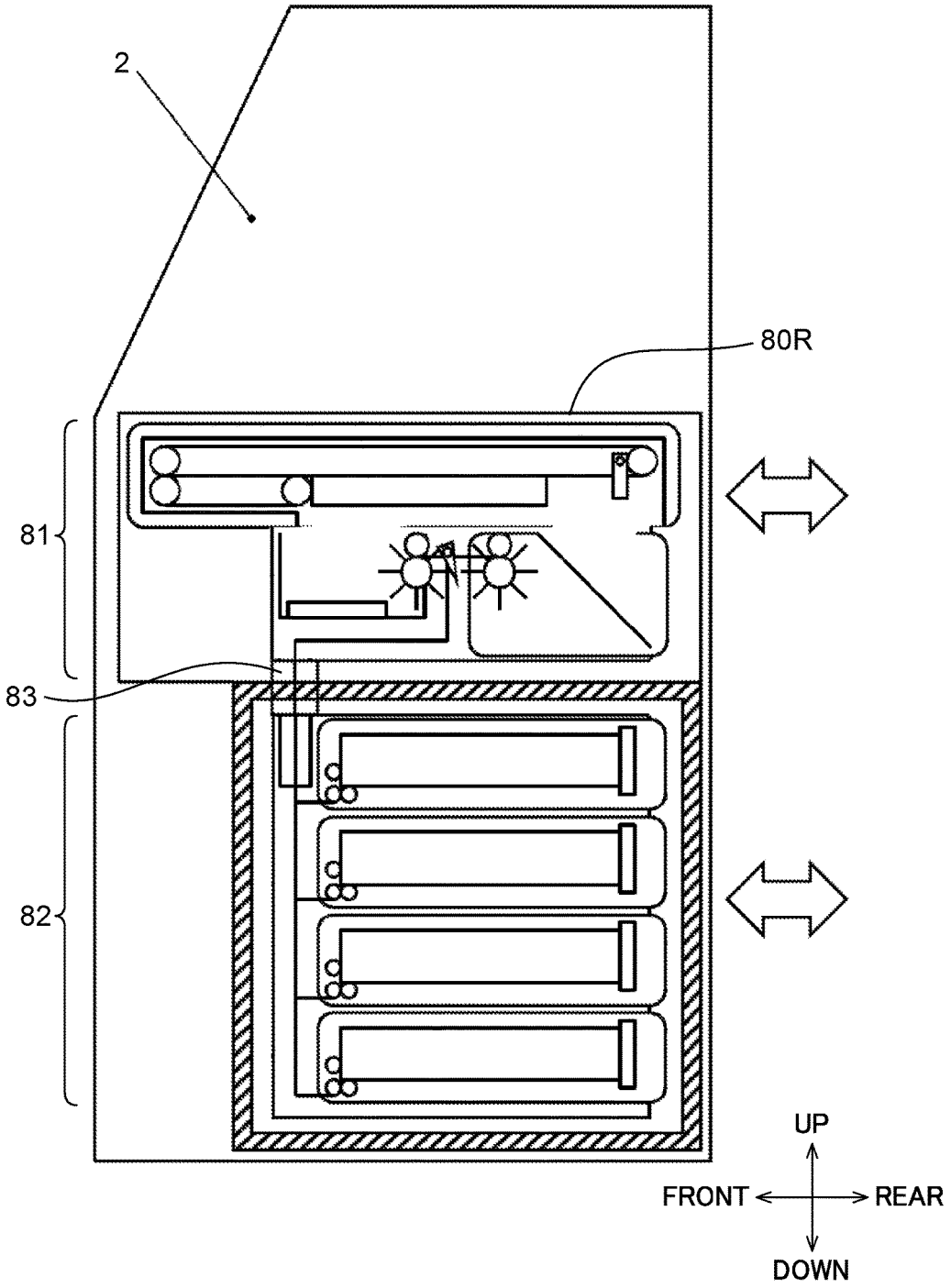
FIG. 20A is a diagram illustrating configuration of the rear-facing machine illustrated in FIG. 19 when installed in a casing.

In the interest of improving security, during installation of the banknote pay-out device 80 in the box shaped casing 2 of the automated cash dispenser 1 illustrated in external view in FIG. 1, the periphery of the lower unit 82 is enclosed in a strong safe 84. FIG. 20A illustrates a state in which the banknote pay-out device 80R illustrated in FIG. 19 has been installed in the casing 2. A rear face side of the safe 84 illustrated in FIG. 20A is provided with a safe door, not illustrated in the drawings. Opening this safe door enables the lower unit 82 to be pulled out toward the rear, and enables the pulled-out lower unit 82 to be housed inside the safe 84. Moreover, a casing door, not illustrated in the drawings, is provided to a rear face side of the casing 2. Opening this casing door enables the upper unit 81 to be pulled out toward the rear, and enables the pulled-out upper unit 81 to be housed inside the casing 2.

Note that the passing section 83 that joins a conveyance path of the lower unit 82 to a conveyance path of the upper unit 81 is mounted to the safe 84. The passing section 83 is mounted with a guide 85 that conveys banknotes, conveyance rollers 86, and a sensor 87 that detects the presence or absence of a banknote. The passing section 83 is operated by drive input from the conveyance section 23 in the upper unit 81 or the lower unit 82. Note that configurations may be adopted in which the passing section 83 is provided with the guide 85 alone, or with the guide 85 and the sensor 87 alone, in consideration of the thickness of the walls of the safe 84.

Figure 21:
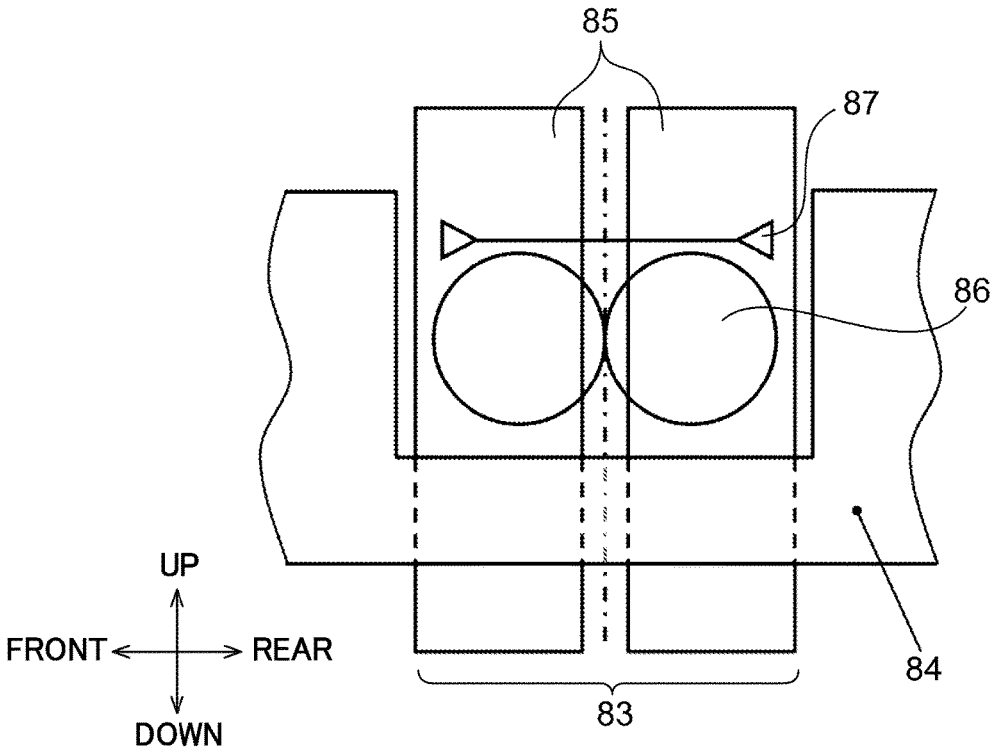
FIG. 21 is an enlarged diagram of a passing section 83 illustrated in FIG. 20A and the vicinity thereof.

FIG. 21 is an enlarged view of the vicinity of the passing section 83 illustrated in FIG. 20A, and illustrates the passing section 83 mounted to the safe 84. The dotted line shown at the center of FIG. 21 illustrates a conveyance path along which banknotes are conveyed between the lower unit 82 and the upper unit 81.

Figure 20B:
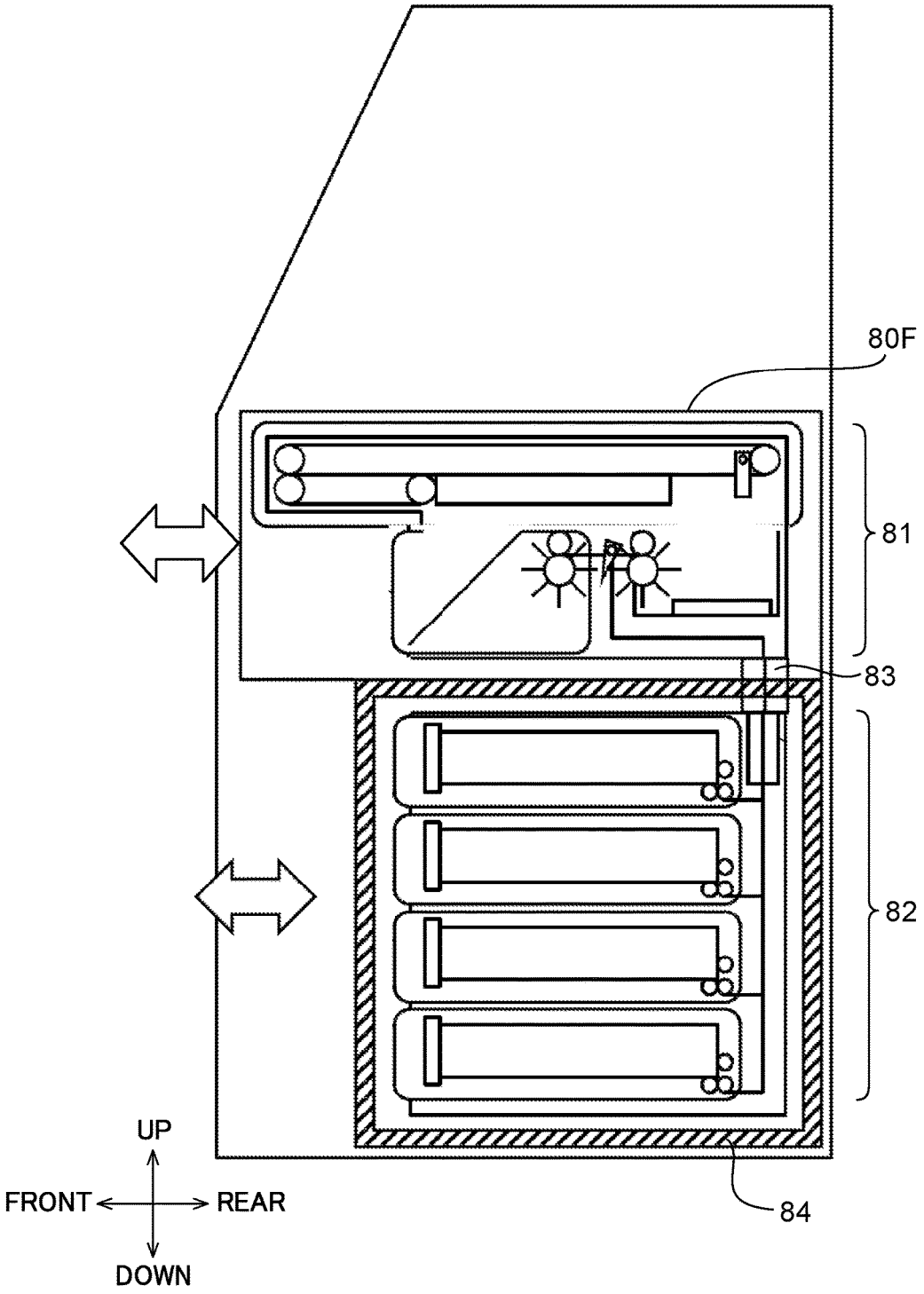
FIG. 20B is a diagram illustrating configuration of a banknote pay-out device according to a modified example of the first exemplary embodiment assembled as a front-facing machine.

The banknote pay-out device 80 is capable of being assembled as a front-facing machine front-rear reversed from configuration illustrated in FIG. 19 and FIG. 20A. FIG. 20B illustrates a state in which the banknote pay-out device 80 assembled as a front-facing machine 80F has been installed in the casing 2. The safe 84 in FIG. 20B differs from that of the rear-facing machine illustrated in FIG. 20A, in that a safe door, not illustrated in the drawings, is provided at a front face side of the safe 84, and a casing door, not illustrated in the drawings, is provided at a front face side of the casing 2. Opening the respective doors allows the upper unit 81 and the lower unit 82 to be pulled out toward the front.

In other respects, the banknote pay-out device 80 of the present modified example has the same configuration as the banknote pay-out device 10 of the first exemplary embodiment.

5-2. Comparative Example to Modified Example

Note that in cases in which the banknote pay-out device is configured split into the upper unit 81 and the lower unit 82, there are conceivable ways to implement switching between a front-facing machine and a rear-facing machine other than implementing the switch about a line between the bundle conveyance unit 13 on one side, and the stacking section 26 and reject storage box 27 on the other side as in the present invention. For example, switching between a front-facing machine and a rear-facing machine could be implemented at a line below the stacking section 26 and the reject storage box 27. Specifically, a conceivable configuration enabling changing between a front-facing machine and a rear-facing machine is by front-rear reversing the lower unit 82 with respect to the upper unit 81.

In order to achieve switching between a front-facing machine and a rear-facing machine at a line below the stacking section 26 and the reject storage box 27, it is necessary to dispose the passing section 83 that joins together the conveyance path of the lower unit 82 and the conveyance path of the upper unit 81 at the center of the device. Disposing the passing section 83 in this manner enables the coupling between the conveyance path of the lower unit 82 and the conveyance path of the upper unit 81 to be maintained even when the lower unit 82 alone is front-rear reversed. Namely, it is possible to change between a front-facing machine and a rear-facing machine by front-rear reversing the lower unit 82 with respect to the upper unit 81.

However, generally speaking a reduction in size of the automated cash dispenser 1 is desirable, and it is therefore preferable to keep the height of the banknote pay-out device 80 as low as possible. This is since the height of the banknote pay-out device 80 (the height of the automated cash dispenser 1) is a limiting factor when it comes to the installation location of the automated cash dispenser 1. It is necessary to provide both the upper unit 81 and the lower unit 82 with a space to connect the passing section 83; however, in order to achieve a lower height of the banknote pay-out device 80, the upper unit 81 and the lower unit 82 are preferably brought as close together as possible at all locations other than the space.

Figure 22A:
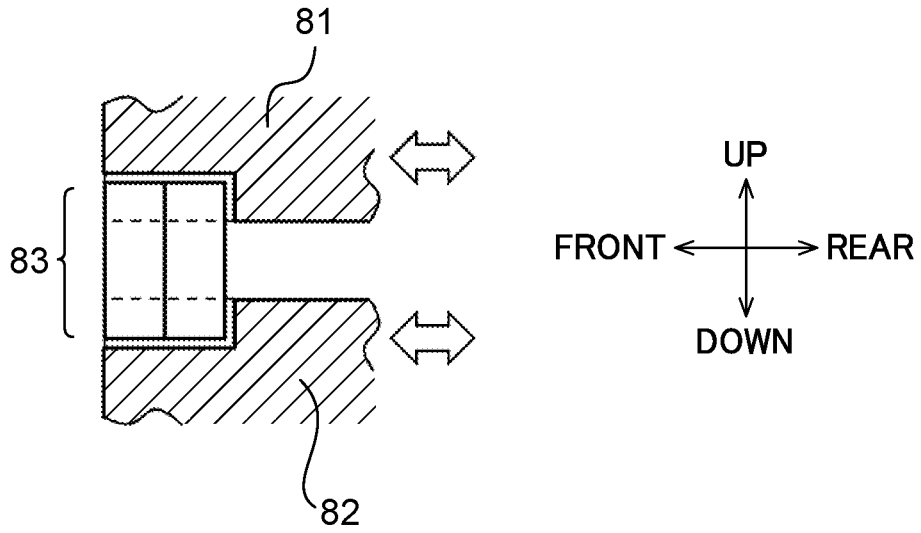
FIG. 22A is a diagram illustrating a relationship between a passing section and an upper unit and lower unit in a comparative example.
Figure 22B:
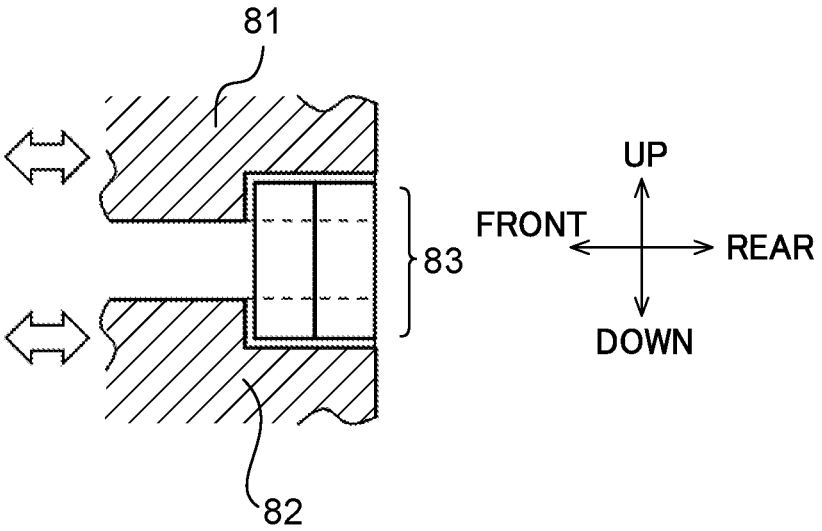
FIG. 22B is a diagram illustrating a relationship between a passing section and an upper unit and lower unit in a comparative example.

In order to bring the upper unit 81 and the lower unit 82 close to one another, a configuration may be considered in which the upper unit 81 and the lower unit 82 are each recessed at only a location corresponding to the passing section. FIG. 22A and FIG. 22B illustrate an upper unit 81 and a lower unit 82 provided with a recess as a space for connecting the passing section 83.

However, in the configuration illustrated in FIG. 22A and FIG. 22B, front-rear direction movement of the upper unit 81 and the lower unit 82 is limited. For example, in the configuration in FIG. 22A, the upper unit 81 and the lower unit 82 can be pulled out at a rear face of the automated cash dispenser. However, when pulling out at the front face, the structure of the upper unit 81 and the lower unit 82 would get in the way of the structure of the passing section 83, obstructing pulling out, such that the upper unit 81 and the lower unit 82 cannot be pulled out at a front face of the automated cash dispenser 1.

Figure 23:
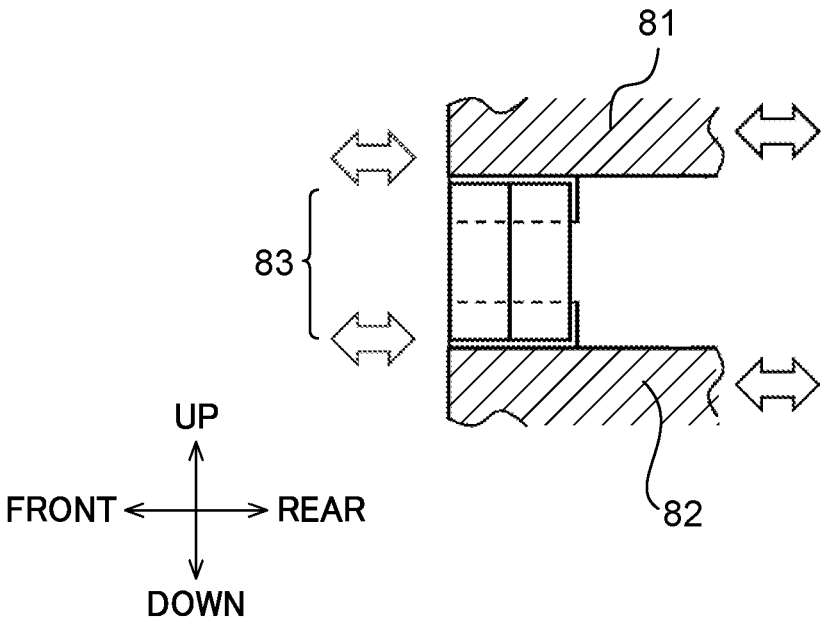
FIG. 23 is a diagram illustrating a relationship between a passing section and an upper unit and lower unit in a comparative example.

In such a structure, in order to enable pulling out of the upper unit 81 and the lower unit 82 toward either a front face direction or a rear face direction of the automated cash dispenser 1, a spacing between the upper unit 81 and the lower unit 82 must be widened such that the passing section does not obstruct pulling out of the upper and lower units, as illustrated in FIG. 23. However, such a structure conflicts with the desire to bring the upper unit 81 and the lower unit 82 closer together in order to reduce the height dimension of the overall device.

In consideration of this point, even in cases such as the present modified example in which the upper unit 81 and the lower unit 82 are configured split, forming a front-rear switching line with the bundle conveyance unit 13 on one side and the stacking section 26 and the reject storage box 27 on the other side is more preferable than a configuration in which a rear-facing machine can be changed to a front-facing machine by front-rear reversing the lower unit 82 with respect to the upper unit 81.

5-3. Operation of the Modified Example

Operation of the banknote pay-out device 80 of the present modified example is basically the same as that of the banknote pay-out device 10 of the first exemplary embodiment.

In the present modified example, the periphery of the lower unit 82 containing the banknote storage boxes 21 is enclosed by the strong safe 84, thereby enabling security to be improved in the automated cash dispenser 1.

In the above a modified example has been explained with reference to the first exemplary embodiment. However, the present modified example is not limited thereto, and may be applied to the banknote pay-out devices of the other exemplary embodiments of the present application.

INDUSTRIAL APPLICABILITY

The present disclosure may be employed, for example, in a banknote pay-out device that houses banknotes in detachable banknote storage boxes, and that pays out banknotes in response to user operation.

The disclosure of Japanese Patent Application No. 2015-027835 is incorporated in its entirety by reference herein.

All cited documents, patent applications, and technical standards mentioned in the present specification are incorporated by reference in the present specification to the same extent as if the individual cited document, patent application, or technical standard was specifically and individually indicated to be incorporated by reference.

The invention claimed is:

1. A medium handover device, comprising:

a storage unit that stores a paper sheet-shaped medium, and stacks any of the medium to be handed over to a user to create a medium bundle;

a bundle conveyance unit that conveys the medium bundle created by the storage unit in a conveyance direction along a bundle conveyance path;

the bundle conveyance unit including a bundle conveyance section that conveys the medium bundle in the conveyance direction along the bundle conveyance path, and a handover port that is disposed at one end in the conveyance direction, and that hands over the medium bundle to the user;

the storage unit including a medium storage box in which the medium is stored, a classification section that classifies the medium that has been fed out from the medium storage box, a stacking section that stacks as normal medium any of the medium classified as normal by the classification section so as to create the medium bundle, and that passes the medium bundle across to the bundle conveyance path of the bundle conveyance unit, a reject storage box that includes a first storage space and a second storage space, the first storage space storing as abnormal medium any of the medium classified as abnormal by the classification section, the second storage space storing medium left behind at the handover port, the medium left behind being taken in at the handover port and conveyed to the second storage space via to the bundle conveyance section, and a switching section that is disposed between the stacking section and the reject storage box, and that switches a conveyance destination of the medium that has passed through the classification section to either the stacking section or the first storage space of the reject storage box; and either the storage unit or the bundle conveyance unit including a conveyance guide that is disposed at a connection location between the storage unit and the bundle conveyance unit, that forms a portion of the bundle conveyance path, and that is to be transitionable between a first communication state in which the bundle conveyance path communicates with the inside of the stacking section, and a first closed state in which the bundle conveyance path is closed off from the inside of the stacking section, and that is transitionable between a second communication state in which the bundle conveyance path communicates with the inside of the reject storage box, and a second closed state in which the bundle conveyance path is closed off from the inside of the reject storage box, wherein the second storage space stores the medium left behind from the bundle conveyance path when the conveyance guide is in the second communication state.

2. The medium handover device of claim 1, further comprising a safe provided inside a casing, and wherein:

the medium storage box is disposed inside the safe, and is provided so as to be capable of being pulled out or stowed away with respect to the casing; and the bundle conveyance unit, the conveyance guide, the stacking section, the reject storage box, and the switching section are disposed outside the safe, and are provided so as to be capable of being pulled out or stowed away with respect to the casing.

3. The medium handover device of claim 1, wherein:

the stacking section includes a stacking hole through which the medium bundle is passed to the bundle conveyance path at a location facing the bundle conveyance unit;

the reject storage box includes an intake hole through which the medium bundle is taken in from the bundle conveyance path at a location facing the bundle conveyance unit; and the conveyance guide is moved to either an open-for-intake position opening up the intake hole, or to an open-for-stacking position opening up the stacking hole.

4. The medium handover device of claim 3, wherein the conveyance guide closes off the stacking hole when at the open-for-intake position, and closes off the intake hole when at the open-for-stacking position.

5. The medium handover device of claim 4, wherein:

the stacking section discharges the normal medium conveyed from the switching section into a stacking space inside the stacking section; and at the open-for-intake position the conveyance guide prevents the normal medium discharged into the stacking space from entering the bundle conveyance path.

6. The medium handover device of claim 4, wherein:

the conveyance guide is moved along the bundle conveyance path in a movement range linking the open-for-intake position and the open-for-stacking position together; and in the movement range of the conveyance guide the bundle conveyance section forms the bundle conveyance path by a portion of an upper belt disposed upward of the conveyance guide and by the conveyance guide, and outside of the movement range of the conveyance guide the bundle conveyance section forms the bundle conveyance path by a remaining portion of the upper belt and by a lower belt disposed downward of the upper belt.

7. The medium handover device of claim 3, wherein the stacking hole and the intake hole are provided to the casing of the storage unit at positions symmetrical to each other with respect to the conveyance direction.

8. The medium handover device of claim 3, wherein the bundle conveyance unit includes a hole at an opposing face that opposes the storage unit, the hole having a size encompassing the stacking hole and the intake hole.

9. The medium handover device of claim 1, further comprising a plurality of the medium storage boxes, wherein the classification section is disposed adjacent to the medium storage box closest to the bundle conveyance unit.

10. The medium handover device of claim 1, wherein:

the storage unit includes a conveyance section that conveys the medium fed out from the medium storage box; and in the medium storage box, a feed-out section that feeds out the medium and hands the medium over to the conveyance section is disposed at a location in the medium storage box distanced from the bundle conveyance unit.

11. A medium handover device, comprising:

a storage unit that stores a paper sheet-shaped medium, and stacks any of the medium to be handed over to a user to create a medium bundle;

a bundle conveyance unit that conveys the medium bundle created by the storage unit in a conveyance direction along a bundle conveyance path;

the bundle conveyance unit including a bundle conveyance section that conveys the medium bundle in the conveyance direction along the bundle conveyance path, and a handover port that is disposed at one end in the conveyance direction, and that hands over the medium bundle to the user;

the storage unit including a medium storage box in which the medium is stored, a classification section that classifies the medium that has been fed out from the medium storage box, a stacking section that stacks as normal medium any of the medium classified as normal by the classification section so as to create the medium bundle, and that passes the medium bundle to the bundle conveyance path of the bundle conveyance unit, a reject storage box that stores as abnormal medium any of the medium classified as abnormal by the classification section, and a switching section that is disposed between the stacking section and the reject storage box, and that switches a conveyance destination of the medium that has passed through the classification section to either the stacking section or the reject storage box; and either the storage unit or the bundle conveyance unit including a conveyance guide that is disposed at a connection location between the storage unit and the bundle conveyance unit, that forms a portion of the bundle conveyance path, and that is transitionable between a first communication state in which the bundle conveyance path communicates with the inside of the stacking section, and a first closed state in which the bundle conveyance path is closed off from the inside of the stacking section, wherein:

the stacking section further includes a stage on which the normal medium is placed, and that is moved in a direction intersecting the conveyance direction; and when the conveyance guide is at the first communication state, the stage moves into the bundle conveyance unit to form a portion of the bundle conveyance path.

12. The medium handover device of claim 11, wherein the stacking section places the stage in an inclined orientation inclined with respect to a horizontal direction when stacking the normal medium on the stage, and the stacking section places the stage in a horizontal orientation that is substantially horizontal when moving the stage into the bundle conveyance unit.

13. A medium handover device, comprising:

a storage unit that stores a paper sheet-shaped medium, and stacks any of the medium to be handed over to a user to create a medium bundle;

a bundle conveyance unit that conveys the medium bundle created by the storage unit in a conveyance direction along a bundle conveyance path;

the bundle conveyance unit including a bundle conveyance section that conveys the medium bundle in the conveyance direction along the bundle conveyance path, and a handover port that is disposed at one end in the conveyance direction, and that hands over the medium bundle to the user;

the storage unit including a medium storage box in which the medium is stored, a classification section that classifies the medium that has been fed out from the medium storage box, a stacking section that stacks as normal medium any of the medium classified as normal by the classification section so as to create the medium bundle, and that passes the medium bundle to the bundle conveyance path of the bundle conveyance unit, a reject storage box that stores as abnormal medium any of the medium classified as abnormal by the classification section, and a switching section that is disposed between the stacking section and the reject storage box, and that switches a conveyance destination of the medium that has passed through the classification section to either the stacking section or the reject storage box; and either the storage unit or the bundle conveyance unit including a conveyance guide that is disposed at a connection location between the storage unit and the bundle conveyance unit, that forms a portion of the bundle conveyance path, and that is transitionable between a first communication state in which the bundle conveyance path communicates with the inside of the stacking section, and a first closed state in which the bundle conveyance path is closed off from the inside of the stacking section, wherein the bundle conveyance section further includes a push-out section that pushes the medium bundle along the bundle conveyance path, and that retracts from the bundle conveyance path at least in the vicinity of the handover port.

* * * * *